US008106896B2

(12) United States Patent
Hwang

(10) Patent No.: US 8,106,896 B2
(45) Date of Patent: Jan. 31, 2012

(54) PICTURE QUALITY CONTROLLING METHOD AND FLAT PANEL DISPLAY USING THE SAME

(75) Inventor: Jong Hee Hwang, Osang-si (KR)

(73) Assignee: LG Display Co., Ltd., Seoul (KR)

( * ) Notice: Subject to any disclaimer, the term of this patent is extended or adjusted under 35 U.S.C. 154(b) by 1199 days.

(21) Appl. No.: 11/640,969

(22) Filed: Dec. 19, 2006

(65) Prior Publication Data

US 2007/0229420 A1 Oct. 4, 2007

(30) Foreign Application Priority Data

Mar. 29, 2006 (KR) ..... 10-2006-0028547

(51) Int. Cl.
*G09G 3/36* (2006.01)
*G09G 5/00* (2006.01)

(52) U.S. Cl. ..... 345/204; 345/904; 345/88

(58) Field of Classification Search ..... 345/204, 345/904, 88
See application file for complete search history.

(56) References Cited

U.S. PATENT DOCUMENTS

2006/0066547 A1* 3/2006 Nitta et al. ..... 345/88
2006/0164407 A1* 7/2006 Cok ..... 345/204

* cited by examiner

*Primary Examiner* — Amr Awad
*Assistant Examiner* — Randal Willis
(74) *Attorney, Agent, or Firm* — Birch, Stewart, Kolasch & Birch, LLP

(57) ABSTRACT

A picture quality controlling method including determining a charge characteristic compensation data of a link sub-pixel electrically connected to a defect sub-pixel and a normal sub-pixel, judging a first and second display surfaces different in brightness from each other, determining a first compensation data which compensates a brightness of the first display surface, modulating the test data using the first compensation data, determining a second compensation data that corrects a brightness of a bordering part inclusive of a part of the first display surface and a part of the second display surface between the first and second display surfaces, adding the first and second compensation data, storing the charge characteristic compensation data and the added compensation data at a memory; adjusting a video data to be displayed in the link sub-pixel using the charge characteristic compensation data, and adjusting video data to be displayed in the first display surface and the bordering part using the added compensation data.

26 Claims, 66 Drawing Sheets

FIG.12E

BORDERING PART

SECOND DISPLAY SURFACE

FIRST DISPLAY SURFACE

| | | | | | | | | | | | |
|---|---|---|---|---|---|---|---|---|---|---|---|
| (234a) | ... | 120 | 120 | 121 | 120 | 122 | 120 | 117.5 | 119.5 | 118.5 | 119.5 | 119.5 | 119.5 | ... |
| (234b) | ... | 120 | 120 | 120 | 121 | 120 | 122 | 120.5 | 118.5 | 120.5 | 119.5 | 120.5 | 120.5 | ... |
| (234a) | ... | 120 | 120 | 121 | 120 | 122 | 120 | 117.5 | 119.5 | 118.5 | 119.5 | 119.5 | 119.5 | ... |
| (234b) | ... | 120 | 120 | 120 | 121 | 120 | 122 | 120.5 | 118.5 | 120.5 | 119.5 | 120.5 | 120.5 | ... |

PICTURE QUALITY CONTROLLING METHOD AND FLAT PANEL DISPLAY USING THE SAME

This application claims the benefit of the Korean Patent Application No. P06-0028547 filed on Mar. 29, 2006, which is hereby incorporated by reference in its entirety.

BACKGROUND OF THE INVENTION

1. Field of the Invention

The present invention relates to a flat panel display device, and more particularly to a picture quality controlling method that improves a picture quality using a repair process and a compensation circuit together, and a flat panel display device using the same.

2. Description of the Related Art

Flat panel display devices are light in weight and can be made small in size compared to a cathode ray tube. The different type of flat panel display devices include a liquid crystal display, a field emission display, a plasma display panel, an organic light emitting diode, etc. Further, the flat panel display device includes a display panel for displaying a picture.

In addition, during a testing process, the display panel is sometimes found to have a defect. One example of a defect is a defect sub-pixel appearing in the test process. In more detail, the defect sub-pixel is generated by a short and open of a signal line, a defect of a thin film transistor ("TFT"), a defect of an electrode pattern, etc. In addition, the defective sub-pixel appears as a dark spot or bright spot on the display screen.

Further, because a bright spot is seen easier than a dark spot, a defect sub-pixel appearing as a bright spot is made to be a dark spot to overcome this problem. Also, as shown in FIG. 1A, a defect sub-pixel made to be the dark spot is essentially not perceived in the display screen using a black gray level. On the contrary, as shown in FIGS. 1B and 1C, the dark defect sub-pixel made as a dark spot is clearly perceived in a display screen using a middle gray level and white gray level, respectively.

Another defect detected during the testing process is caused by a non-uniformity of brightness of a backlight unit. Thus, the panel defect appears as a display stain having a brightness difference on the display screen. That is, if the same signal is applied to a normal area and a panel defect area of the display panel, a picture displayed in the panel defect area is displayed to be darker or brighter than the picture displayed in a normal area. In addition, the defect area may also have a different color impression than a normal area.

Further, the panel defect is mostly generated during the display panel fabrication process. The defect also generally has a fixed form such as dot, line, belt, circle, polygon, etc. or has an undetermined form in accordance with what caused the defect. For example, FIGS. 2A to 2E illustrate different defect shapes. In addition, among the defects shown in FIGS. 2A to 2E, the vertical belt shape defect shown in FIGS. 1A to 1C is mainly generated by an overlapping exposure process, a number difference of lens, etc.

Also, the dot shape panel defect shown in FIG. 2D is mainly generated by impurities, etc. The panel defect may also cause a defect in the overall product. This defect also decreases the amount of produced flat panel displays thereby increasing the manufacturing costs. Further, even though a product having a defect may be shipped as a good product (i.e., because the defect is below a particular threshold), the picture quality deteriorated due to the panel defect reduces the reliability of the product. Accordingly, various methods have been proposed to improve the picture quality caused by the panel defect. However, the related art improvement methods focus mainly on solving problems in the fabrication process.

In addition, the brightness non-uniformity caused by a backlight unit is also a possible picture quality defect appearing in the liquid crystal display device. That is, the liquid crystal display device is not a self-luminous device, and thus irradiates light to the display panel using the backlight unit. The liquid crystal display device also controls the transmittance of the light traveling from the rear surface of the display panel to the front surface thereby displaying a picture. However, the backlight unit causes display problems in the liquid crystal display device. For example, the backlight unit sometimes causes a problem in that various shapes appear on the display screen, e.g., a bright line, because the light from the backlight unit is not uniformly incident to the entire incidence surface of the display panel.

For example, FIG. 3 represents an example of bright lines appearing in the liquid crystal display device using a direct type backlight unit. The related art tries to solve this problem by improving an operation or structure of the backlight unit, which is difficult.

Other various picture quality defects may also be found in the flat panel testing process. Further, the above discussed picture quality defects may also appear to be overlapped in one flat panel display device.

SUMMARY OF THE INVENTION

Accordingly, it is an object of the present invention to provide a picture quality controlling method that is adaptive for improving picture quality by use of a repair process and a compensation circuit together, and a flat panel display device using the same.

To achieve these and other advantages and in accordance with the purpose of the present invention, as embodied and broadly described herein, the present invention provides in one aspect a picture quality controlling method which includes determining a charge characteristic compensation data that compensates a charge characteristic of a link sub-pixel which is electrically connected to a defect sub-pixel and a normal sub-pixel that is adjacent thereto in a display panel; judging a first display surface and a second display surface, which are different in brightness from each other, by supplying a test data to the display panel to measure a brightness of the display panel; determining a first compensation data which compensates a brightness of the first display surface; modulating the test data by use of the first compensation data; determining a second compensation data that corrects a brightness of a bordering part inclusive of a part of the first display surface and a part of the second display surface between the first and second display surfaces by supplying the modulated test data to the display panel; adding up the first compensation data and the second compensation data to calculate the summed compensation data; storing the charge characteristic compensation data and the summed compensation data at a memory; adjusting a video data, which is to be displayed in the link sub-pixel, by use of the charge characteristic compensation data that are stored at the memory; and adjusting a video data, which is to be displayed in the first display surface and the bordering part, by use of the summed compensation data that is stored at the memory.

The defect sub-pixel and the normal sub-pixel, which are included in the link sub-pixel, express the same color.

The charge characteristic compensation data is different in accordance with a location and a gray level of the link sub-pixel.

The memory includes at least any one of EEPROM and EDID ROM.

A current path between the defect sub-pixel and a data line of a display panel is opened, and a pixel electrode of the defect sub-pixel is electrically connected to a pixel electrode of the normal sub-pixel.

The first compensation data is different in accordance with a pixel location within the first display surface and a gray level of the data which is to be displayed in the first display surface.

The second compensation data is different in accordance with a pixel location within the bordering part and a gray level of the data which is to be displayed in the bordering part.

The first compensation data has the same compensation value for pixels which are horizontally adjacent in at least a part of the first display surface.

The second compensation data is determined to have a different compensation value from each other for vertically adjacent pixels and to have a different compensation value from each other for horizontally adjacent pixels in at least a part of the bordering part.

The second compensation data is determined to be a compensation value which increases the brightness of the first display surface and the second display surface that are included in the bordering part.

The second compensation data is determined to be a compensation value which decreases the brightness of the first display surface and the second display surface that are included in the bordering part.

The first compensation data is determined to have a different compensation value from each other for horizontally adjacent pixels in at least a part of the first display surface.

The second compensation data is determined to have a different compensation value from each other for vertically adjacent pixels and to have a different compensation value from each other for horizontally adjacent pixels in at least a part of the bordering part.

The second compensation data is determined to have a compensation value which increases the brightness of the first display surface and the brightness of the second display surface included in the bordering part.

The first and second compensation data are determined to have different compensation values from each other for the same pixel.

The second compensation data is determined to have a compensation value which is lower in the degree of brightness compensation than the first compensation data for the same pixel.

The second compensation data is determined to have a compensation value which decreases the brightness of the first display surface included in the bordering part and increases the brightness of the second display surface included in the bordering part.

The first and second compensation data are determined to have a compensation value which is lower in the degree of brightness compensation than the charge characteristic compensation data for the same pixel.

Adjusting the video data which is to be displayed in the first display surface and the bordering part includes extracting a brightness information and a color difference information of n (n is an integer higher than m) bits from a red data of m bits, a blue data of m bits and a blue data of m bits which are to be displayed in the first display surface and the bordering part; generating the modulated brightness information of n bits by adjusting the brightness information of n bits with the summed compensation data; and generating the modulated red data of m bits, the modulated blue data of m bits and the modulated blue data of m bits by use of the color difference information which is not modulated and the brightness information of n bits which is modulated.

Adjusting the video data which is to be displayed in the first display surface and the bordering part includes dispersing a compensation value of the summed compensation data by use of at least any one of a frame rate control (FRC) method and a dithering method; and adjusting the data, which is to be displayed in the first display surface and the bordering part, with the dispersed data.

The first compensation data includes the data which compensates a brightness of a backlight unit that irradiates light to the display panel.

A flat panel display device according to another aspect of the present invention includes a memory that stores a charge characteristic compensation data for compensating a charge characteristic of a link sub-pixel which is electrically connected to a defect sub-pixel and a normal sub-pixel adjacent thereto in a display panel, and a compensation data for compensating a brightness of a first display surface out of first and second display surfaces which are displayed differently in brightness in the display panel and for compensating a brightness of a bordering part which includes a part of a first display surface and a part of a second display surface between the first display surface and the second display surface; a first compensation part for adjusting the data, which is to be displayed in the first display surface and the bordering part, by use of the compensation data; a second compensation part for adjusting the data from the first compensation part by use of the charge characteristic compensation data; and a driver for displaying the data from the second compensation part in the display panel, and the panel defect compensation data has a compensation value which is calculated by adding up a first compensation value for compensating the brightness of the first display surface and a second compensation value for compensating the brightness of the bordering part.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which:

FIGS. 12A to 12E are diagrams specifying the example shown in FIGS. 11A to 11F;

DETAILED DESCRIPTION OF THE PREFERRED EMBODIMENT

Reference will now be made in detail to the preferred embodiments of the present invention, examples of which are illustrated in the accompanying drawings.

With reference to FIGS. 4A to 31, embodiments of the present invention will be explained. Hereinafter, the embodiments for a flat panel display device and a fabricating method thereof, and a picture quality controlling method and apparatus according to the present invention will be explained centering on a liquid crystal display device among the different types of flat panel display devices.

Figure 1A:
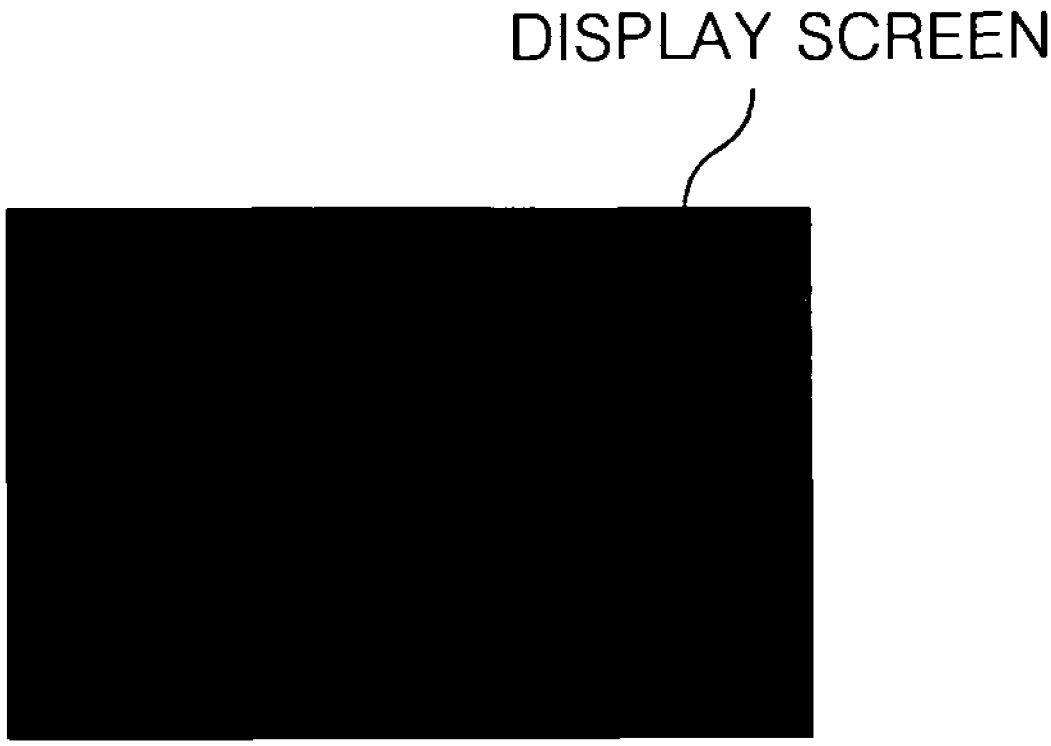
FIG. 1A RELATED ART
FIGS. 1A to 1C are diagrams representing a degree of perception of a dark-spotted defect sub-pixel for each gray level.
Figure 1B:
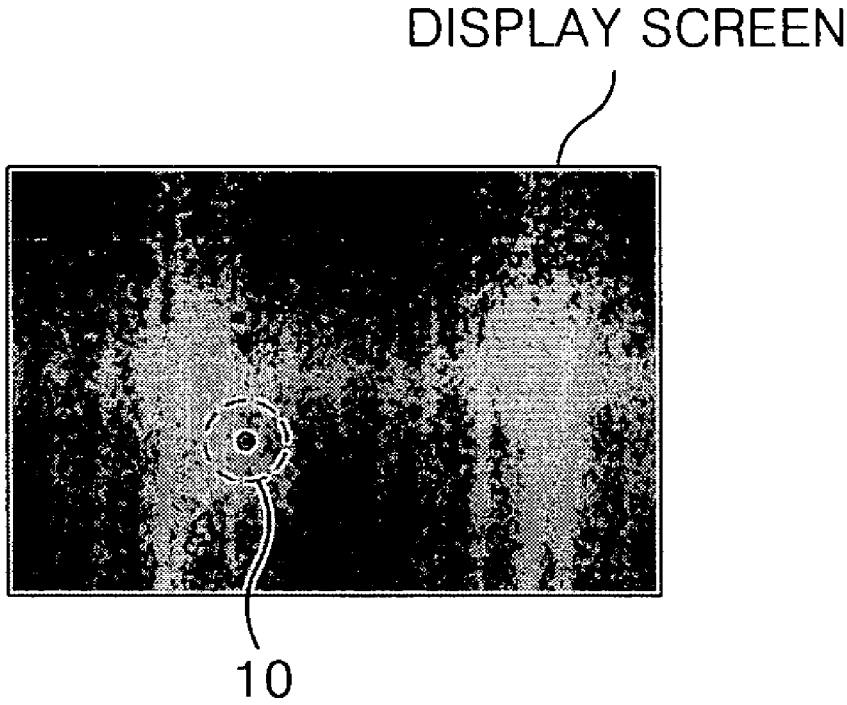
FIG. 1B RELATED ART
Figure 1C:
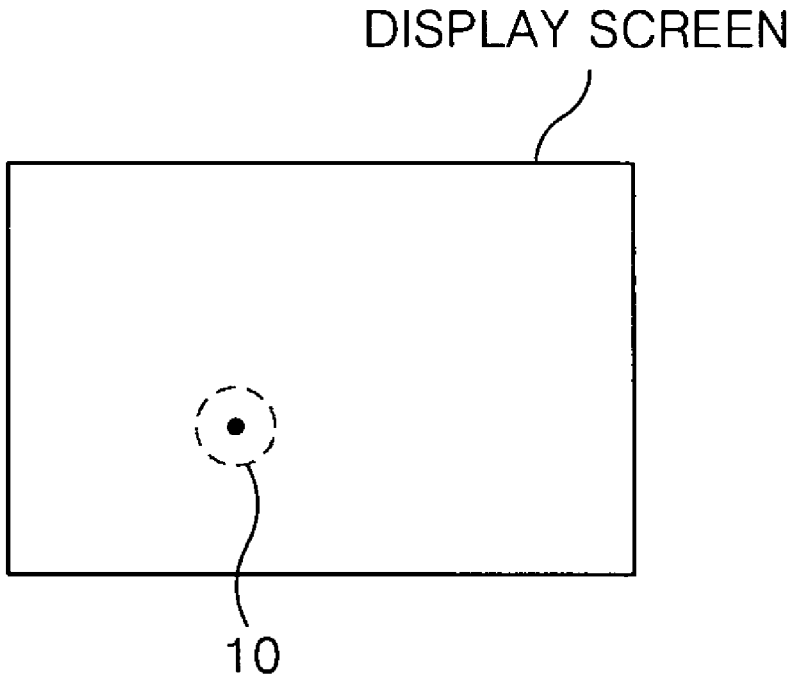
FIG. 1C RELATED ART
Figure 2A:
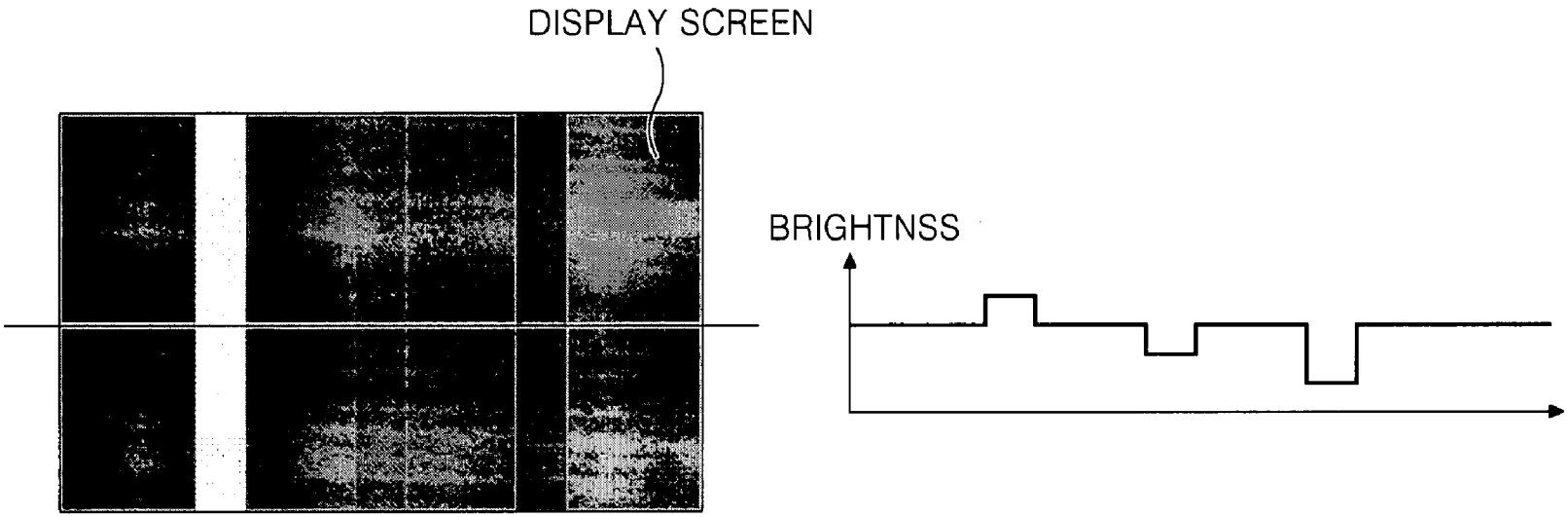
FIG.2A RELATED ART
FIGS. 2A to 2E are diagrams representing various examples of a panel defect.
Figure 2B:
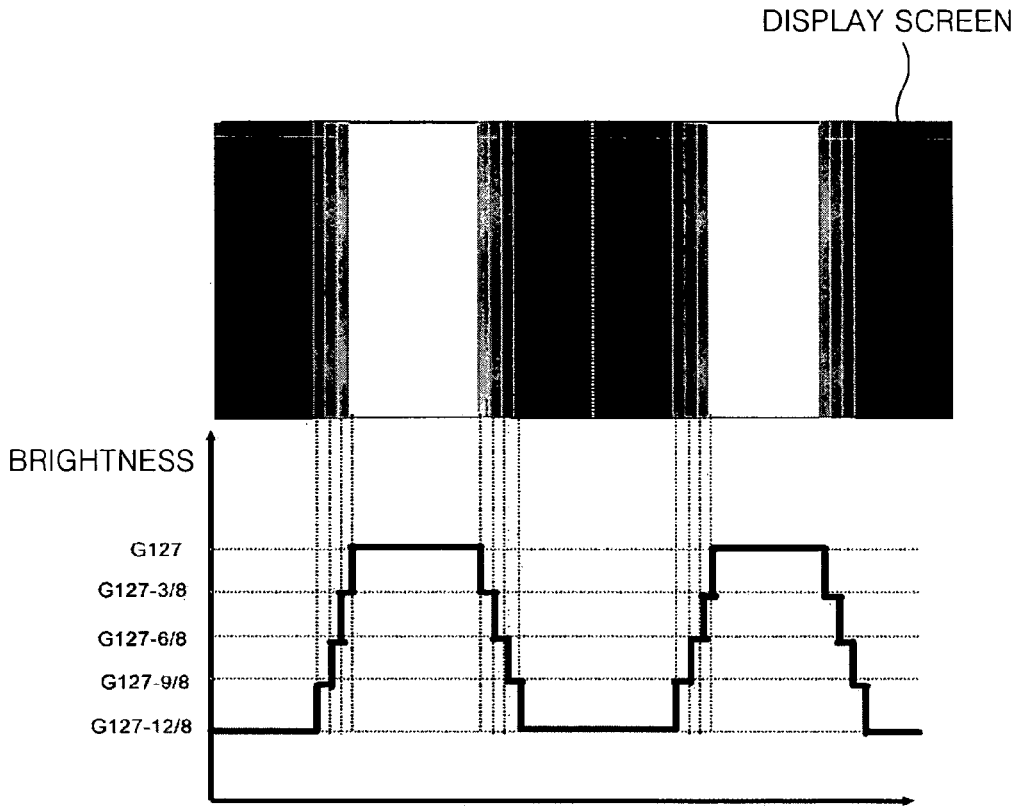
FIG.2B RELATED ART
Figure 2C:
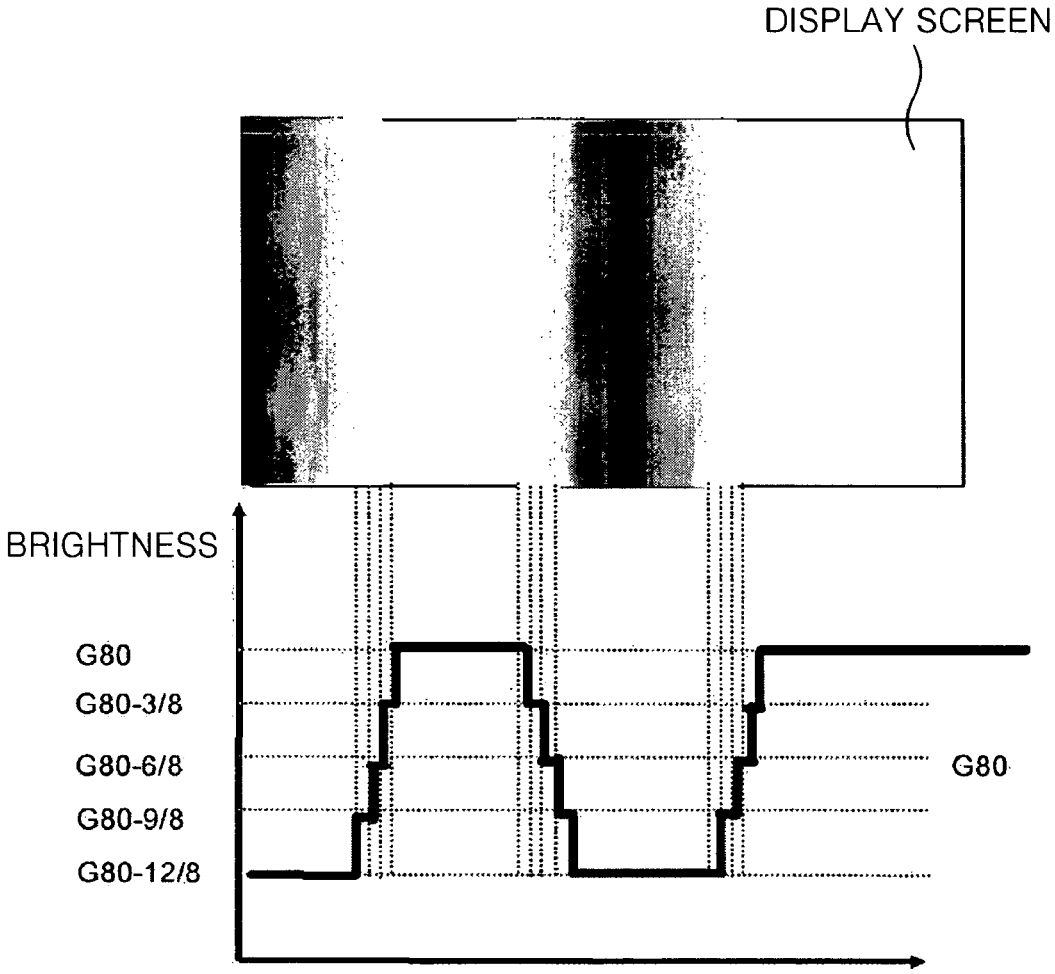
FIG.2C RELATED ART
Figure 2D:
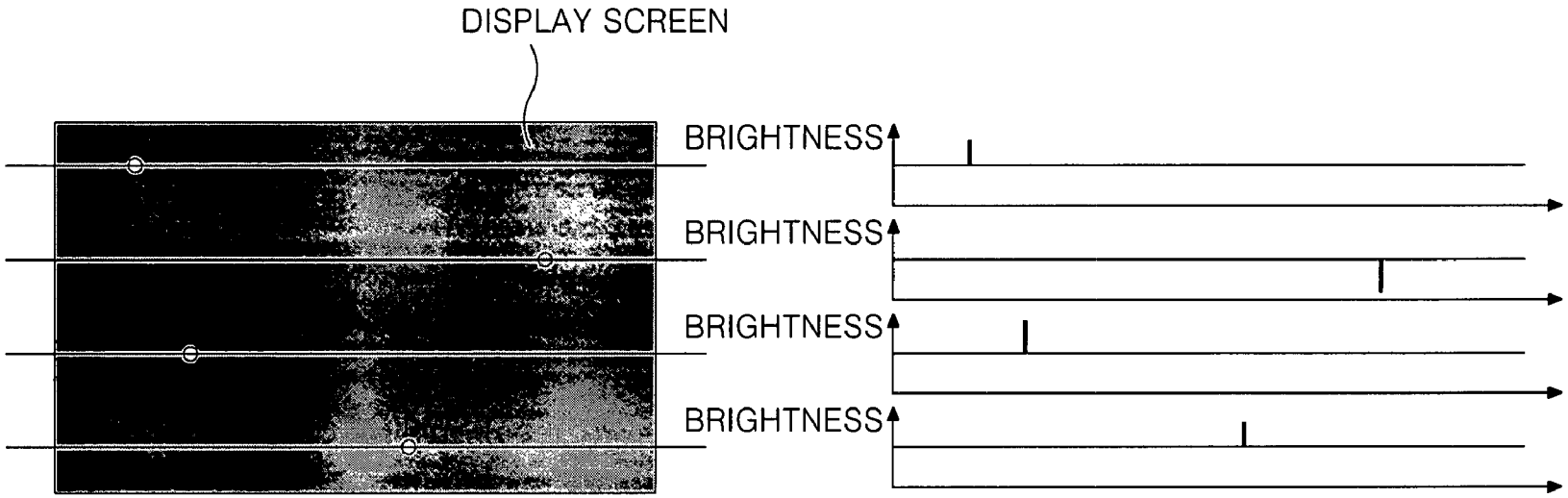
FIG.2D RELATED ART
Figure 2E:
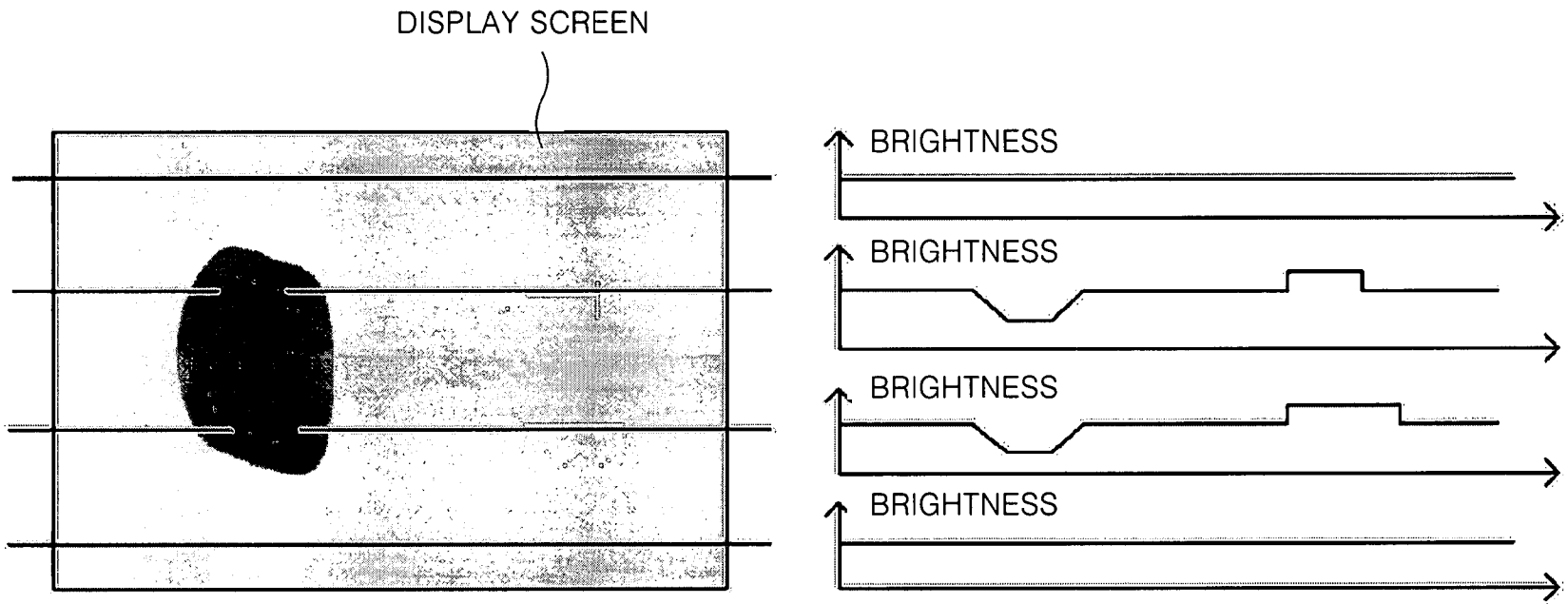
FIG.2E RELATED ART
Figure 3:
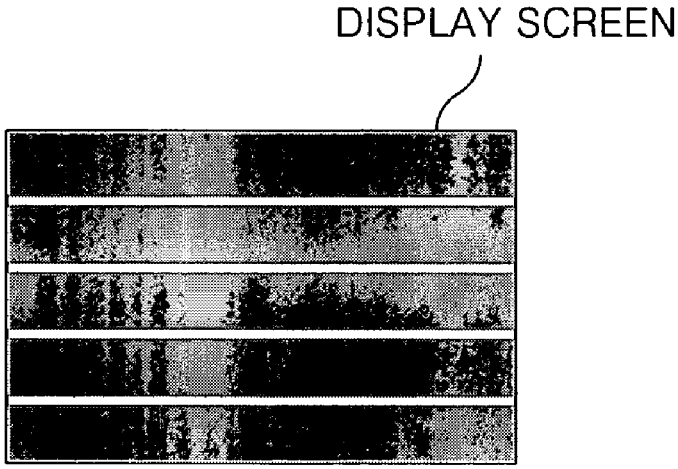
FIG. 3 RELATED ART
FIG. 3 is a diagram representing an example of a bright line caused by a backlight unit.
Figure 4A:
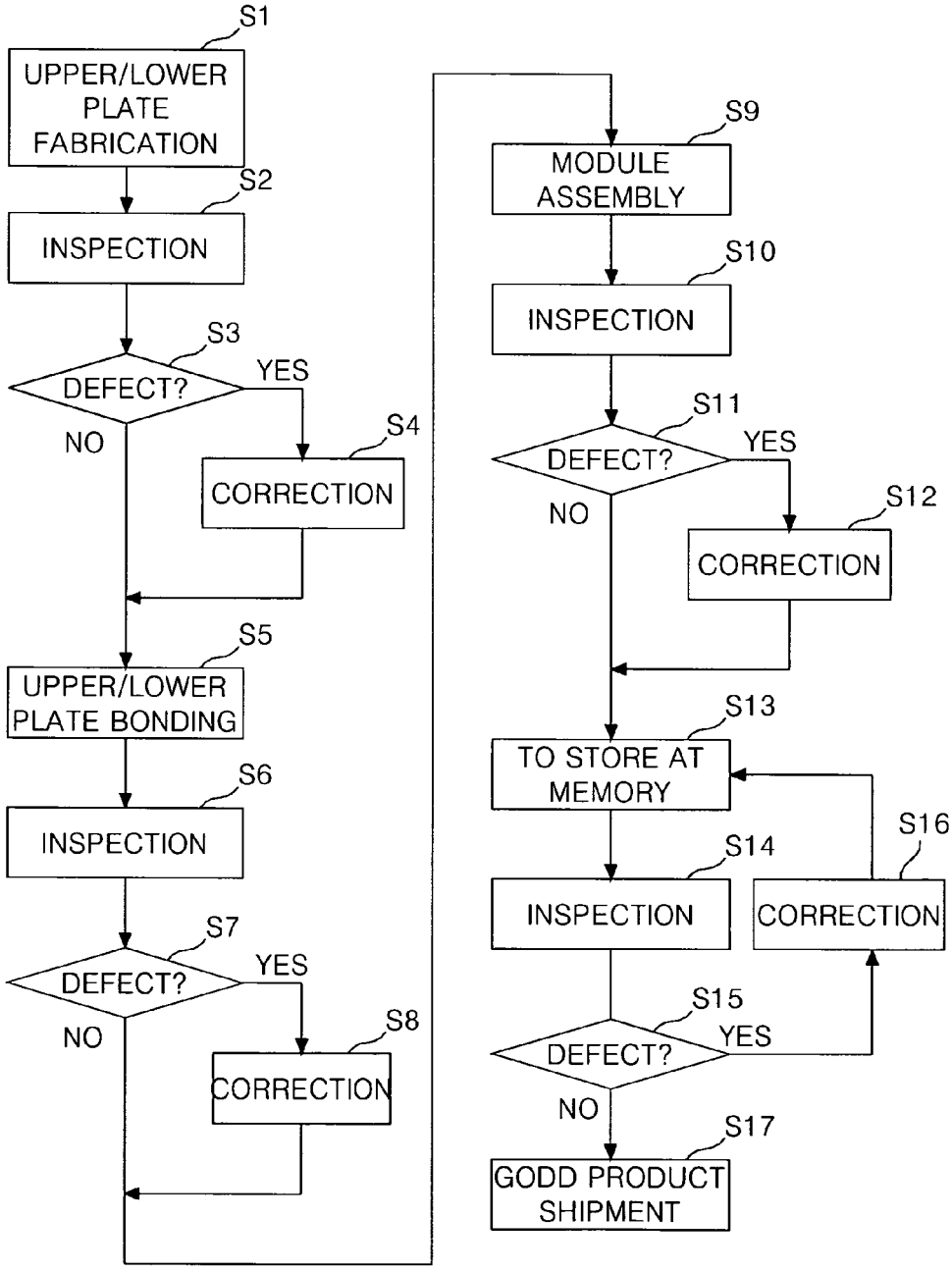
FIGS. 4A and 4B are flowcharts representing a fabricating method of a flat panel display device according to an embodiment of the present invention.

Referring first to FIGS. 4A, the fabricating method includes separately making an upper substrate (color filter substrate) and a lower substrate (TFT array substrate) of a display panel (S1). The step S1 includes a substrate cleaning process, a substrate patterning process, an alignment film forming/rubbing process, etc. Further, in the substrate cleaning process, impurities on the surfaces of the upper and lower substrates are removed with a cleaning solution.

In addition, the substrate patterning process is divided into an upper substrate patterning process and a lower substrate patterning process. In the upper substrate patterning process, a color filter, a common electrode, a black matrix, etc. are formed. In the lower substrate patterning process, signal lines such as a data line and a gate line are formed, a TFT is formed at the crossing part of the data line and the gate line, and a pixel electrode is formed at a pixel area provided by the crossing of the data line and the gate line. On the other hand, the lower substrate patterning process, as shown in FIG. 5, may include the process of patterning a conductive link pattern 12 for linking a normal sub-pixel 11 and a defect sub-pixel 10 which are adjacent.

Subsequently, the fabricating method displays a test picture by applying test data of each gray level to the lower substrate of the display panel, and inspects for the presence or absence of a panel defect and/or a defect sub-pixel using an electrical/magnetic inspection method for the picture (S2). If the defect sub-pixel and/or the panel defect are detected (Yes in S3), the fabricating method performs a correction process to improve the brightness and color difference of a first display surface and/or the defect sub-pixel (S4). The correction process in step S4 is shown in detail in FIG. 4B.

Figure 4B:
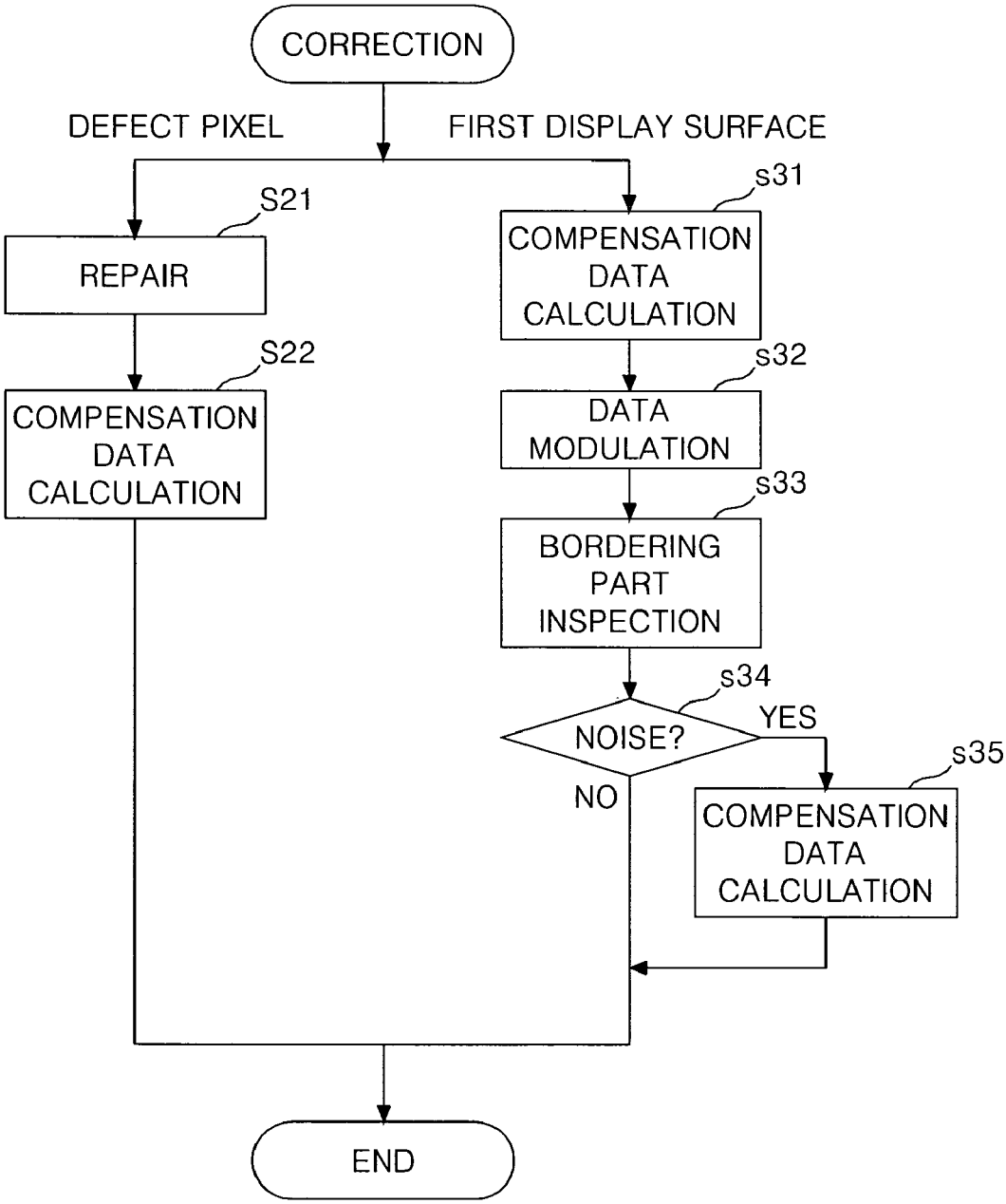

As shown in FIG. 4B, if the defect sub-pixel is detected (Yes in Step S3 of FIG. 4A), a repair process S21 is performed for the detected defect sub-pixel. In addition, one pixel includes red R, green G and blue sub-pixels. Also, a pixel defect generally appears as a sub-pixel unit. Accordingly, the inspection process S2 and the repair process S21 for the defect sub-pixel are performed according to the sub-pixel unit, and this will be the same in the following inspection processes and repair processes.

Figure 5:
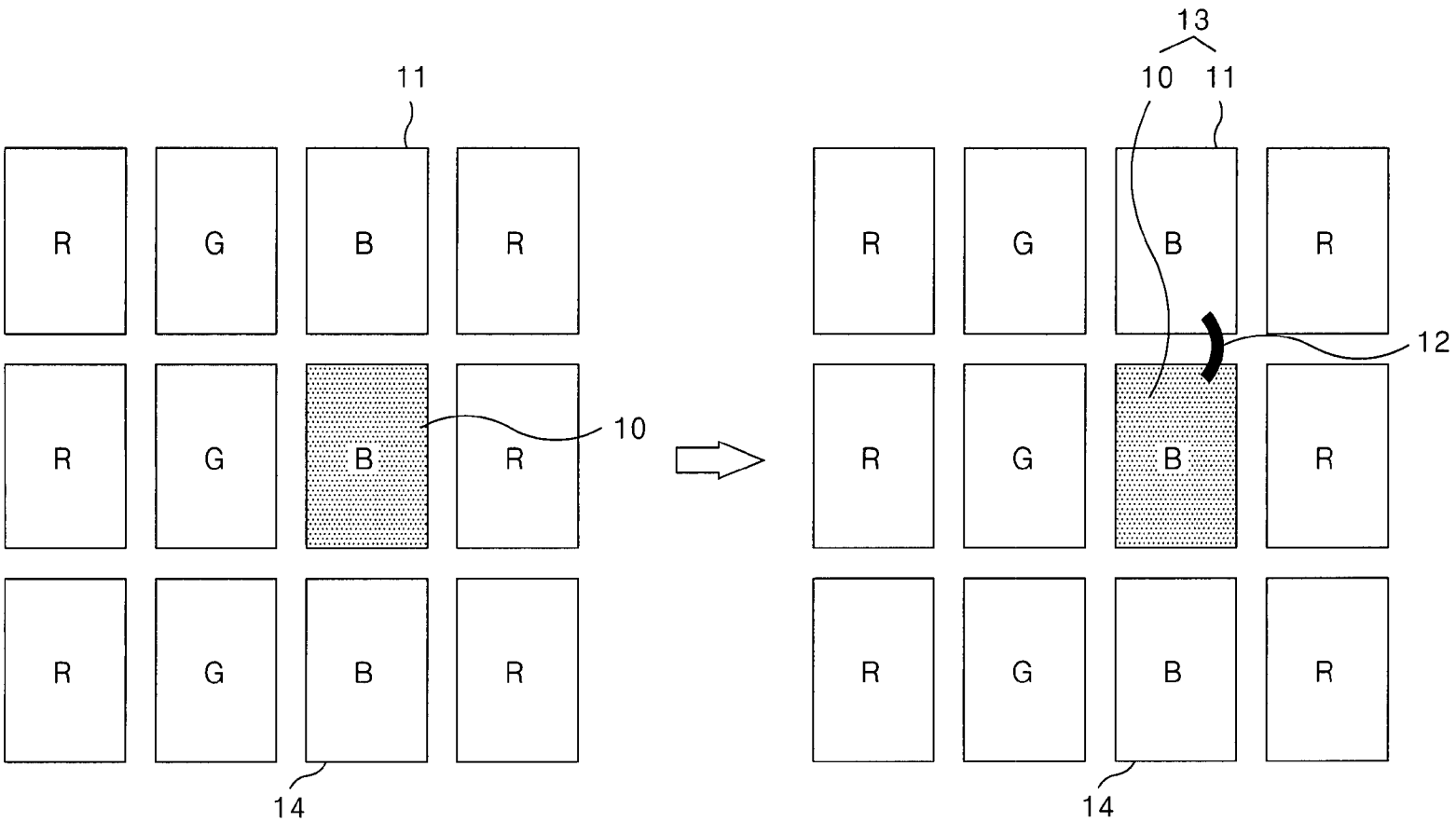
FIG. 5 is a diagram for explaining a repair process according to an embodiment of the present invention.

As shown in FIG. 5, the repair process S21 for the defect sub-pixel includes electrically shorting or linking the defect sub-pixel 10 and the normal sub-pixel 11 adjacent to and having the same color as the defect sub-pixel 10. The repair process S21 includes blocking a path through which a data voltage is supplied to a pixel electrode of the defect sub-pixel 10, and electrically shorting or linking the normal sub-pixel 11 and the defect sub-pixel 10 using the conductive link pattern 12. These processes can be divided into many embodiments such as a method of forming a link pattern using a W-CVD (chemical vapor deposition) process, a method of forming a link pattern while forming the lower substrate, or a method of using a head part of a gate line.

In addition, and with reference to FIG. 5, the linked defect sub-pixel 10 is charged with the same data voltage as the linked normal sub-pixel 11 when the data voltage is charged in the linked normal sub-pixel 11. Further, the link sub-pixel 13 has a different charge characteristic from the normal sub-pixel 14 which is not linked because an electric charge is supplied to the pixel electrodes, which are included in two sub-pixels 10, 11 through one TFT.

For example, when the same data voltage is supplied to the link sub-pixel 13 and the not-linked normal sub-pixel 14, the link sub-pixel 13 has electric charges dispersed to the two sub-pixels 10, 11, and thus the amount of electric charge is little in comparison with the not-linked normal sub-pixel 14. As a result, when the same data voltage is supplied to the not-linked normal sub-pixel 14 and the link sub-pixel 13, the link sub-pixel 13 appears to be brighter than the not-linked normal sub-pixel 14 in a normally white mode. On the contrary, the link sub-pixel 13 appears to be darker than the not-linked normal sub-pixel 14 in a normally black mode. Further, the liquid crystal display device of the normally white mode has a higher transmittance or gray level as the data voltage is lower, and the liquid crystal display device of the normally black mode has a higher tansmittance or gray level as the data voltage is higher.

Generally, a twisted nematic mode ("TN mode") is driven in a normally white mode. The TN mode corresponds to when a pixel electrode and a common electrode of the liquid crystal cell are separately formed on two substrates which face each other with a liquid crystal therebetween and a vertical electric field is applied between the pixel and common electrodes. On the contrary, an in-plane switching mode ("IPS mode") is driven in the normally black mode. The IPS mode corresponds to when the pixel electrode and the common electrode are formed on the same substrate and a horizontal electric field is applied between the pixel and common electrodes.

Returning to FIG. 4B, after the repair process S21 is performed, the information for the presence or absence of the defect sub-pixel 10 together with the information for the location of the link sub-pixel 13 are stored at an inspection computer, and the inspection computer computes the charge characteristic compensation data for each gray level for each location of the link sub-pixel 13 (S22). In addition, the charge characteristic compensation data are data for compensating a charge characteristic of the link sub-pixel 13 by as much as the not-linked normal pixel 14.

On the other hand, because the degree of the brightness difference or color difference between the link sub-pixel 13 and the not-linked normal sub-pixel 14 is different in accordance with the location of the link sub-pixel 13, the charge characteristic compensation data is optimized for each location of the link sub-pixel 13. Further, it is preferable for the charge characteristic compensation data to be different for each gray level so that the link sub-pixel 13 can have the same gray level expression capability as the not-linked normal sub-pixel 14 or to be different for each gray level area inclusive of a plurality of gray levels.

If the panel defect is detected (Yes in S3), the information for the presence or absence of the panel defect together with the location information of each of the pixels located within the first display surface is stored at the inspection computer. The inspection computer computes panel defect compensation data for each gray level for each location of the panel defect (S31). The panel defect compensation data computed by the inspection computer is optimized for each location because the degree of brightness difference or color difference between the first and second display surfaces is different in accordance with the pixel location within the first display surface, and is also optimized for each gray level in consideration of a gamma characteristic, as shown in FIG. 6.

Figure 6:
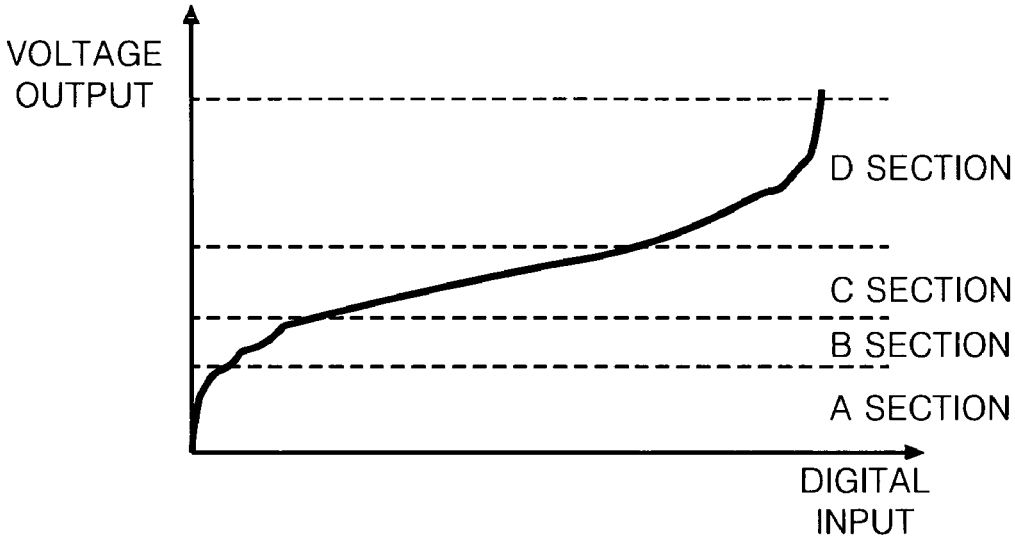
FIG. 6 is a graph representing a gamma characteristic curve.

Accordingly, as shown in FIG. 6, a compensation value can be set for each gray level in each of R, G, B sub-pixels or can be set differently for each gray level section (A, B, C, D) which include a plurality of gray levels. For example, the compensation value is optimized for each location such as '+1' at an arbitrary first pixel location, '−1' at an arbitrary second pixel location, '0' at an arbitrary third pixel location, and is also optimized for each gray level section such as '0' at the 'gray level section A', '0' at the 'gray level section B', '1' at the 'gray level section C' and '1' at the 'gray level section D'.

Therefore, the compensation value can be made different for each location and/or for each gray level within the same first display surface, and can also be made different in accordance with the location within the first display surface even in the same gray level. The compensation value is set to be the same value in each of the R, G, B data of one pixel when correcting brightness, and is set by the unit of one pixel inclusive of the R, G, B sub-pixels. On the contrary, the compensation value is set differently in each of the R, G, B data when correcting color difference. For example, if red appears to be outstanding in a specific panel defect location than the non panel defect location, the R compensation value is lower than the G, B compensation values.

Further, a drive circuit of the flat panel display device displays a gray level range of a discrete brightness distribution in a display panel using a binary data, i.e., a digital video data. If a brightness difference between the gray levels which are adjacent within the gray level range that can be displayed by the drive circuit (i.e., a minimum brightness difference that can be displayed by the drive circuit) is defined to be 'ΔL', then 'ΔL' may have a different value for each flat panel display device by various picture process techniques or a data process capacity of the drive circuit of the flat panel display device. For example, 'ΔL' in a flat panel display device having a drive circuit with a 6 bit process capacity is different from 'ΔL' in a flat panel display device having a drive circuit with an 8 bit process capacity. Further, 'ΔL' is different even between the flat panel display devices having a drive circuit of a same bit process capacity depending on whether or not the picture process technique is applied.

Further, to compensate the brightness and/or color difference of the panel defect by the aspect of the circuit through the correction of the data to be displayed in the first display surface, the brightness of the first display surface is increased or decreased with an interval of 'ΔL' to become close to the brightness of the second display surface. However, if the compensation value of the brightness and/or color difference is less than 'ΔL', it is difficult to completely compensate the brightness and/or color difference of the display device by a simple addition or subtraction of the general digital data.

Figure 7A:
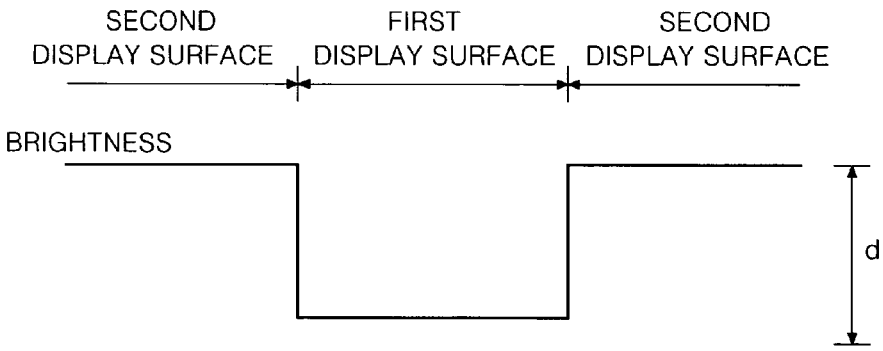
FIGS. 7A to 7C are diagrams representing a brightness characteristic of a bordering part between a first display surface and a second display surface.
Figure 7B:
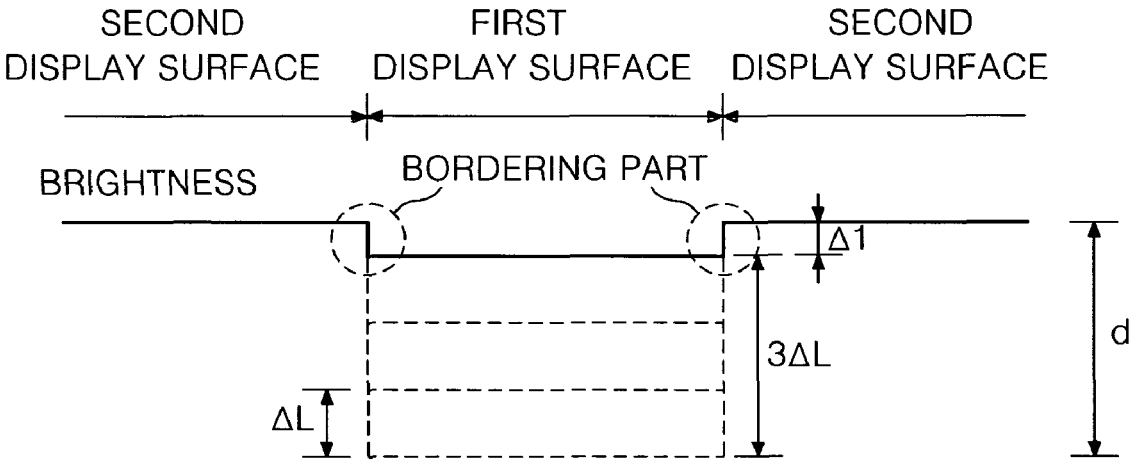
Figure 7C:
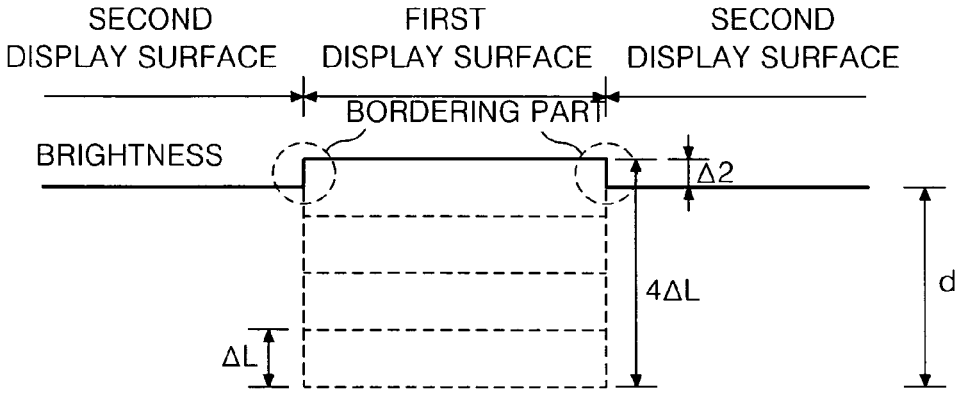

For example, when the brightness difference between the first and second display surfaces is 'd', as in FIG. 7A, and if the brightness of the first display surface is increased by 3ΔL, as in FIG. 7B, the brightness of a bordering part and the first display surface is decreased by Δ1 of less than ΔL in comparison with the second display surface. In addition, if the brightness of the first display surface is increased by 4ΔL, as in FIG. 7C, the brightness of the bordering part and the first display surface is increased by Δ2 of less than ΔL in comparison with the second display surface. Further, it is difficult to completely compensate the brightness and/or color difference for the brightness deviation of less than ΔL like Δ1 and Δ2, and it is likely to observe the difference of the brightness and/or color difference in the bordering part between the first display surface and the second display device with bare eyes.

Also, in the embodiment below, the bordering part is an area inclusive of a bordering line between the first and second display surfaces and a plurality of pixels disposed around it, and is defined as an area to which a compensation value that is different from the compensation value of the first display surface is applied. Accordingly, with reference to FIG. 4B, the fabricating method of the present invention performs an electrical/magnetic inspection on the bordering part (S32, S33) after compensating the brightness of the first display surface using the panel defect compensation data calculated in the step S31 (i.e., after modulating the test data to the panel defect compensation data calculated in the step S31) to apply to the display panel.

In addition, when a bordering part noise is detected as the inspection result of the step S33 (Yes in S34), the information for the presence or absence of the bordering part noise together with the information for the location where the bordering part noise appears is stored at the inspection computer, and the inspection computer calculates the bordering part noise compensation data for each gray level for each location where the bordering part noise appears (S35). The inspection computer calculates the compensation data by summing the bordering part noise compensation data calculated in the step S35 and the panel defect compensation data calculated in the step S31. Further, the summed compensation data have different compensation values from each other for the horizontal lines which are adjacent on the display panel.

That is, if the panel defect compensation data judged in a first display surface inspection process is a first compensation data and the bordering part noise compensation data judged in the bordering part noise inspection process is a second compensation data, and if the compensation data for a first horizontal line is a first type and the compensation data for a second horizontal line is a second type in relation to the first and second horizontal lines which are adjacent to each other and vertical to a boundary between the first and second display surfaces in the display panel, then the first compensation data of the first type and the first compensation data of the second type are set to be identical for vertically adjacent pixels or to be different from each other. Also, the second compensation data of the first type and the second compensation data of the second type are set to be different from each other for the vertically adjacent pixels. Accordingly, the summed compensation data calculated by the sum of the first and second compensation data is set to be different between the vertically adjacent pixels of the first type and the second type.

Next, with reference to FIGS. 8 to 12E, embodiments of the present invention will be explained in detail for a method of setting the summed compensation data.

In more detail, a method of setting the summed compensation data according to a first embodiment of the present invention sets the first compensation data of the first and second types to 0 in the second display surface and to the compensation value of $\pm A\times\Delta L$ in the first display surface when the first display surface and the second display surface have a brightness difference (d) between $A\times\Delta L$ and $(A+1)\times\Delta L$. The second compensation data of the first type is set to 0 in the first and second display surfaces, and the second compensation data of the second type is set to the compensation value of $\pm k\times\Delta L$ for the pixel adjacent to the boundary and for every other pixel on the same line of the first display surface including this pixel.

Further, the second compensation data of the second type can be set to the compensation value for the range from one pixel which is as close to the boundary as possible in the first display surface to the pixel which is away from the boundary at most by half of the distance between both ends of the first display surface. Further, 'A' is a positive integer, 'k' is a positive integer which is less than or equal to 'A', '+' is a brightness increase and '−' is a brightness decrease, and 'd' and 'ΔL' are as defined above.

Figure 8:
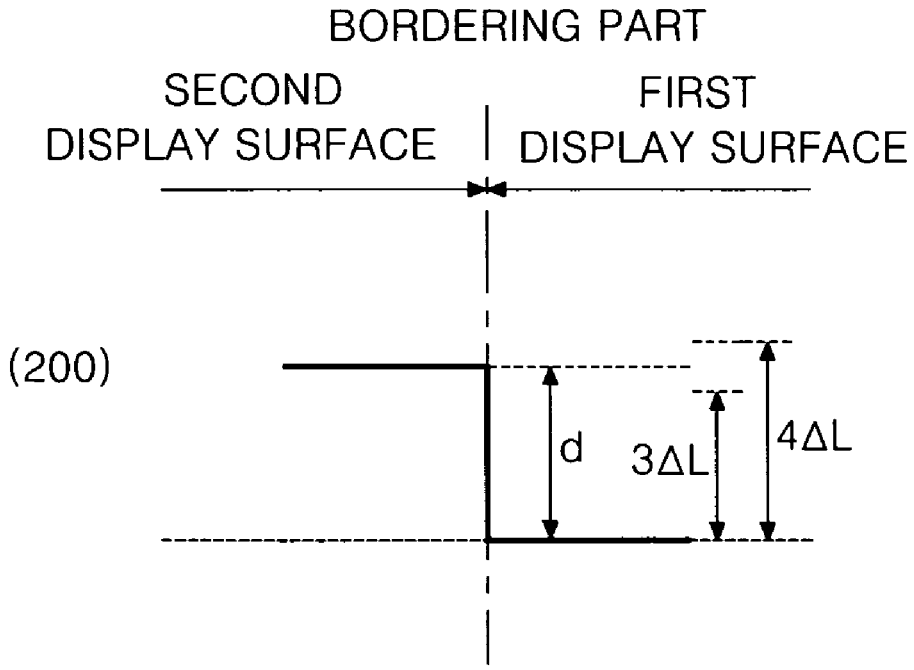
FIG. 8 is a diagram representing an example of a brightness difference between the first display surface and the second display surface.

For example, as shown in FIG. 8, when the brightness of the first display surface is lower by 'd' than the brightness of the second display surface and 'd' is a value between 3ΔL and 4ΔL, a method of setting the summed compensation data according to the first embodiment of the present invention is as follows.

Figure 9A:
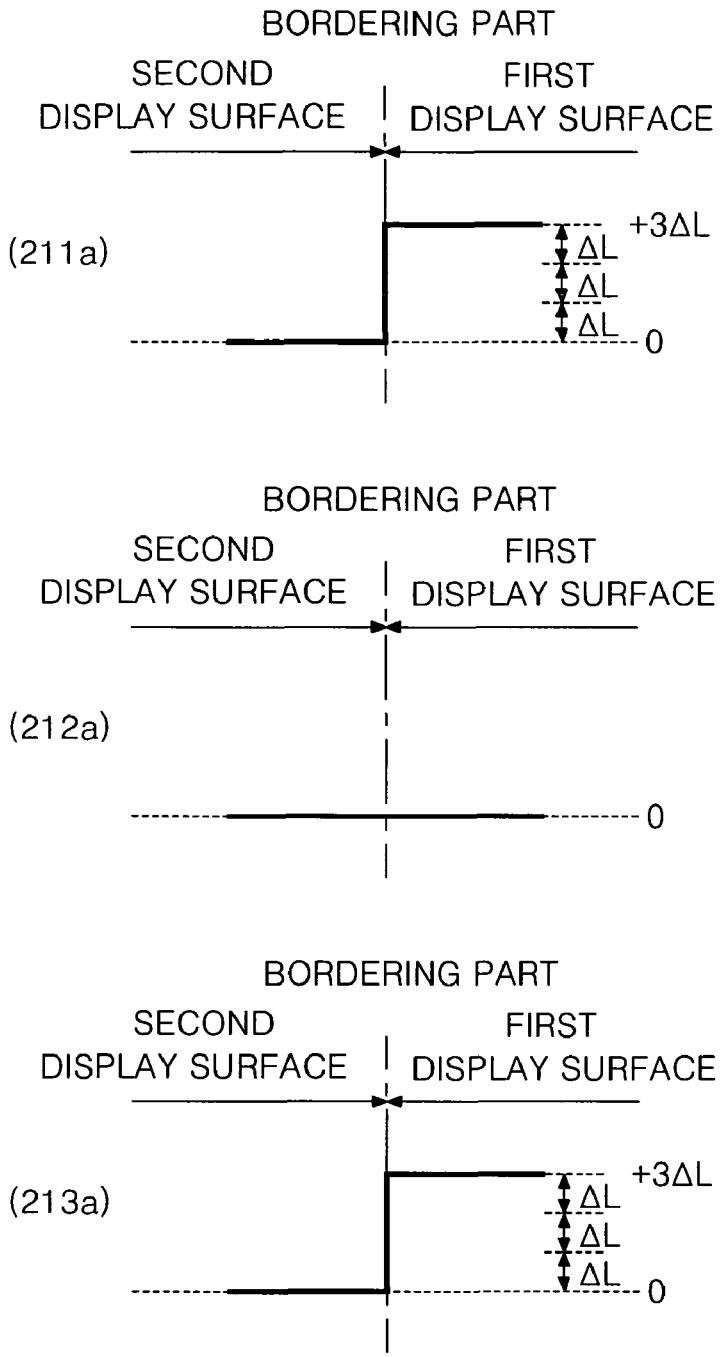
FIGS. 9A to 9F are diagrams representing an example of a compensation value setting-up to compensate the brightness difference of FIG. 8.

Referring to FIG. 9A, a first compensation data 211*a* of the first type is set to 0 in the second display surface and to the compensation value of +3ΔL in the first display surface, and a second compensation data 212*a* of the first type is set to the compensation value of 0 in the first and second display surfaces. Also, the summed compensation data 213*a* of the first type is calculated by the sum of the first compensation data 211*a* of the first type and the second compensation data 212*a* of the first type.

Figure 9B:
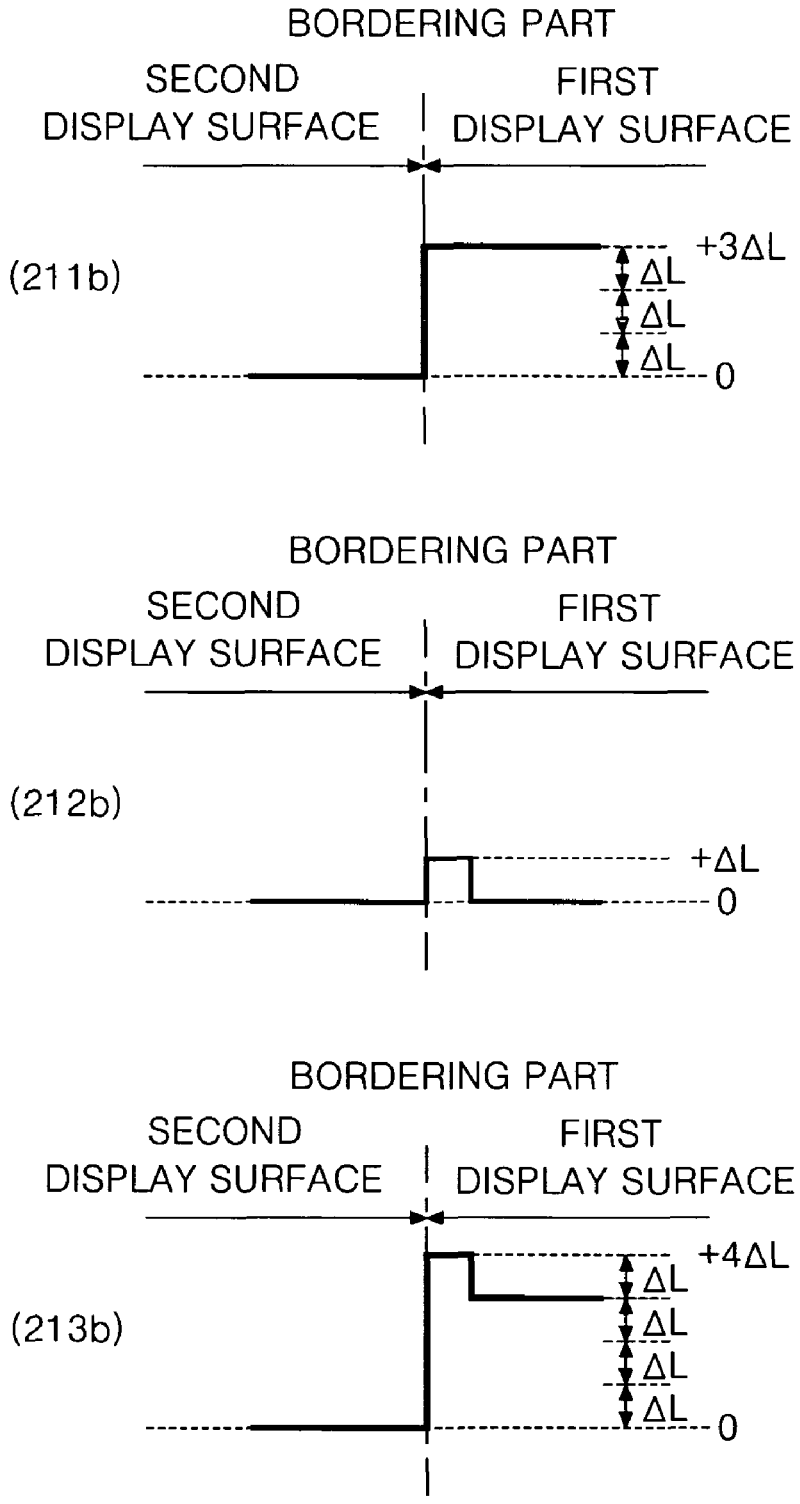

Referring to FIG. 9B, a first compensation data 211*b* of the second type is set to 0 in the second display surface and to the compensation value of +3ΔL in the first display surface in the same manner as the first compensation data 211*a* of the first type, and the second compensation data 212*b* of the second type is set to the compensation value of $+k\times\Delta L$, e.g., +ΔL for the pixel which is adjacent to the boundary of the first display surface. The second compensation data 212*b* of the second type can be set by the unit of every other pixel for the range from one pixel which is as close to the boundary as possible to the pixel which is away from the boundary at most by half of the distance between both ends of the first display surface while including the pixel. In addition, the summed compensation data 213*b* of the second type is calculated by the sum of the first compensation data 211*b* of the second type and the second compensation data 212*b* of the second type.

Figure 9C:
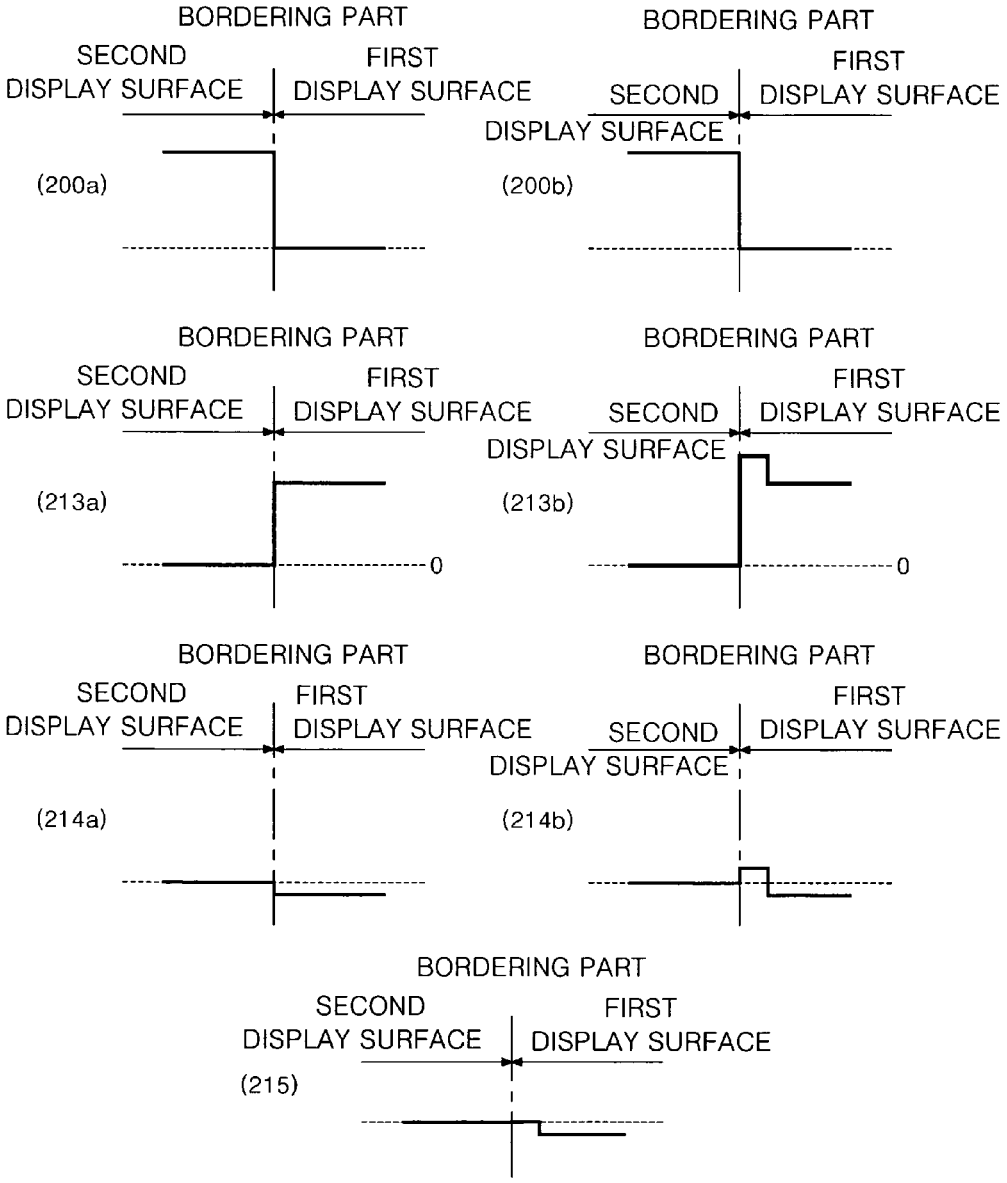

The brightness compensation result of the bordering part and the first display surface which can be predicted by the summed compensation data set up in this way is as shown in FIG. 9C. That is, when the brightness of the first and second horizontal lines which are adjacent in the first and second display surfaces is equal to 200*a* and 200*b*, if the brightness of the first horizontal line is compensated as in 214A using the summed compensation data of the first type as in 213*a* and the brightness of the second horizontal line is compensated as in 214*b* using the summed compensation data of the second type as in 213*b*, then the average brightness of the first and second horizontal lines where the bordering part noise is compensated and the first display surface is as shown in 215 (the bottom portion of FIG. 9C).

Figure 9D:
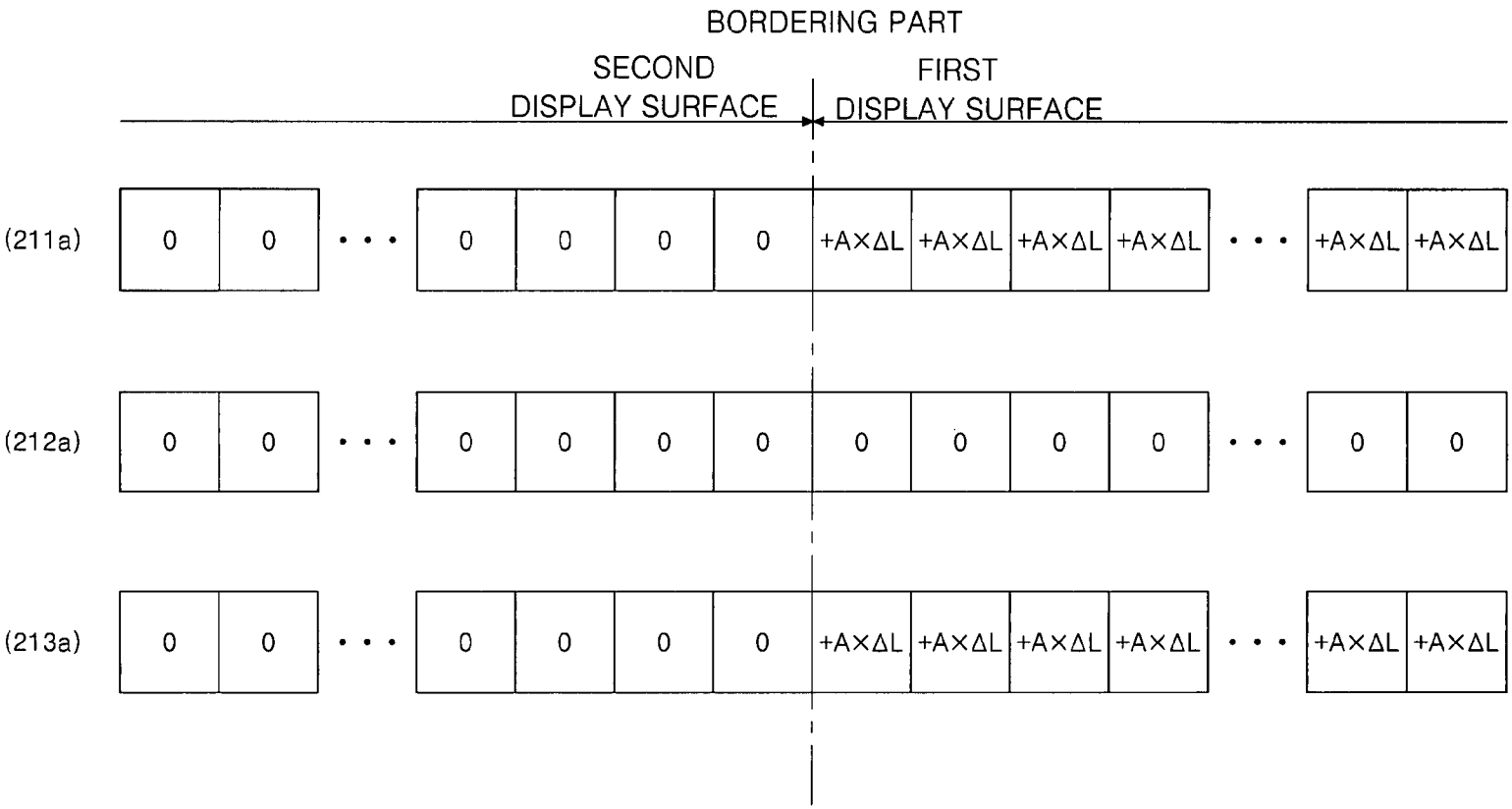
Figure 9E:
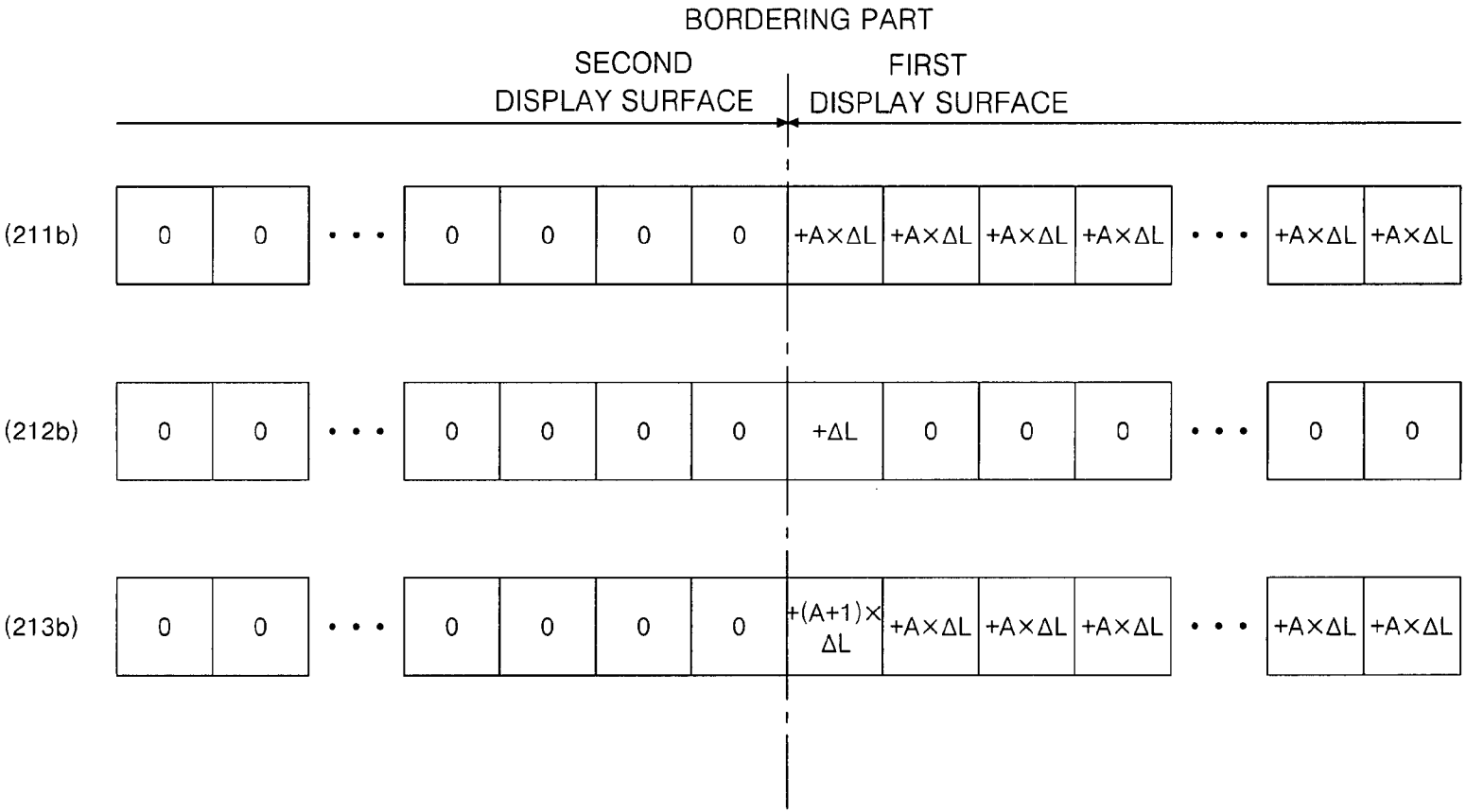
Figure 9F:
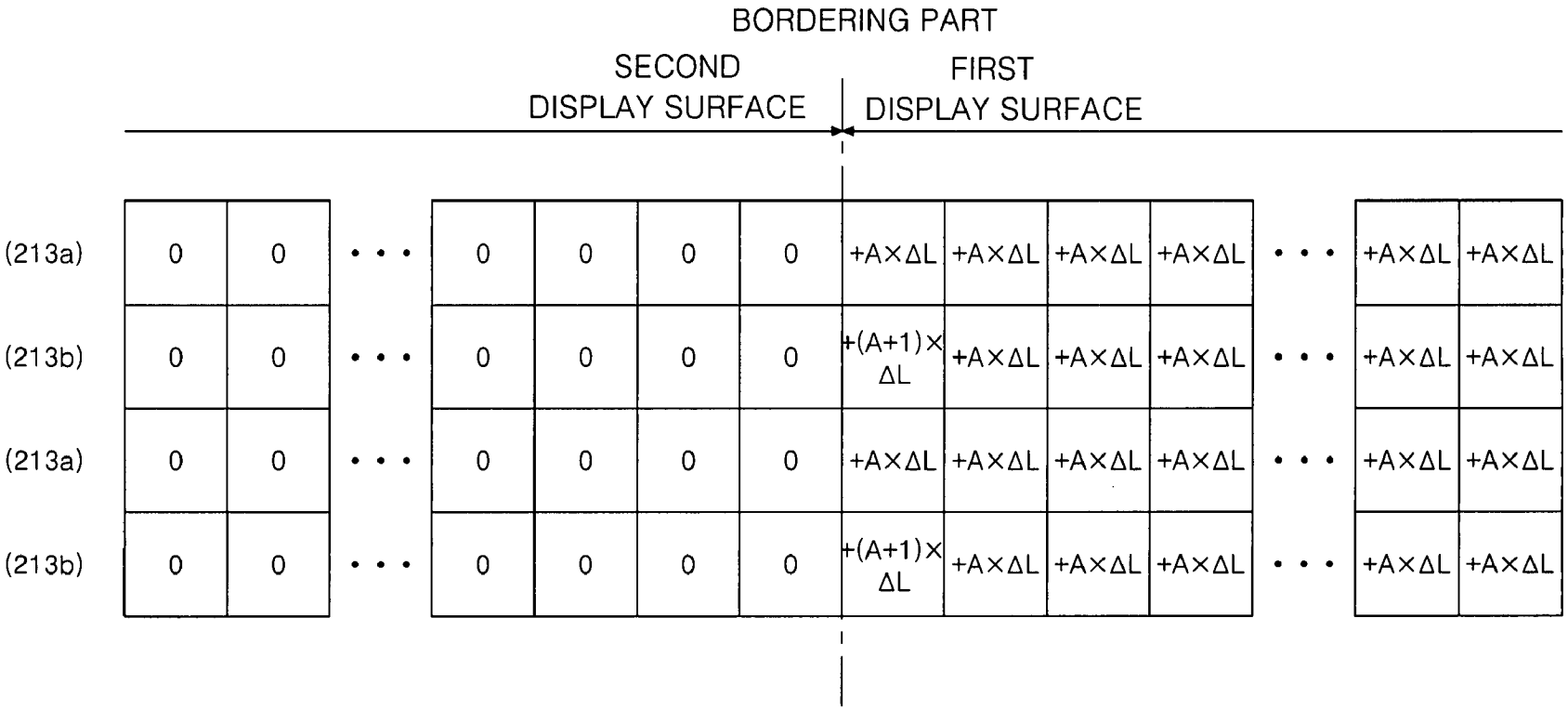

Next, FIGS. 9D to 9F represent examples of setting the compensation data in correspondence to each location of the pixels disposed in the first display surface and the bordering part thereof. Spaces which are divided in a square and arranged in the drawings of FIG. 9D and below mean the pixels on the display panel, and 'A', '+' and 'ΔL' written therein are as defined above.

Referring to FIG. 9D, the first compensation data 211*a* of the first type is set to the compensation value of 0 in the second display surface and to the compensation value of $+A\times\Delta L$ in the first display surface. Further, if the brightness difference of the first and second display surfaces is as in FIG. 8, 'A' has the same value as 3. In addition, the second compensation data 212*a* of the first type is set to the compensation value of 0 in the first and second display surfaces. The summed compensation data 213*a* of the first type is calculated by the sum of the first compensation data 211*a* of the first type and the second compensation data 212*a* of the first type.

Referring to FIG. 9E, the first compensation data 211*b* of the second type is set to the compensation value of 0 in the second display surface and to the compensation value of $+A\times\Delta L$ in the first display surface in the same manner as the first compensation data 211*a* of the first type. Further, the second compensation data 212*b* of the second type is set to the compensation value of 0 in the second display surface and to +ΔL for the pixel adjacent to the boundary in the first display surface. The summed compensation data 213*b* of the second type is calculated by the sum of the first compensation data 211*b* of the second type and the second compensation data 212*b* of the second type. The summed compensation data 213*a* and 213*b* of the first and second types which are calculated as above are alternately applied for the horizontal lines which are adjacent on the display panel, as shown in FIG. 9F.

A method of setting the summed compensation data according to a second embodiment of the present invention sets the first compensation data of the first and second types to 0 in the second display surface and to the compensation value of ±A×ΔL in the first display surface when the first display surface and the second display surface have a brightness difference (d) between A×ΔL and (A+1)×ΔL. Further, the second compensation data of the first type is set to the compensation value of ±k×ΔL for the pixel adjacent to the boundary in the second display surface and for every other pixel on the same line of the first and second display surfaces while including this pixel. The second compensation data of the second type is set to the compensation value of ±k×ΔL for the pixel adjacent to the boundary in the first display surface and for every other pixel on the same line of the first and second display surfaces while including this pixel. Then, the second compensation data of the first and second types can be set to the compensation value for the range from one pixel which is as close to the boundary as possible in the first and second display surfaces to the pixel which is away from the boundary at most by half of the distance between both ends of the first display surface.

For example, as shown in FIG. 8, when the brightness of the first display surface is lower by 'd' than the brightness of the second display surface and 'd' is a value between 3ΔL and 4ΔL, a method of setting the summed compensation data according to the second embodiment of the present invention is as follows.

Figure 10A:
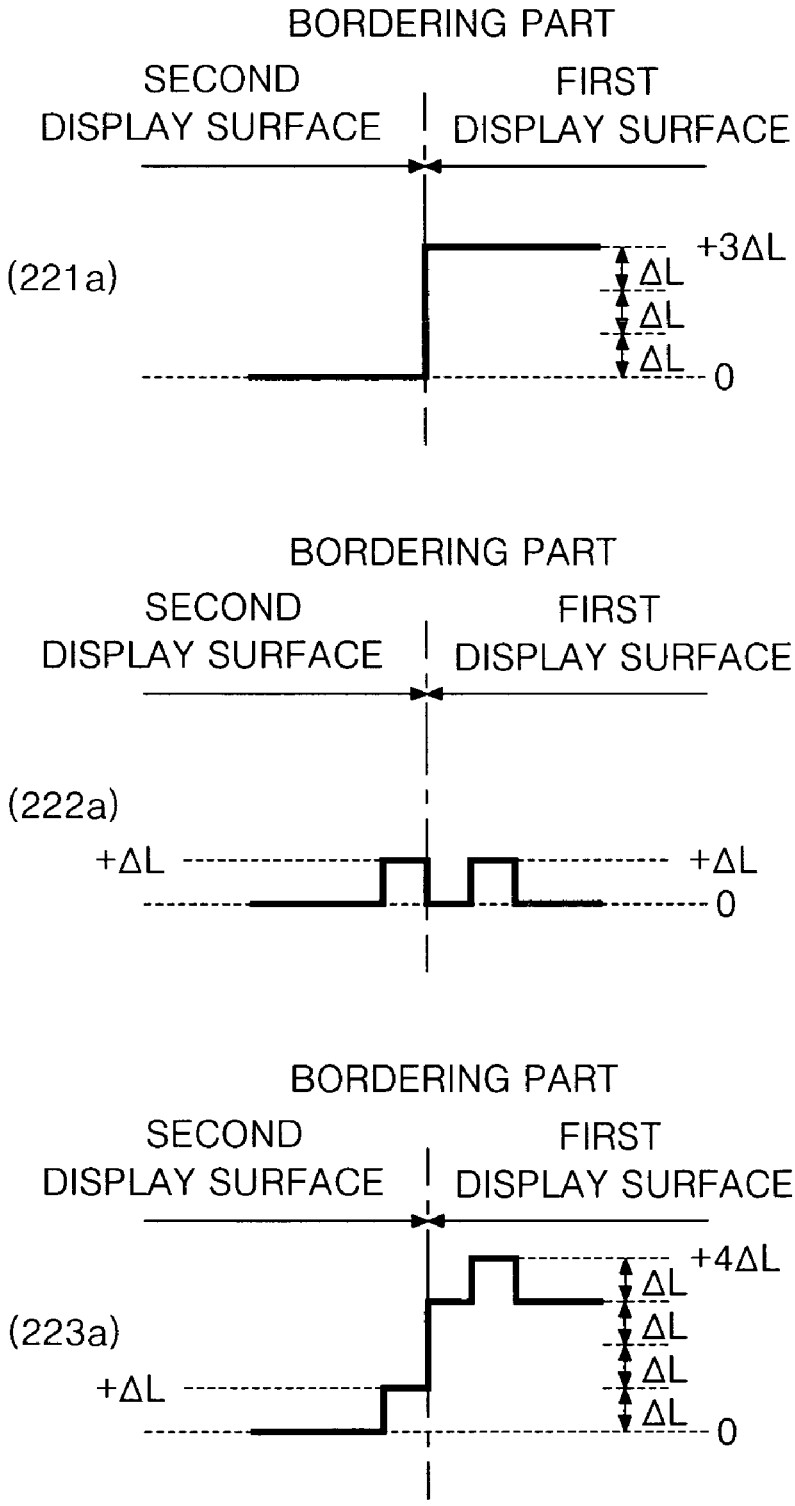
FIGS. 10A to 10F are diagrams representing another example of the compensation value setting-up in order to compensate the brightness difference of FIG. 8.

Referring to FIG. 10A, a first compensation data 221*a* of the first type is set to 0 in the second display surface and to the compensation value of +3ΔL in the first display surface, and a second compensation data 222*a* of the first type is set to the compensation value of +k×ΔL, e.g., +ΔL, for the pixel adjacent to the boundary in the second display surface and for the pixel which is located away from that pixel with the boundary therebetween with a distance of every other pixel. The second compensation data 222*a* of the first type can be set for every other pixel for the range from one pixel which is as close to the boundary as possible to the pixel which is away from the boundary at most by half of the distance between both ends of the first display surface while including the above pixels. In addition, the summed compensation data 223*a* of the first type is calculated by the sum of the first compensation data 221A of the first type and the second compensation data 222*a* of the first type.

Figure 10B:
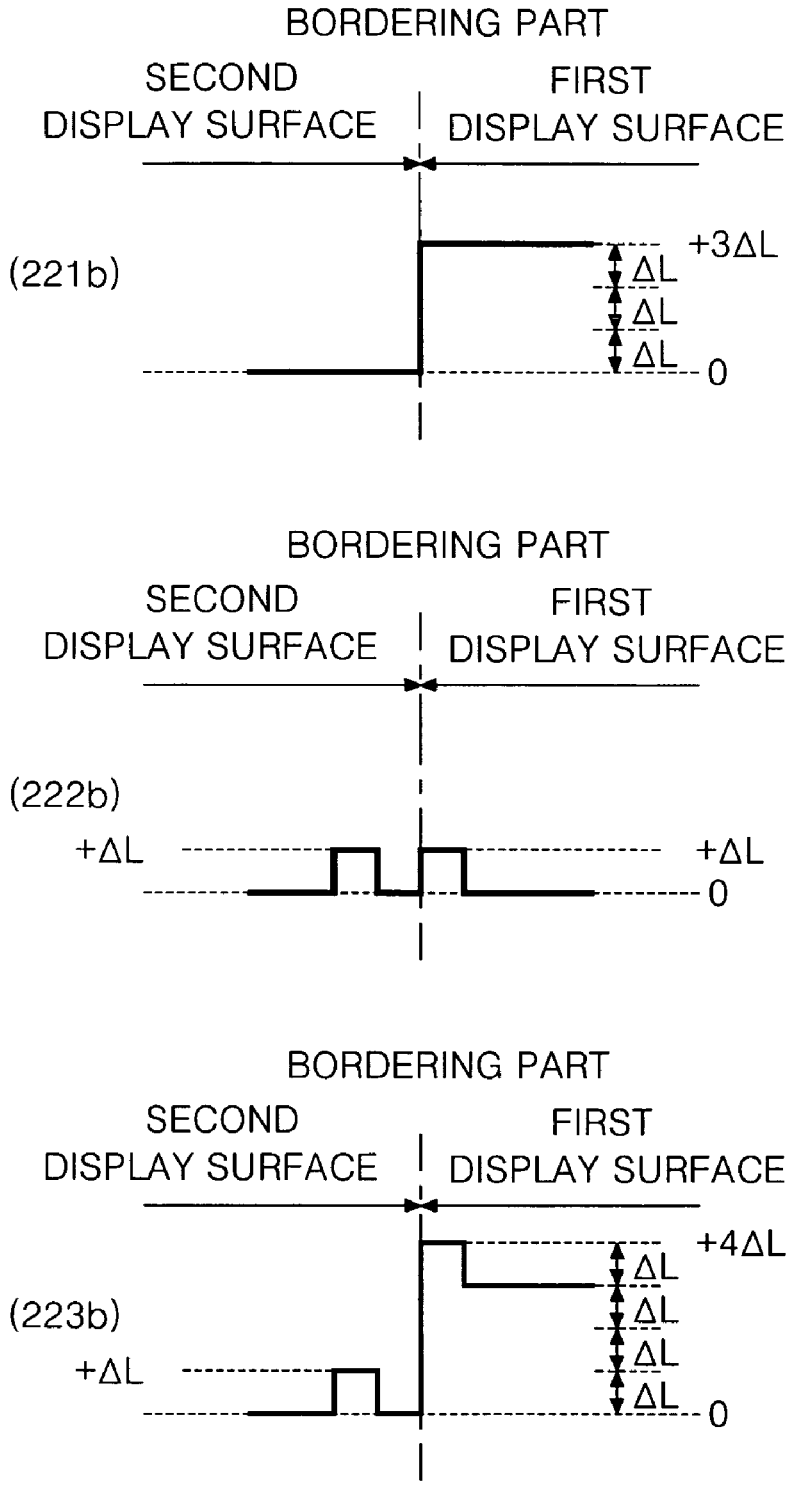

Referring to FIG. 10B, a first compensation data 221*b* of the second type is set to 0 in the second display surface and to the compensation value of +3ΔL in the first display surface in the same manner as the first compensation data 221*a* of the first type, and the second compensation data 222*b* of the second type is set to the compensation value of +k×ΔL, e.g., +ΔL, for the pixel adjacent to the boundary in the first display surface and for the pixel which is located away from that pixel with the boundary therebetween with a distance of every other pixel. The second compensation data 222*b* of the second type can be set for every other pixel for the range from one pixel which is as close to the boundary as possible to the pixel which is away from the boundary at most by half of the distance between both ends of the first display surface while including the above pixels. Further, the summed compensation data 223*b* of the second type is calculated by the sum of the first compensation data 221*b* of the second type and the second compensation data 222B of the second type.

Figure 10C:
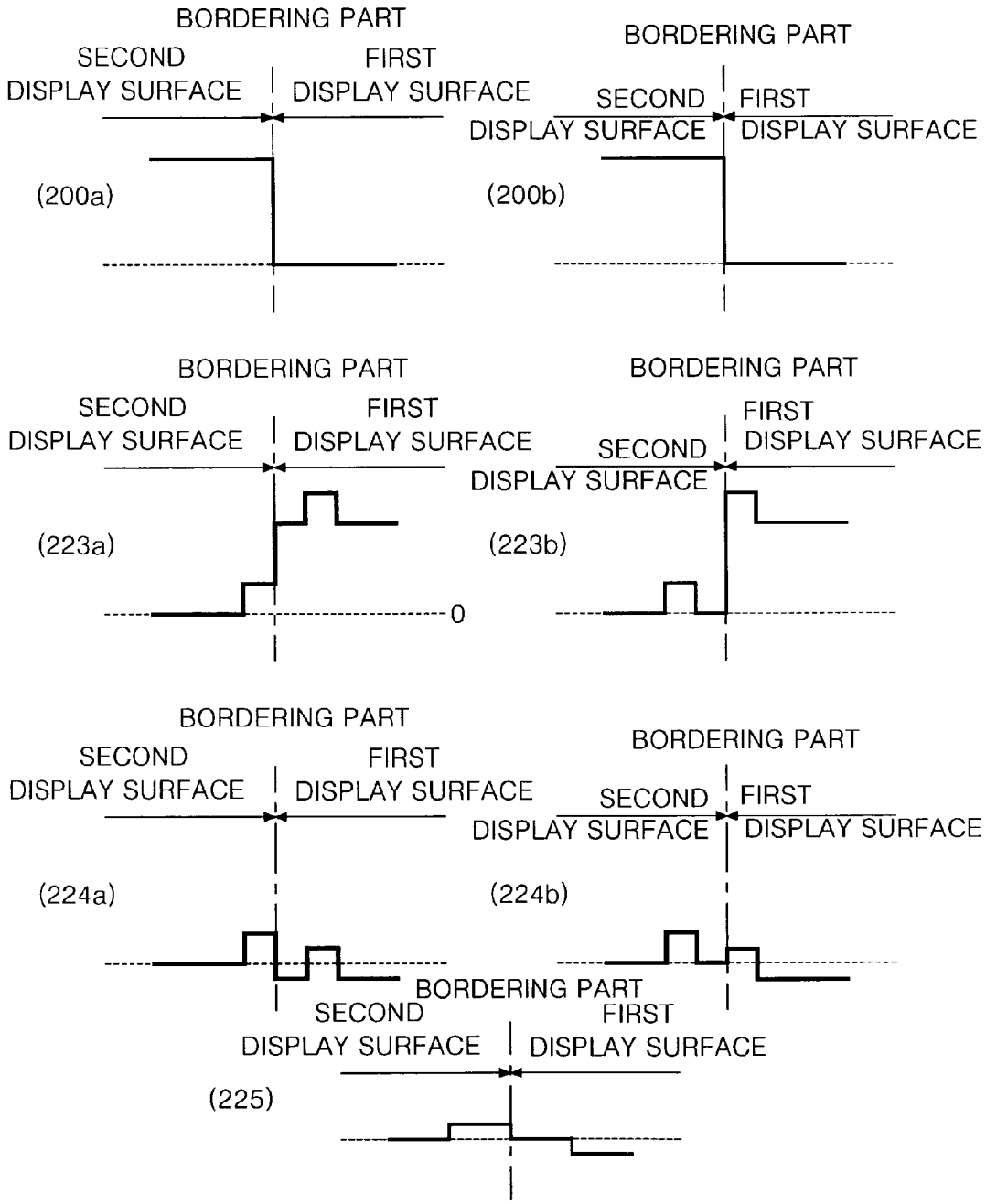

The brightness compensation result of the bordering part and the first display surface which can be predicted by the summed compensation data set up in this way is as shown in FIG. 10C. That is, when the brightness of the first and second horizontal lines which are adjacent in the first and second display surfaces is equal to 200*a* and 200*b*, if the brightness of the first horizontal line is compensated as in 224*a* using the summed compensation data of the first type as in 223*a* and the brightness of the second horizontal line is compensated as in 224B by use of the summed compensation data of the second type as in 223*b*, then the average brightness of the first and second horizontal lines where the bordering part noise is compensated and the first display surface is as shown in 225 (the bottom portion of FIG. 10C).

Figure 10D:
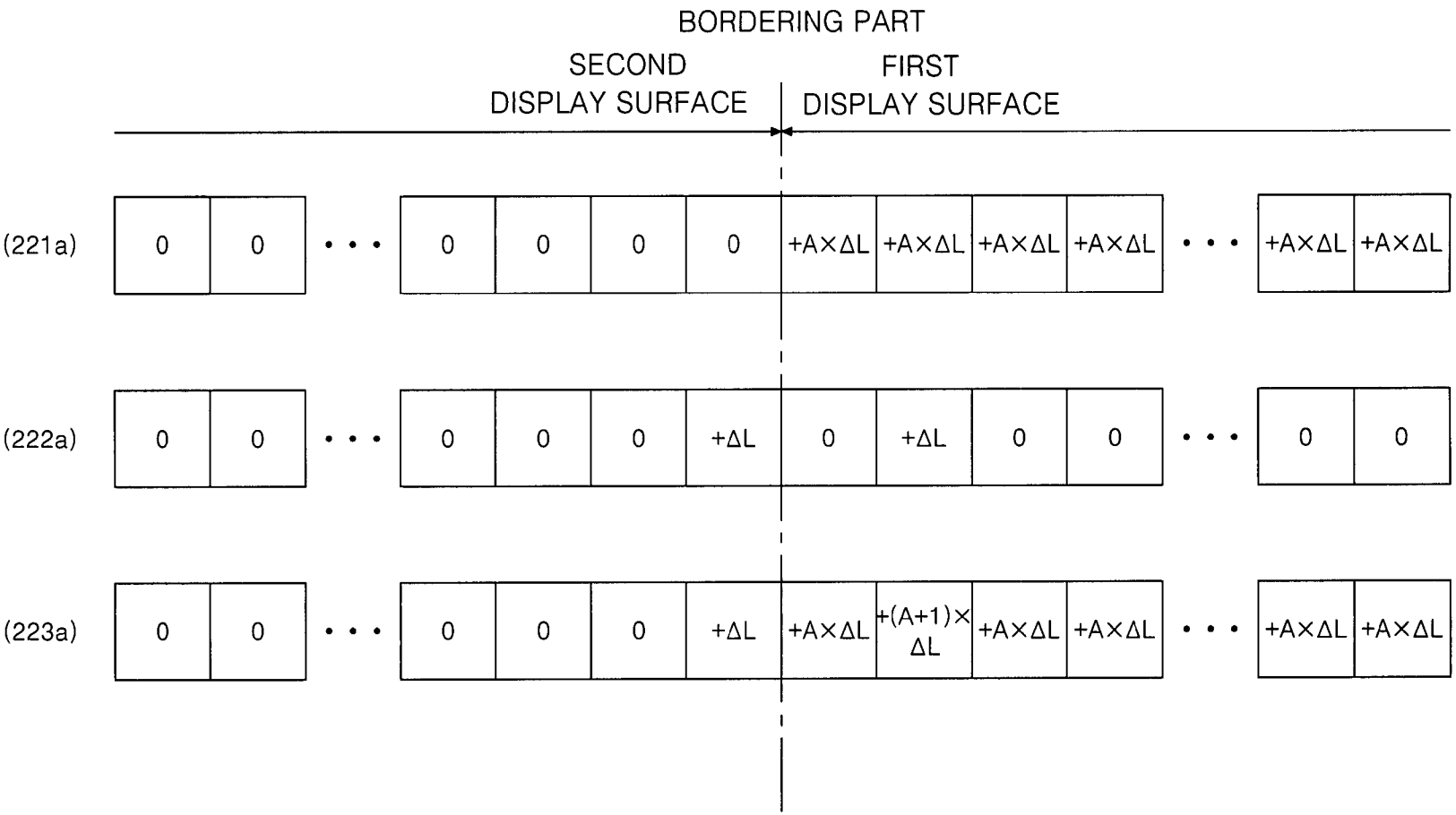
Figure 10E:
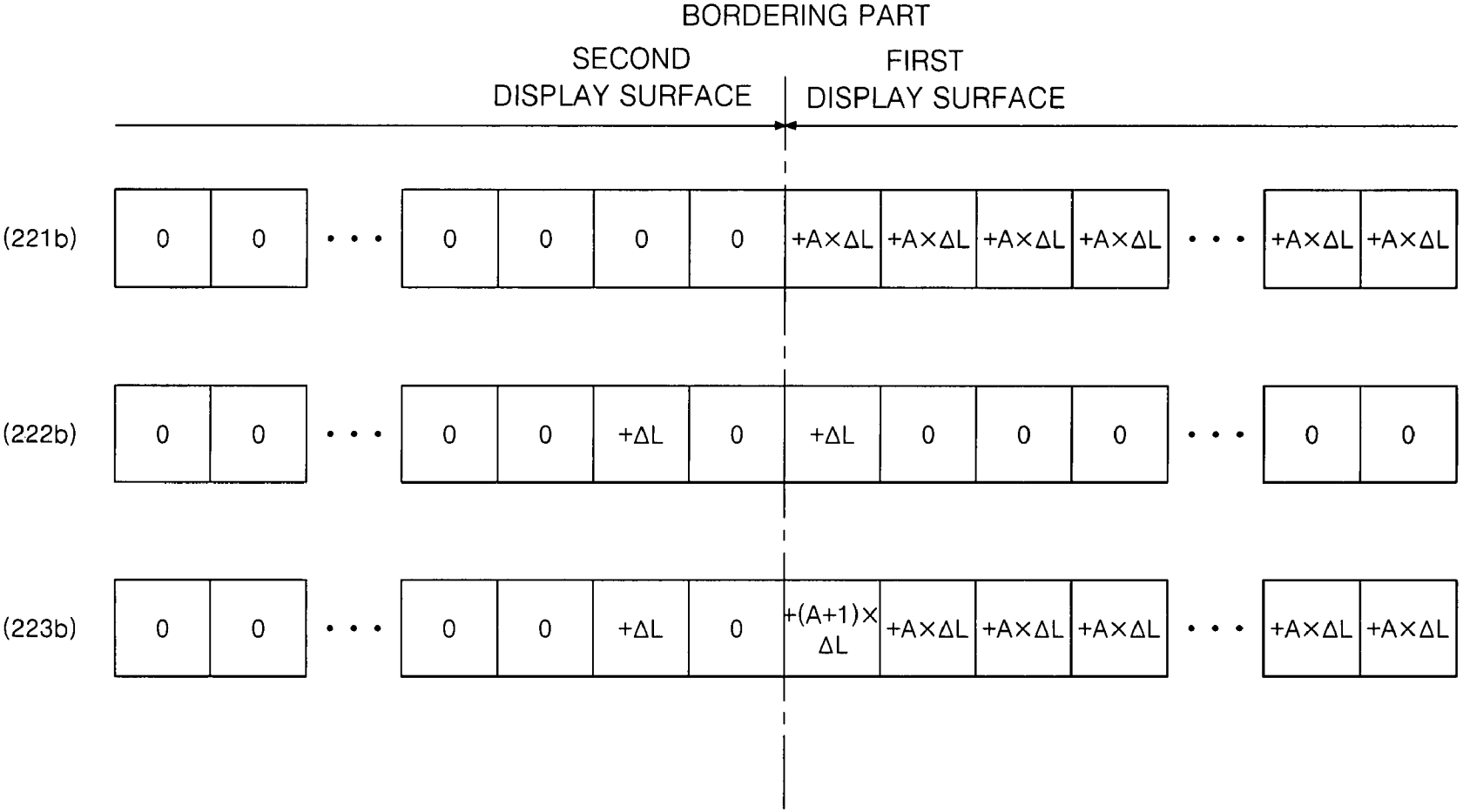
Figure 10F:
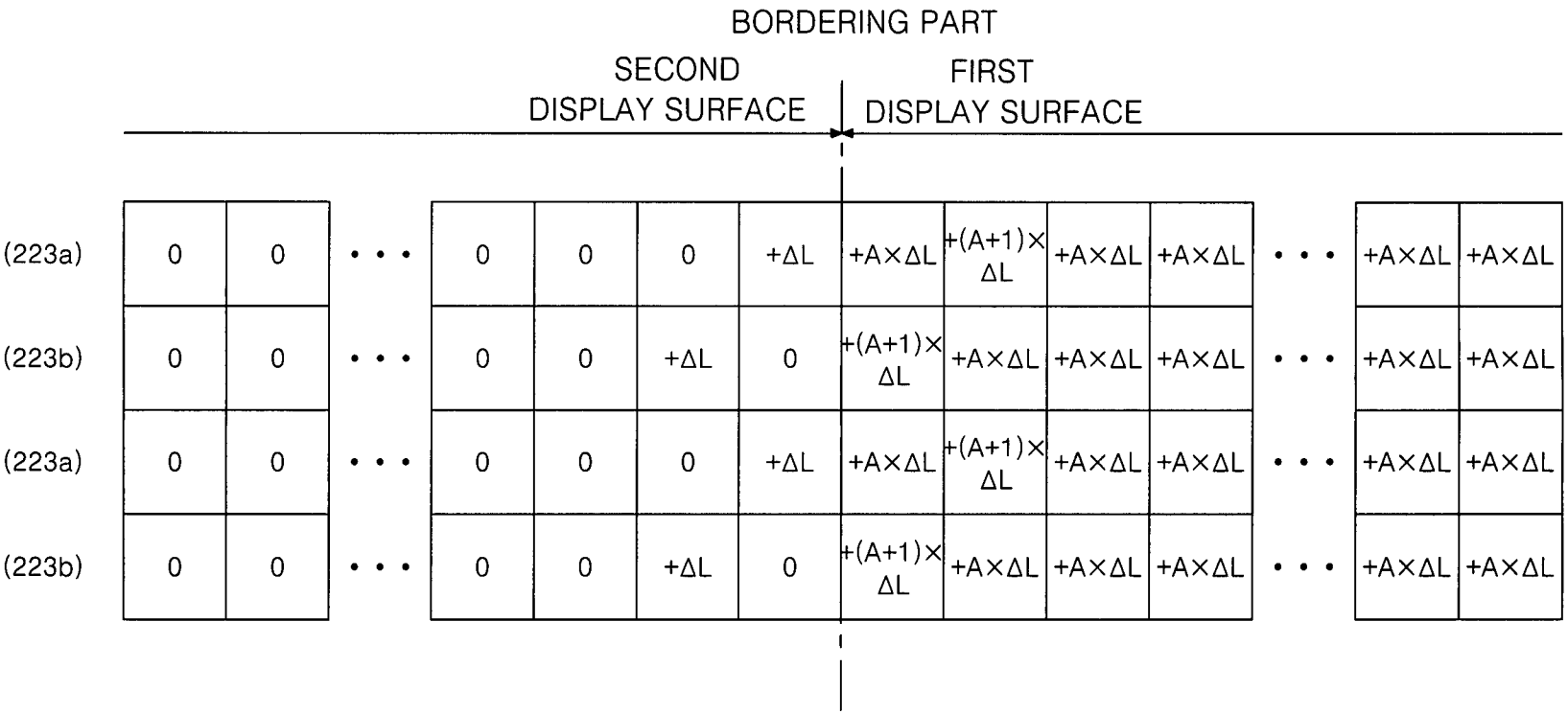

Next, FIGS. 10D to 10F represent examples of setting the compensation data in correspondence to each location of the pixels which are disposed in the first display surface and the bordering part thereof.

Referring to FIG. 10D, the first compensation data 221*a* of the first type is set to the compensation value of 0 in the second display surface and to the compensation value of +A×ΔL in the first display surface. Further, if the brightness difference of the first display surface and the second display surface is as in FIG. 8, 'A' has the same value as 3. In addition, the second compensation data 222*a* of the first type is set to the compensation value of +ΔL for the pixel adjacent to the boundary in the second display surface and for the pixel which is located away from that pixel with the boundary therebetween with a distance of every other pixel. The second compensation data 222*a* of the first type can be set for every other pixel for the range from one pixel which is as close to the boundary as possible to the pixel which is away from the boundary at most by half of the distance between both ends of the first display surface while including the above pixels. The summed compensation data 223*a* of the first type is calculated by the sum of the first compensation data 221*a* of the first type and the second compensation data 222*a* of the first type.

Referring to FIG. 10E, the first compensation data 221*b* of the second type is set to the compensation value of 0 in the second display surface and to the compensation value of +A×ΔL in the first display surface in the same manner as the first compensation data 221*a* of the first type. Also, the second compensation data 222*b* of the second type is set to the compensation value of +ΔL for the pixel adjacent to the boundary in the first display surface and for the pixel which is located away from that pixel with the boundary therebetween with a distance of every other pixel. The second compensation data 222*b* of the second type can be set for every other pixel for the range from one pixel which is as close to the boundary as possible to the pixel which is away from the boundary at most by half of the distance between both ends of the first display surface while including the above pixels. The summed compensation data 223*b* of the second type is calculated by the sum of the first compensation data 221*b* of the second type and the second compensation data 222*b* of the second type.

The summed compensation data 223*a* and 223*b* of the first and second types calculated as above are alternately applied for the horizontal lines which are adjacent on the display panel.

In addition, a method of setting the summed compensation data according to a third embodiment of the present invention sets the first compensation data of the first type to 0 in the second display surface and to the compensation value of +A×ΔL in the first display surface and sets the first compensation data of the second type to 0 in the second display surface and to the compensation value of +(A+1)×ΔL in the first display surface when the first display surface and the second display surface have a brightness difference (d) between A×ΔL and (A+1)×ΔL. The second compensation data of the first type is set to the compensation value of −k×ΔL for the pixel adjacent to the boundary in the first display surface and the compensation value is increased by ΔL for each pixel that is away from that pixel with a distance of every other pixel.

Also, the second compensation data of the first type is set to the compensation value of +k×ΔL for the pixel which is located away from that pixel adjacent to the boundary of the first display surface with a boundary therebetween with a distance of every other pixel in the second display surface and the compensation value is decreased by ΔL for each pixel that is away from that pixel with a distance of every other pixel. The second compensation data of the second type is set to the compensation value of +k×ΔL for the pixel adjacent to the boundary in the second display surface and the compensation value is decreased by ΔL for each pixel that is away from that pixel with a distance of every other pixel.

In addition, the second compensation data of the second type is set to the compensation value of −k×ΔL for the pixel which is located away from that pixel adjacent to the boundary of the second display surface with a boundary therebetween with a distance of every other pixel in the first display surface and the compensation value is increased by ΔL for each pixel that is away from that pixel with a distance of every other pixel. Then, the second compensation data of the first and second types can be set to the compensation value for the range from one pixel which is as close to the boundary as possible in the first and second display surfaces to the pixel which is away from the boundary at most by half of the distance between both ends of the first display surface. Further, 'A' is a positive integer, 'k' is a positive integer which is less than or equal to 'A', '+' is a brightness increase, '−' is a brightness decrease, and 'd' and 'ΔL' are as defined above. In addition, 'k' can be 1/2A. Further, the second compensation data of the first and second types can be set to the compensation value which is decreased from +k×ΔL in the first display surface and is increased from −k×ΔL in the second display surface.

For example, as shown in FIG. 8, when the brightness of the first display surface is lower by 'd' than the brightness of the second display surface and 'd' is a value between 3ΔL and 4ΔL, a method of setting the summed compensation data according to the third embodiment of the present invention is as follows.

Figure 11A:
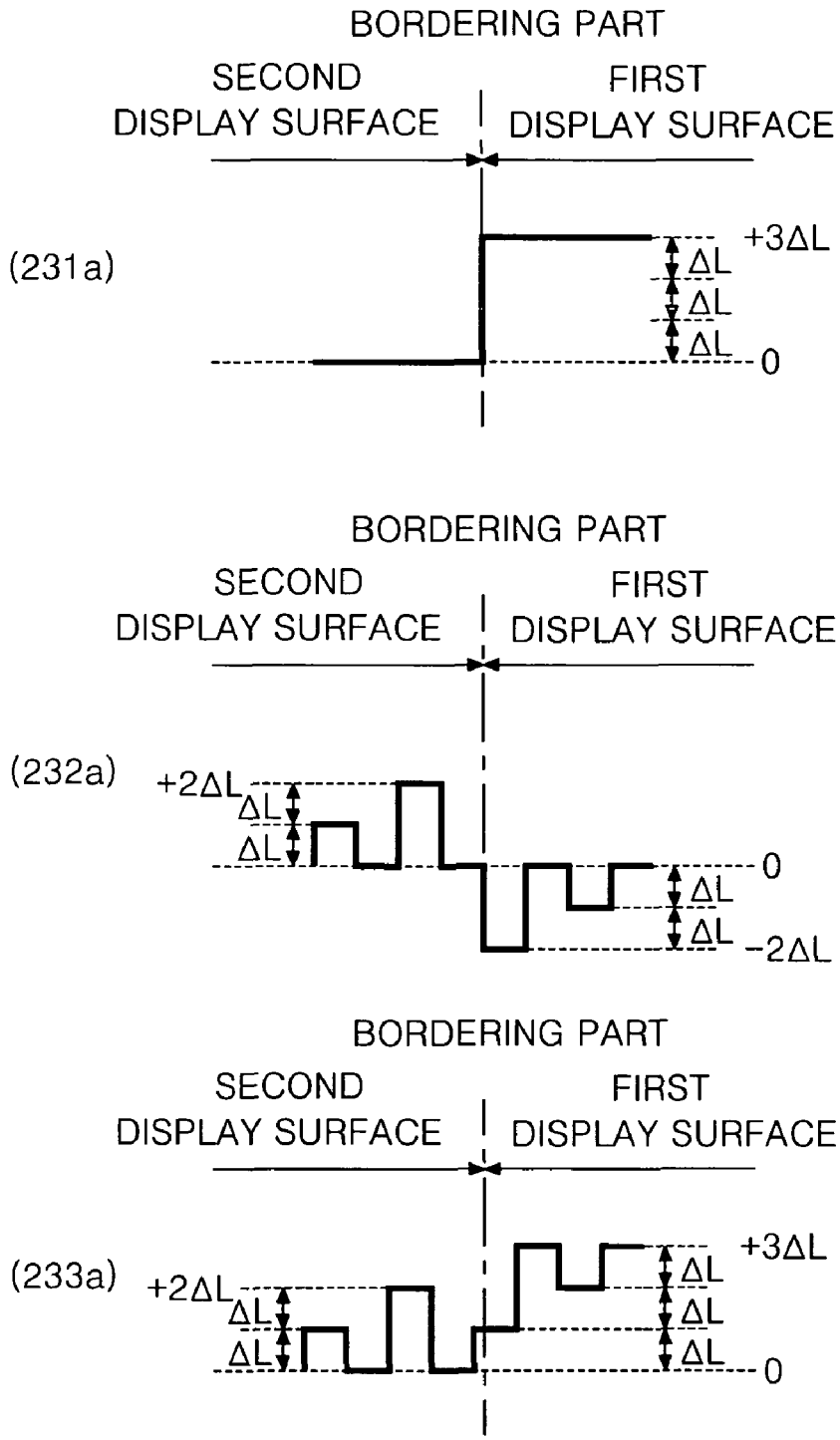
FIGS. 11A to 11F are diagrams representing still another example of the compensation value setting-up to compensate the brightness difference of FIG. 8.

Referring to FIG. 11A, a first compensation data 231*a* of the first type is set to 0 in the second display surface and to the compensation value of +3ΔL in the first display surface. And, a second compensation data 232*a* of the first type is set to the compensation value of −2ΔL for the pixel adjacent to the boundary in the first display surface and the compensation value is increased by ΔL for each pixel that is away from that pixel with a distance of every other pixel. Further, the second compensation data 232*a* of the first type is set to the compensation value of +2ΔL for the pixel which is located away from that pixel adjacent to the boundary of the first display surface with a boundary therebetween with a distance of every other pixel in the second display surface and the compensation value is decreased by ΔL for each pixel that is away from that pixel with a distance of every other pixel.

The second compensation data 232*a* of the first type can be set for every other pixel for the range from one pixel which is as close to the boundary as possible to the pixel which is away from the boundary at most by half of the distance between both ends of the first display surface while including the above pixels. Also, the summed compensation data 233*a* of the first type is calculated by the sum of the first compensation data 231*a* of the first type and the second compensation data 232*a* of the first type.

Figure 11B:
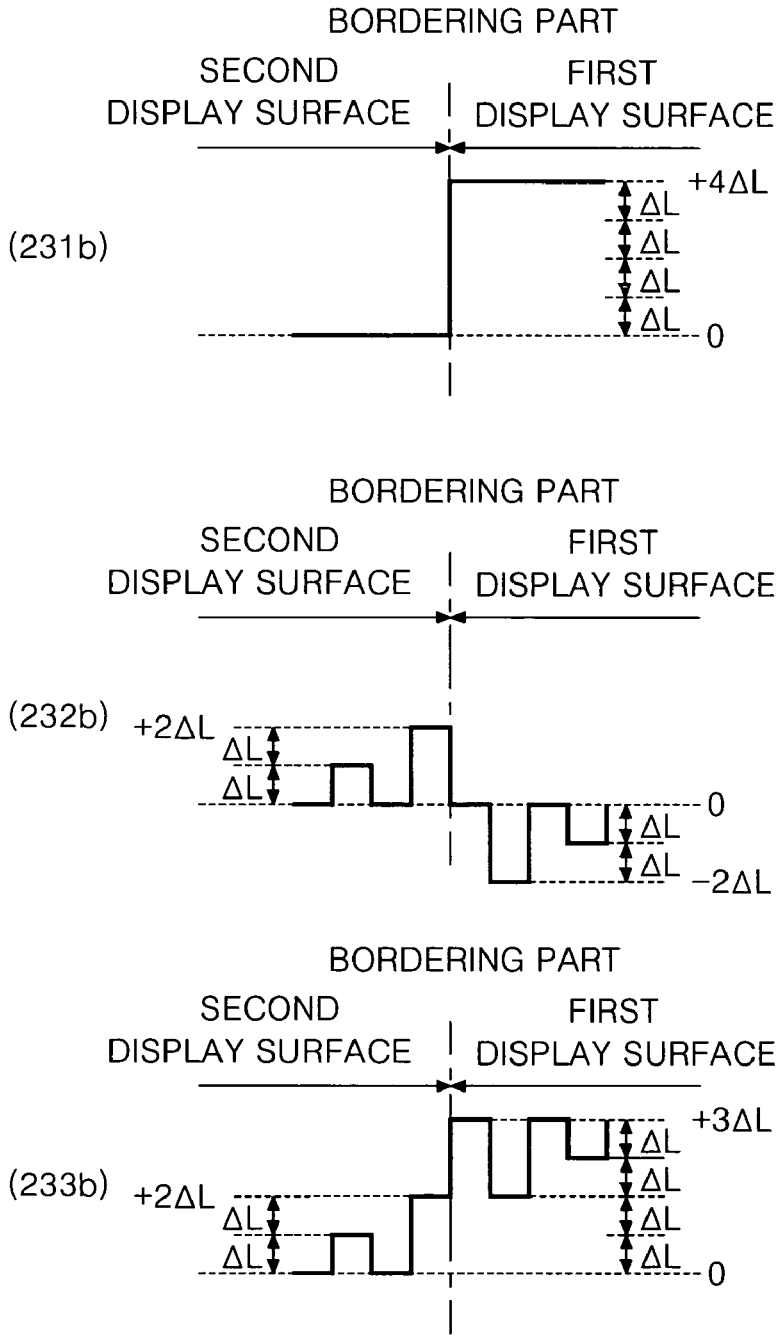

Referring to FIG. 11B, a first compensation data 231*b* of the second type is set to 0 in the second display surface and to the compensation value of +4ΔL in the first display surface differently from the first compensation data 231*a* of the first type. In addition, a second compensation data 232*b* of the second type is set to the compensation value of +2ΔL for the pixel adjacent to the boundary in the second display surface and the compensation value is decreased by ΔL for each pixel that is away from that pixel with a distance of every other pixel.

In addition, the second compensation data 232*b* of the second type is set to the compensation value of −2ΔL for the pixel which is located away from that pixel adjacent to the boundary of the second display surface with a boundary therebetween with a distance of every other pixel in the first display surface and the compensation value is increased by ΔL for each pixel that is away from that pixel with a distance of every other pixel. The second compensation data 232B of the second type can be set for every other pixel for the range from one pixel which is as close to the boundary as possible to the pixel which is away from the boundary at most by half of the distance between both ends of the first display surface while including the above pixels. Further, the summed compensation data 233*b* of the second type is calculated by the sum of the first compensation data 231B of the second type and the second compensation data 232*b* of the second type.

Figure 11C:
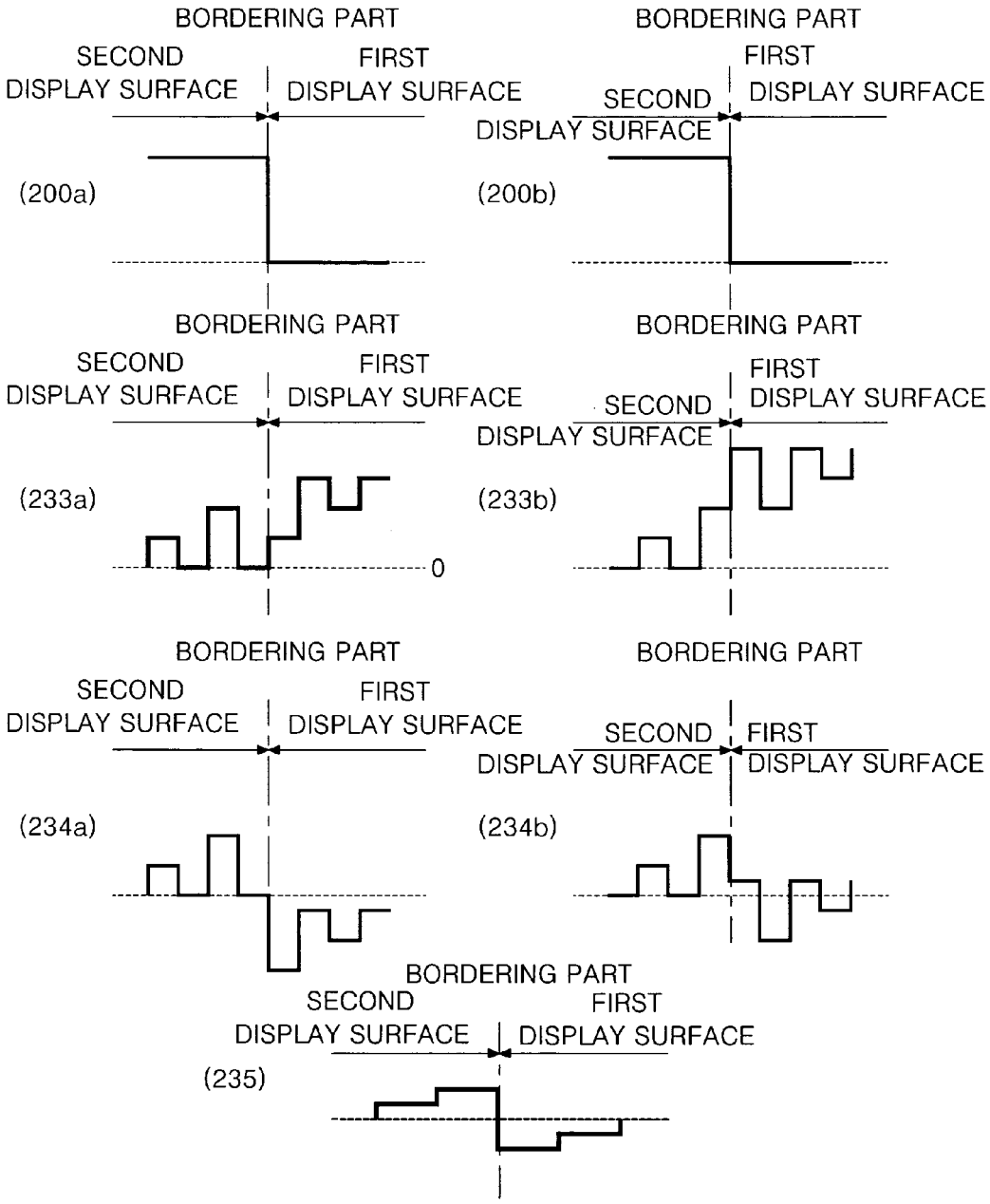

The brightness compensation result of the bordering part and the first display surface which can be predicted by the summed compensation data set up in this way is as shown in FIG. 11C. That is, when the brightness of the first and second horizontal lines which are adjacent in the first and second display surfaces is equal to 200A and 200B, and if the brightness of the first horizontal line is compensated as in 234*a* using the summed compensation data of the first type as in 233*a* and the brightness of the second horizontal line is compensated as in 234*b* using the summed compensation data of the second type as in 233*b*, then the average brightness of the first and second horizontal lines where the bordering part noise is compensated and the first display surface is as shown in 235 (the bottom portion of FIG. 11C).

Figure 11D:
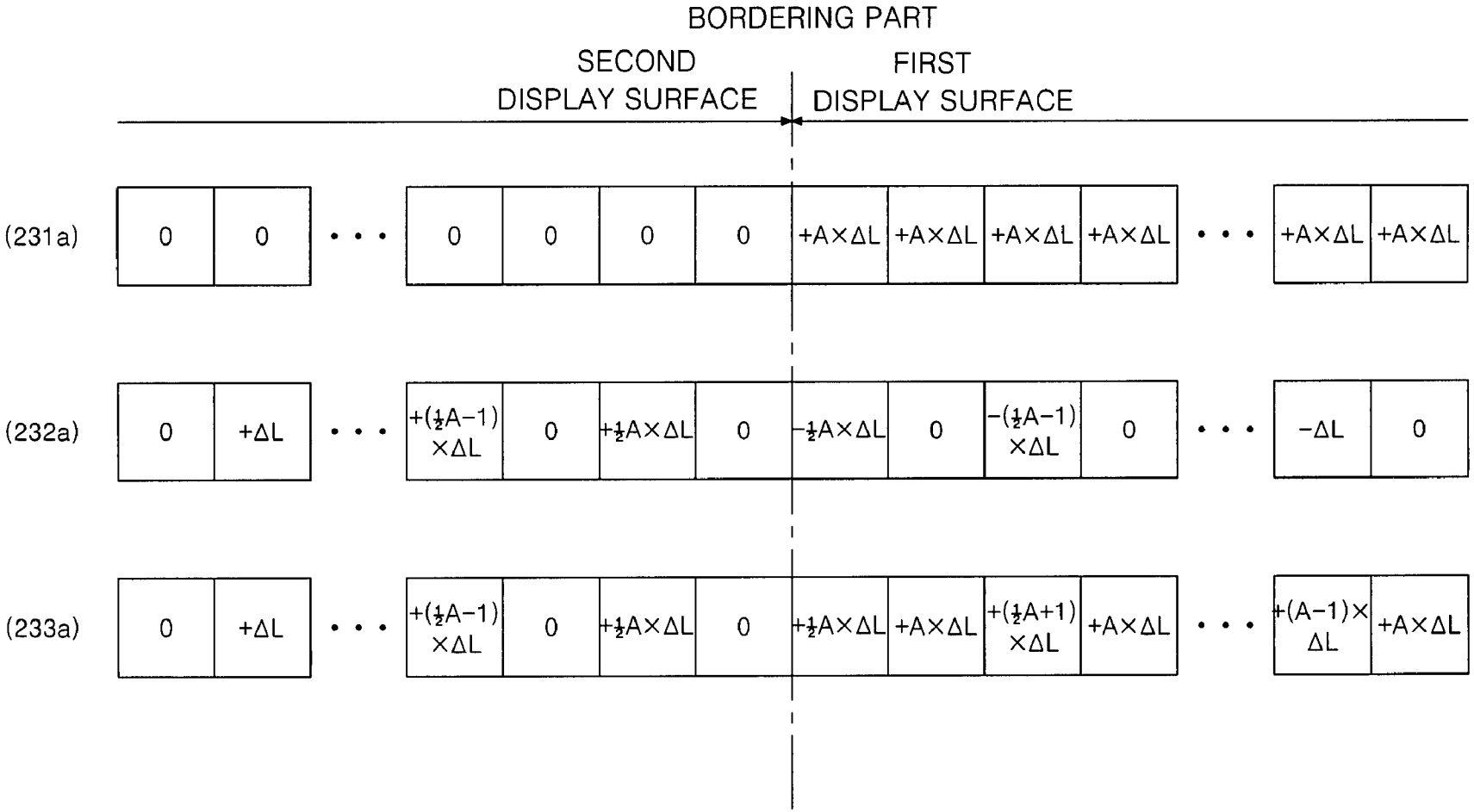
Figure 11E:
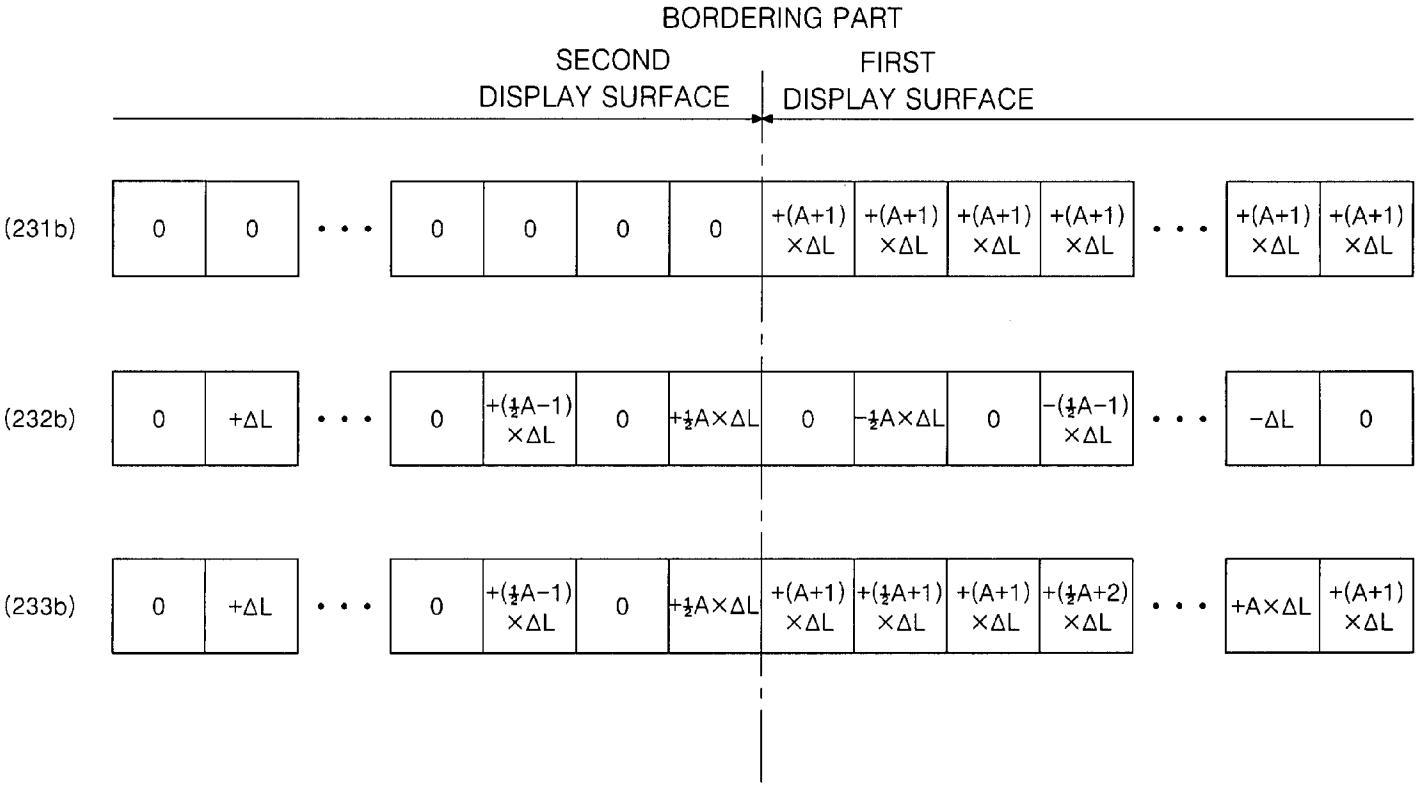
Figure 11F:
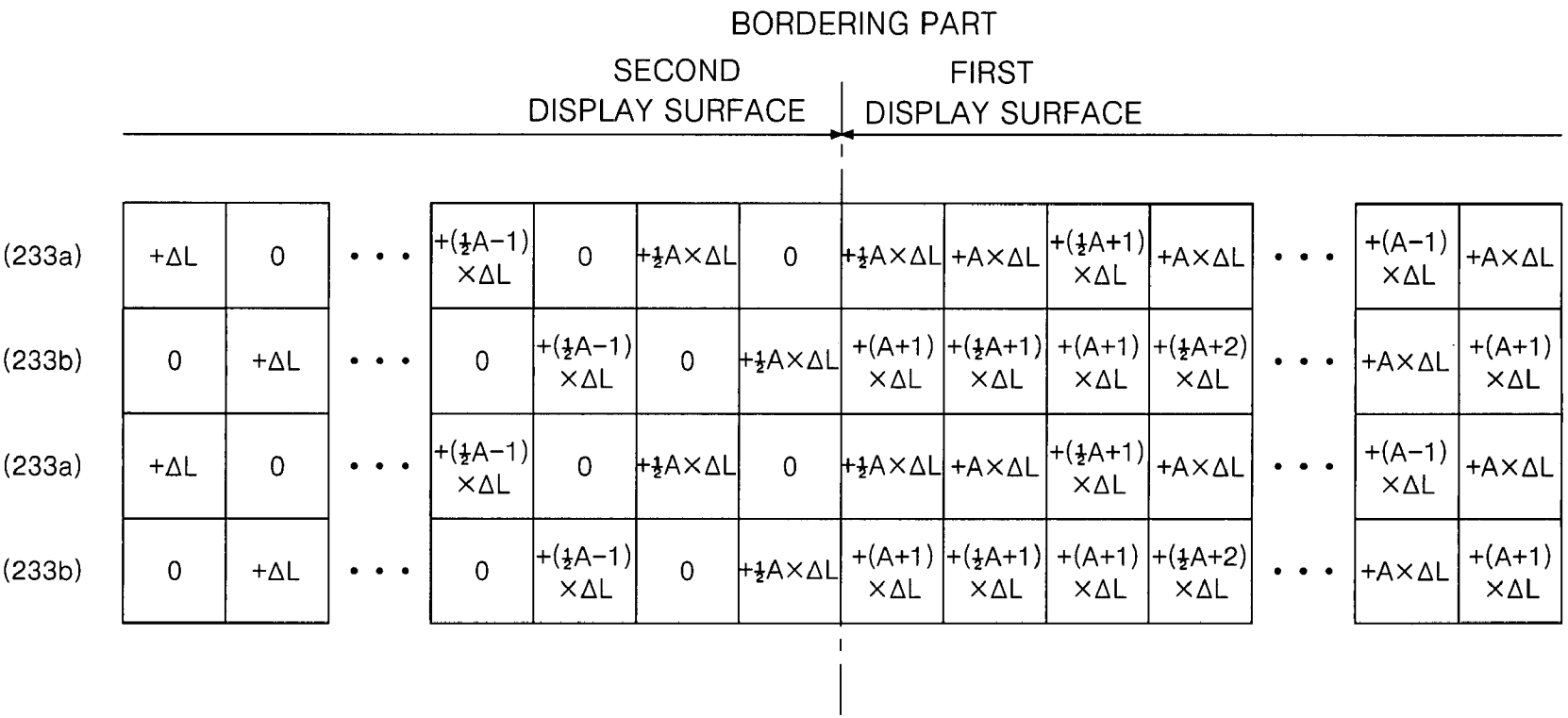

Next, FIGS. 11D to 11F represent examples of setting the compensation data in correspondence to each location of the pixels which are disposed in the first display surface and the bordering part thereof.

Referring to FIG. 11D, the first compensation data 231*a* of the first type is set to the compensation value of 0 in the second display surface and to the compensation value of +A×ΔL in the first display surface. Further, if the brightness difference of the first and second display surfaces is as in FIG. 8, 'A' has the same value as 3. In addition, the second compensation data 232*a* of the first type is set to the compensation value of −1/2A×ΔL for the pixel adjacent to the boundary in the first display surface and the compensation value is increased by ΔL for each pixel that is away from that pixel with a distance of every other pixel.

In addition, the second compensation data 232*a* of the first type is set to the compensation value of +1/2A×ΔL for the pixel which is located away from that pixel adjacent to the boundary of the first display surface with a boundary therebetween with a distance of every other pixel in the second display surface and the compensation value is decreased by ΔL for each pixel that is away from that pixel with a distance of every other pixel. The second compensation data 232A of the first type can be set for every other pixel for the range from one pixel which is as close to the boundary as possible to the pixel which is away from the boundary at most by half of the distance between both ends of the first display surface while including the above pixels. Also, the summed compensation data 233*a* of the first type is calculated by the sum of the first compensation data 231A of the first type and the second compensation data 232*a* of the first type.

Referring to FIG. 11E, the first compensation data 231*b* of the second type is set to the compensation value of 0 in the second display surface and to the compensation value of +A×ΔL in the first display surface in the same manner as the first compensation data 231*a* of the first type. Further, the second compensation data 232*b* of the second type is set to the compensation value of +1/2A×ΔL for the pixel adjacent to the boundary in the second display surface and the compensation value is decreased by ΔL for each pixel that is away from that pixel with a distance of every other pixel. Also, the second compensation data 232*b* of the second type is set to the compensation value of −1/2A×ΔL for the pixel which is located away from that pixel adjacent to the boundary of the second display surface with a boundary therebetween with a distance of every other pixel in the first display surface and the compensation value is increased by ΔL for each pixel that is away from that pixel with a distance of every other pixel.

The second compensation data 232*b* of the second type can be set for every other pixel for the range from one pixel which is as close to the boundary as possible to the pixel which is away from the boundary at most by half of the distance between both ends of the first display surface while including the above pixels. Further, the summed compensation data 233B of the second type is calculated by the sum of the first compensation data 231B of the second type and the second compensation data 232B of the second type.

The summed compensation data 233*a* and 233*b* of the first and second types calculated as above are alternately applied for the horizontal lines which are adjacent on the display panel as shown in FIG 11F.

FIGS. 12A to 12E represent examples of applying an arbitrary numerical value to the setting method of the summed compensation data according to a third embodiment of the present invention.

Figure 12A:
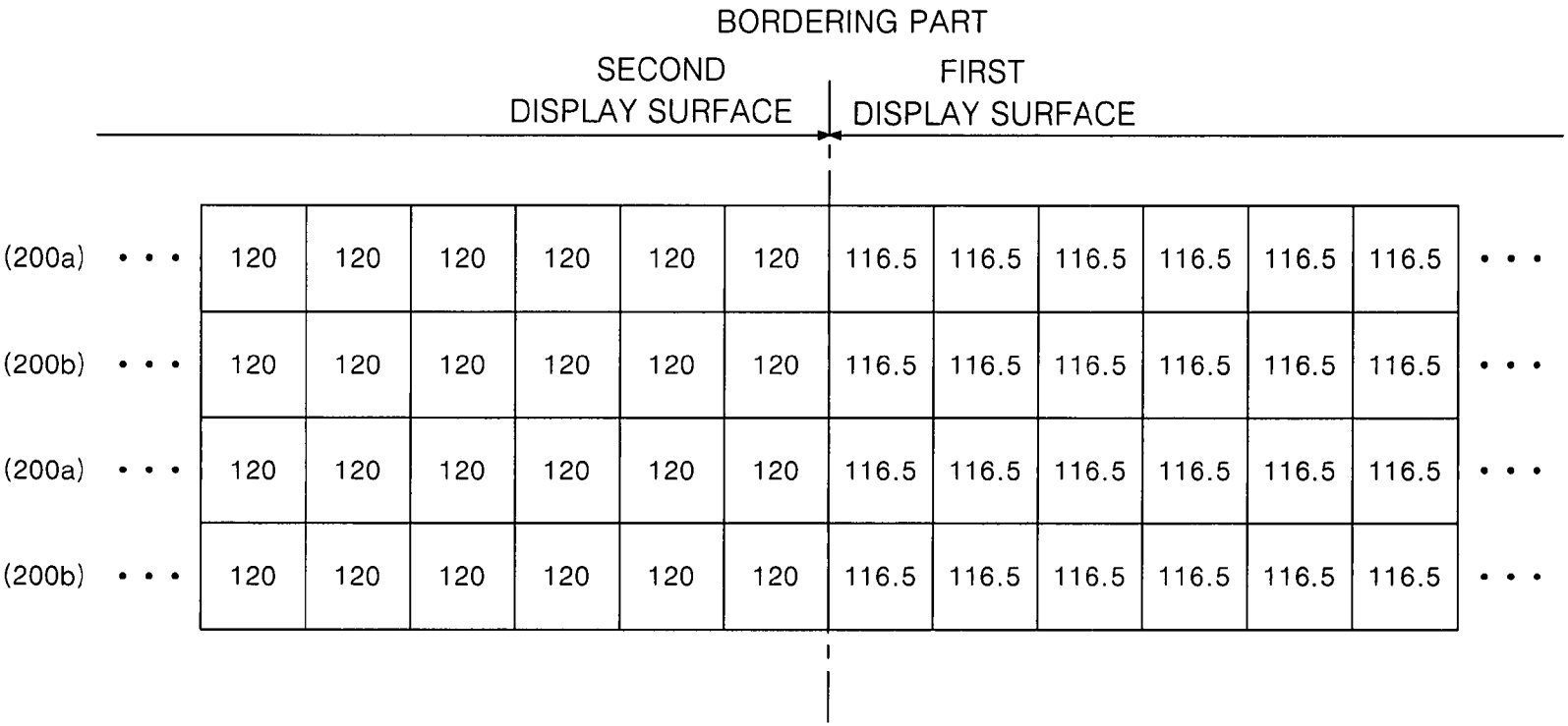
Figure 12B:
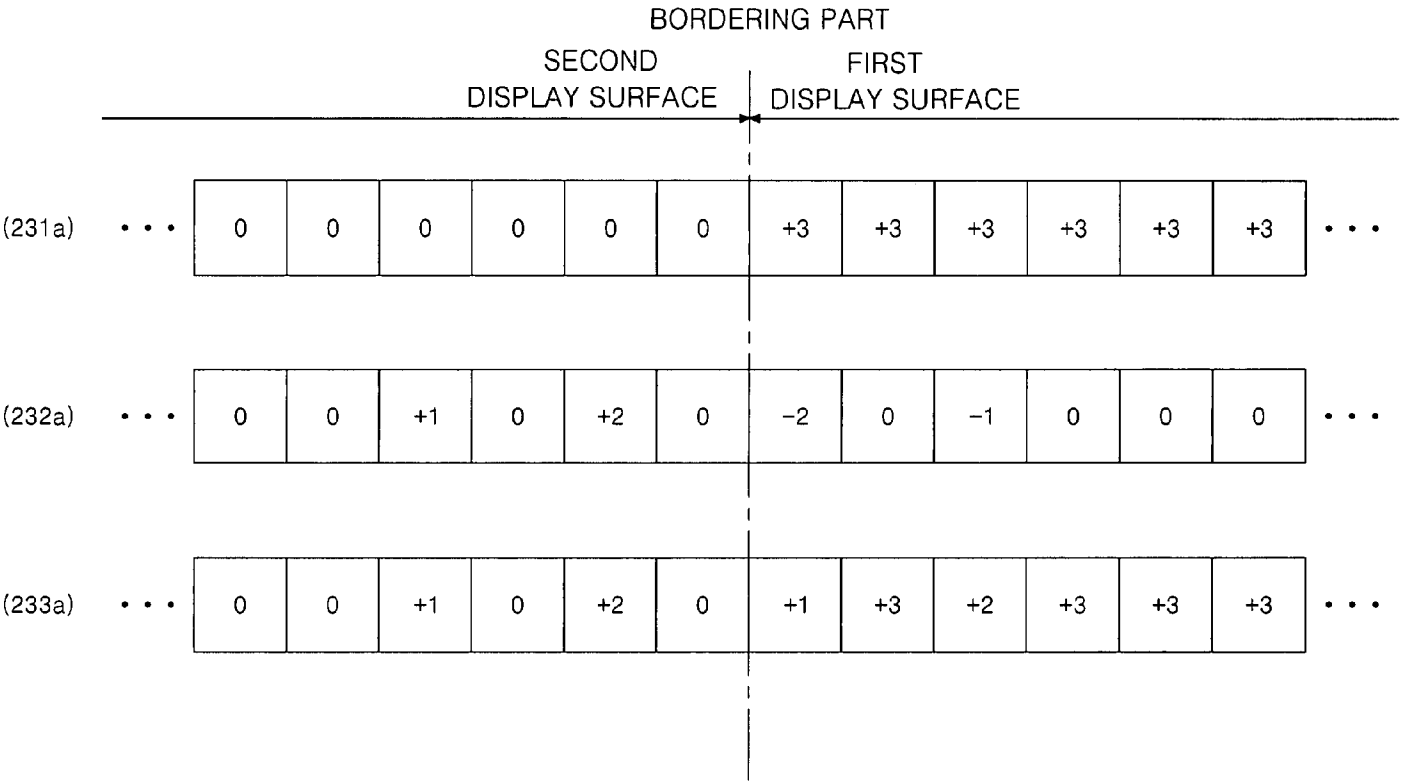

For example, as shown in FIG. 12A, if the brightness of the second display surface is 120 and the brightness of the first display surface is 116.5, (i.e., if the brightness difference (d) of the first and second display surfaces is 3.5 and ΔL has the value of 1), the first compensation data 231*a* of the first type is set to the compensation value of 0 in the second display surface and to the compensation value of +3 in the first display surface, as shown in FIG. 12B. In addition, the second compensation data 232*a* of the first type is set to the compensation value of −2 for the pixel adjacent to the boundary in the first display surface and the compensation value is increased by 1 for each pixel that is away from that pixel with a distance of every other pixel.

Further, the second compensation data 232*a* of the first type is set to the compensation value of +2 for the pixel which is located away from that pixel adjacent to the boundary of the first display surface with a boundary therebetween with a distance of every other pixel in the second display surface and the compensation value is decreased by 1 for each pixel that is away from that pixel with a distance of every other pixel. Also, the summed compensation data 233*a* of the first type is calculated by the sum of the first compensation data 231*a* of the first type and the second compensation data 232*a* of the first type.

Figure 12C:
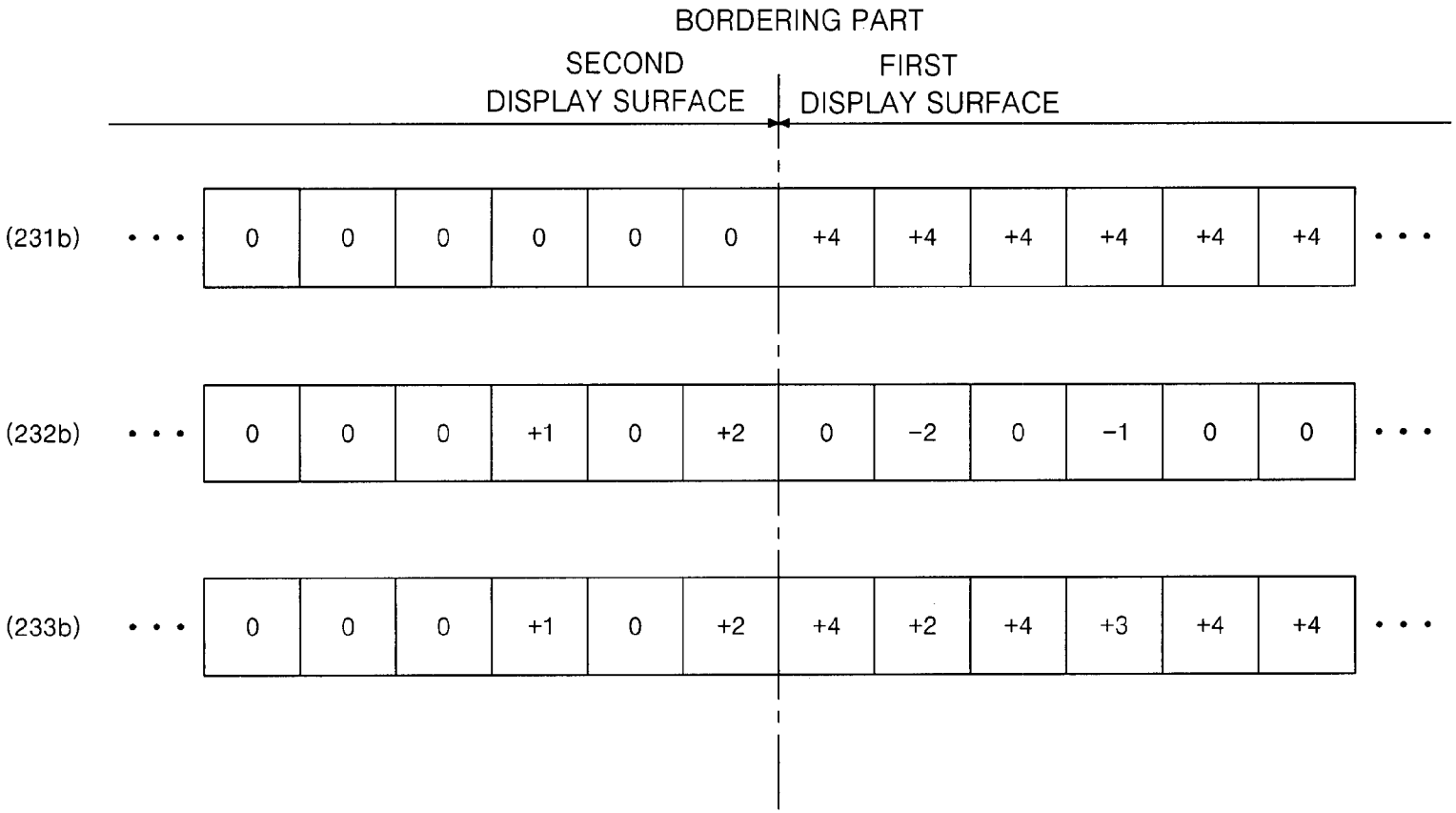

Referring to FIG. 12C, the first compensation data 231*b* of the second type is set to the compensation value of 0 in the second display surface and to the compensation value of +4 in the first display surface differently from the first compensation data 231*a* of the first type. In addition, the second compensation data 232*b* of the second type is set to the compensation value of +2 for the pixel adjacent to the boundary in the second display surface and the compensation value is decreased by 1 for each pixel that is away from that pixel with a distance of every other pixel. Also, the second compensation data 232*b* of the second type is set to the compensation value of −2 for the pixel which is located away from that pixel adjacent to the boundary of the second display surface with a boundary therebetween with a distance of every other pixel in the first display surface and the compensation value is increased by 1 for each pixel that is away from that pixel with a distance of every other pixel.

The second compensation data 232*b* of the second type can be set for every other pixel for the range from one pixel which is as close to the boundary as possible to the pixel which is away from the boundary at most by half of the distance between both ends of the first display surface while including the above pixels. In addition, the summed compensation data 233*b* of the second type is calculated by the sum of the first compensation data 231*b* of the second type and the second compensation data 232*b* of the second type.

Figure 12D:
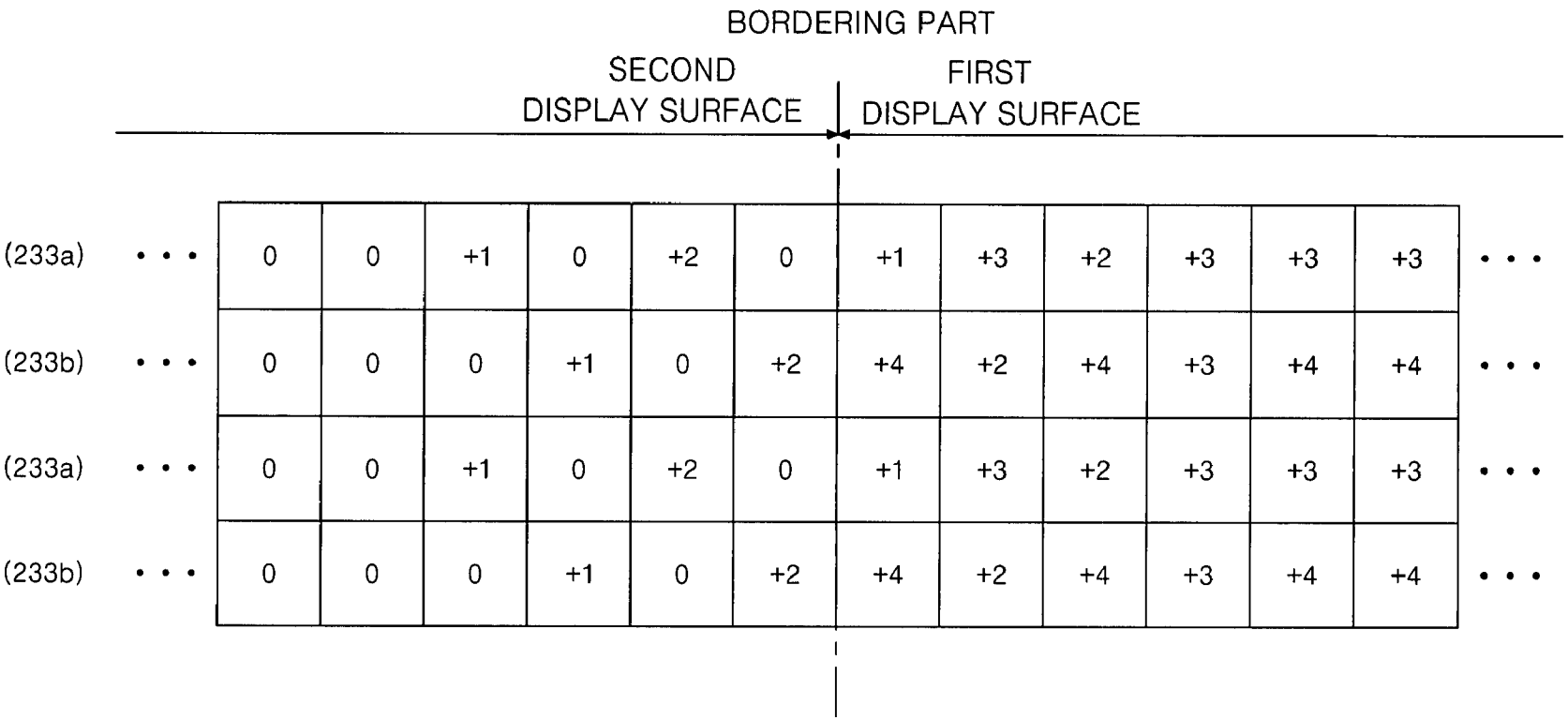

The summed compensation data 233*a* and 233*b* of the first and second types calculated as above, as shown in FIG. 12D, are alternately applied to the adjacent horizontal lines on the display panel, and the brightness compensation result of the bordering part and the first display surface which can be predicted by the summed compensation data 233*a* and 233*b* of the first and second types is as shown in FIG. 12E.

In addition, the above-described embodiments have been explained centering on the fact that the compensation data are calculated by sequentially taking all the foregoing steps. However, to make the fabrication process simpler in an actual mass-production, the patterns of a plurality of the standardized compensation data which can correspond to various patterns of the bordering part noise and the first display surface are stored in a database using repeated experiments. Thus, it is possible to select the optimum compensation data pattern corresponding to the brightness difference type of the bordering area and the panel defect among standardized patterns after a simple inspection process, thereby computing the optimum compensation data at once.

Further, with reference to FIG. 4A, Subsequent to the step S3 or S4, the fabricating method of the liquid crystal display device according to an embodiment of the present invention bonds upper/lower substrates with a sealant or frit glass (S5). The step S5 includes an alignment film forming/rubbing process and a substrate bonding/liquid crystal injecting process. In the alignment film forming/rubbing process, an alignment film is spread over each of the upper and lower substrates and the alignment film is rubbed with a rubbing cloth, etc. In the substrate bonding/liquid crystal injecting process, the upper substrate and the lower substrate are bonded using the sealant, and a liquid crystal and a spacer are injected through a liquid crystal injection hole and then the liquid crystal injection hole is sealed off.

Next, the fabricating method displays a test picture by applying a test data of each gray level to the display panel where the upper/lower substrates are bonded, and inspects the presence or absence of the panel defect and/or the defect sub-pixel for the picture using an electrical/magnetic inspection and/or a bare eye inspection process (S6). In the inspection step S6, there is a difference because the bare eye inspection is possible in comparison with the inspection of the step S2. Further, the bare eye inspection includes an inspection which is carried out using optical equipment such as a camera, etc.

In addition, when the defect sub-pixel and/or the panel defect are detected as the inspection result of the step S6 (Yes in S7), the fabricating method performs correction for improving the defect caused by the defect sub-pixel and/or the panel defect (S8). When the defect sub-pixel is detected as the inspection result of the step S6 (Yes in S7), a repair process (S21 in FIG. 4B) is performed for the detected defect sub-pixel.

The repair process S21 for the defect sub-pixel shown in FIG. 5 is performed by a method of electrically shorting or linking the defect sub-pixel 10 and the normal sub-pixel 11 which is adjacent to and has the same color as the defect sub-pixel 10. The repair process S21 includes blocking a path through which a data voltage is supplied to a pixel electrode of the defect sub-pixel 10 and electrically shorting or linking the normal sub-pixel 11 and the defect sub-pixel 10 using the conductive link pattern 12. On the other hand, the repair process S21 of the step S8 is different from the repair process S21 of the step S4 because it is difficult to form the link pattern using a W-CVD (chemical vapor deposition) process.

Further, the information for the presence or absence of the defect sub-pixel 10 together with the information for the location of the link sub-pixel 13 is stored at the inspection computer after the repair process S21, and the inspection computer calculates the charge characteristic compensation data for each gray level for each location of the link sub-pixel 13 (S22 in FIG. 4B). In addition, when the panel defect is detected as the inspection result of the step S6 (Yes in S7 of FIG. 4A), the information for the presence or absence of the panel defect together with the information for the location of the panel defect (or the first display surface) is stored at the inspection computer, and the inspection computer calculates the panel defect compensation data for each gray level for each location of the panel defect (S31).

Further, after compensating the brightness of the first display surface using the panel defect compensation data calculated in the step S31 (i.e., after modulating the test data to the panel defect compensation data calculated in the step S31 to apply to the display panel), the electrical/magnetic inspection and/or bare eye inspection are performed for the bordering part (S32 and S33).

When the bordering part noise is detected as the inspection result of the step S33 (Yes in S34 of FIG. 4B), the information for the presence or absence of the bordering part noise together with the information for the location where the bordering part noise appears is stored at the inspection computer, and the inspection computer calculates the bordering part noise compensation data for each gray level for each location where the bordering part noise appears (S35). Further, the inspection computer calculates the summed compensation data by adding the bordering part noise compensation data calculated in the step S35 to the panel defect compensation data calculated in the step S31.

Subsequently, the fabricating method mounts a drive circuit onto the display panel where the upper/lower substrates are bonded and puts the display panel on which the drive circuit is mounted, a backlight, etc. into a case, thereby performing a module assembly process of the display panel (S9). In the mounting process of the drive circuit, an output terminal of a tape carrier package ('TCP') on which IC's such as a gate drive IC and a data drive IC are mounted is connected to a pad part on a substrate, and an input terminal of a TCP is connected to a printed circuit board ('PCB') on which a timing controller is mounted.

Further, a memory for storing the compensation data and a compensation circuit for modulating the stored data to be displayed and for supplying the modulated data to the drive circuit are mounted on the PCB. Also, the memory is a non volatile memory such as EEPROM (electrically erasable programmable read only memory) where the data can be renewed and erased. In addition, the compensation circuit can be embedded in the timing controller as a single chip with the timing controller. Further, the drive IC's can also be mounted directly on the substrate by a COG (chip-on-glass) method other than a TAB (tape automated bonding) method.

Subsequently, the fabricating method displays the test picture by applying the test data of each gray level to the display panel and inspects the presence or absence of the panel defect and/or the defect sub-pixel by the electrical/magnetic inspection and/or the bare eye inspection for the picture (S10 in FIG. 4A). The inspection of the step S10 has a difference because the bare eye inspection is possible in comparison with the inspection of the step S2 in the same manner as the inspection of the step S6. The bare eye inspection includes an inspection which is performed using optical equipment such as a camera, etc.

Further, when the defect sub-pixel and/or the panel defect are detected as the inspection result of the step S10 (Yes in S11), the fabricating method performs a correction process for improving the defect caused by the defect sub-pixel and/or the panel defect (S12). In more detail, referring to FIG. 4B, when the defect sub-pixel is detected as the inspection result of the step S10 (Yes in S11), a repair process (S21) is performed for the detected defect sub-pixel.

As discussed above, the repair process S21 for the defect sub-pixel as shown in FIG. 5 is performed by electrically shorting or linking the defect sub-pixel 10 and the normal sub-pixel 11 which is adjacent to and has the same color as the defect sub-pixel 10. The repair process S21 includes blocking a path through which a data voltage is supplied to a pixel electrode of the defect sub-pixel 10 and electrically shorting or linking the normal sub-pixel 11 and the defect sub-pixel 10 by use of the conductive link pattern 12. On the other hand, the repair process S21 of the step S12 is different from the repair process S21 of the step S4 because it is difficult to form the link pattern using a W-CVD (chemical vapor deposition) process, in the same manner as the step S8.

Further, the information for the presence or absence of the defect sub-pixel 10 together with the information for the location of the link sub-pixel 13 is stored at the inspection computer after the repair process S21, and the inspection computer calculates the charge characteristic compensation data for each gray level for each location of the link sub-pixel 13 (S22). When the panel defect is detected as the inspection result of the step S10 (Yes in S11), the information for the presence or absence of the panel defect together with the information for the location of the panel defect (or the first display surface) is stored at the inspection computer, and the inspection computer calculates the panel defect compensation data for each gray level for each location of the panel defect (S31).

After compensating the brightness of the first display surface using the panel defect compensation data calculated in the step S31 (i.e., after modulating the test data to the panel defect compensation data calculated in the step S31 to apply to the display panel), the electrical/magnetic inspection and/or bare eye inspection are performed for the bordering part (S32 and S33). When the bordering part noise is detected as the inspection result of the step S33 (Yes in S34), the information for the presence or absence of the bordering part noise together with the information for the location where the bordering part noise appears is stored at the inspection computer, and the inspection computer calculates the bordering part noise compensation data for each gray level for each location where the bordering part noise appears (S35). The inspection computer calculates the summed compensation data by adding the bordering part noise compensation data calculated in the step S35 to the panel defect compensation data calculated in the step S31.

Subsequently, the fabricating method stores the location data, the charge characteristic compensation data and the summed compensation data for the link sub-pixel, the panel defect (or the first display surface) and the bordering part which are determined by the steps S4, S8 and S12 at the EEPROM (S13). Further, the inspection computer supplies the location data and the compensation data to the EEPROM using a ROM recorder. Then, the ROM recorder can transmit the location data and the compensation data to the EEPROM through a user connector. The compensation data is transmitted in series through the user connector, and a serial clock, a power source, a ground power source, etc. are transmitted to the EEPROM through the user connector.

In addition, the memory for storing the location data and the compensation data can be an EDID ROM (extended display identification data ROM) instead of an EEPROM. The EDID ROM stores monitor information data such as a seller/buyer identification information, the variables and characteristic of the basic display device, etc. Further, the location data and the compensation data are stored at a storage space which is separate from the storage space at which the monitor information data are stored. In addition, for storing the compensation data at the EDID ROM instead of the EEPROM, the ROM recorder transmits the compensation data through a DDC (data display channel). Accordingly, the EEPROM and the user connector can be removed if the EDID ROM is used, and thus an additional development cost is reduced.

Further, the below description assumes that the memory storing the compensation data is the EEPROM. However, the EEPROM and the user connector can be replaced with the EDID ROM and DDC. Also, the memory for storing the location data and the compensation data can be another type of non volatile memory which can renew and erase the data as well as the EEPROM and the EDID ROM.

The fabricating method then modulates the test data using the location data and the compensation data which are stored at the EEPROM, and performs the picture quality inspection process by applying the modulated data to the display panel (S14). Further, when detecting picture quality defects which exceed a sufficiently good product reference tolerance as the inspection result of the step S14, a correction process is performed (S16). The correction subject includes the picture quality defect which is not found in the inspection of the steps S2, S6 and S10, and the picture quality defect caused by the non optimization of the compensation value which is calculated in the steps S4, S8 and S12.

For example, when the defect sub-pixel unfound in the steps S2, S6 and S10 is detected in the step S14, the repair process for this sub-pixel is performed and the charge characteristic compensation data is calculated and stored in the EEPROM (S13). Further, when the compensation data calculated in the steps S4, S8 and S12 are not optimized, the compensation data are re-calculated and stored in the EEPROM so the compensation data in the EEPROM is renewed. On the other hand, when detecting the brightness defect of the backlight unit in the step S14, the compensation data for this defect is calculated like the foregoing panel defect compensation data and stored at the EEPROM (S13).

In addition, when the picture quality defect is not found as the inspection result of the step S14 (No in S15) (i.e., if the degree of the picture quality defect is found to be not higher than the good product tolerance reference value), the liquid crystal display device is judged as a good product to be shipped to the customer (S17). On the other hand, the foregoing inspection steps and correction steps can be simplified or the designated steps thereof omitted to simplify the fabrication process, etc.

Turning next to FIGS. 13A to 16C, which are diagrams representing various embodiments of forming a conductive link pattern in the repair process S21.

Figure 13A:
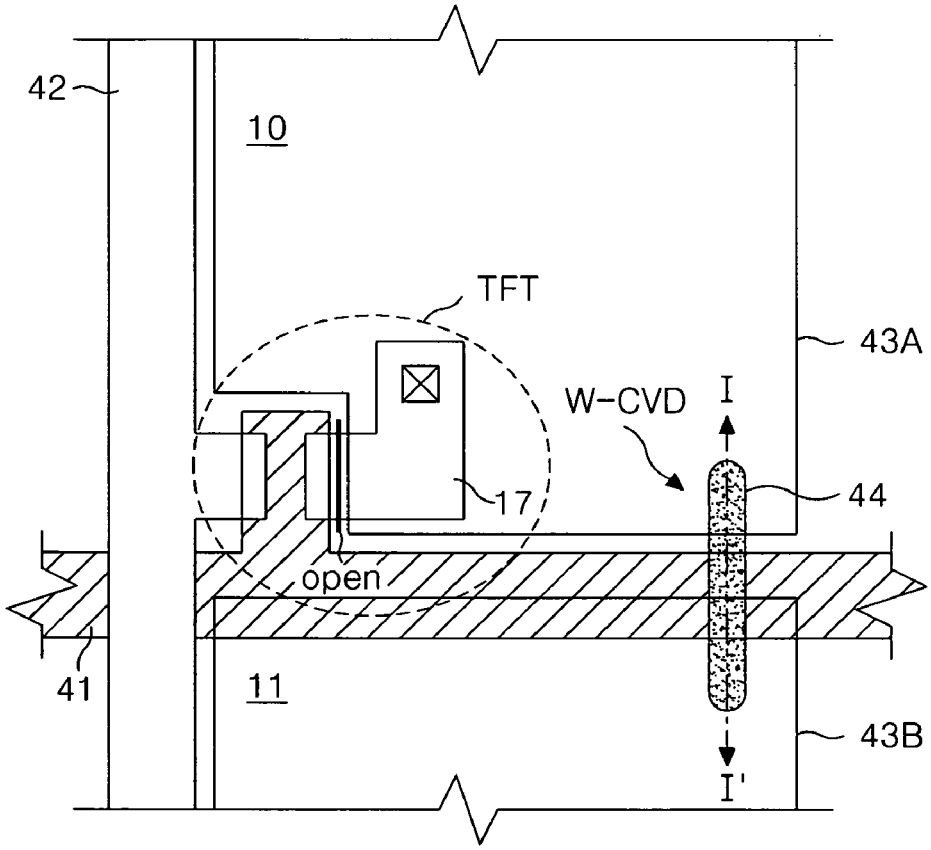
FIGS. 13A to 13C are diagrams representing a first embodiment of a repair process according to an embodiment of the present invention.
Figure 13B:
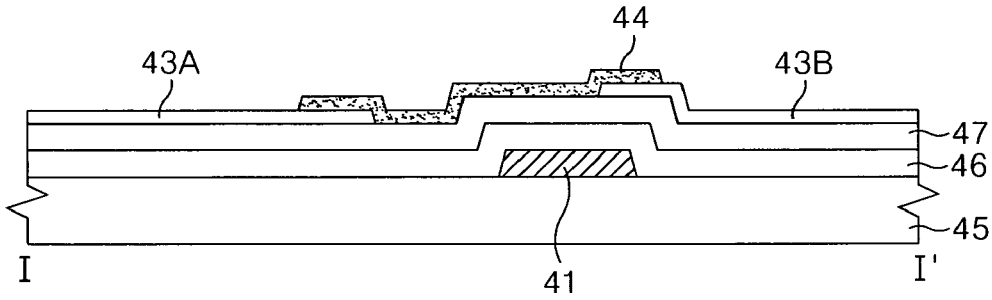
Figure 13C:
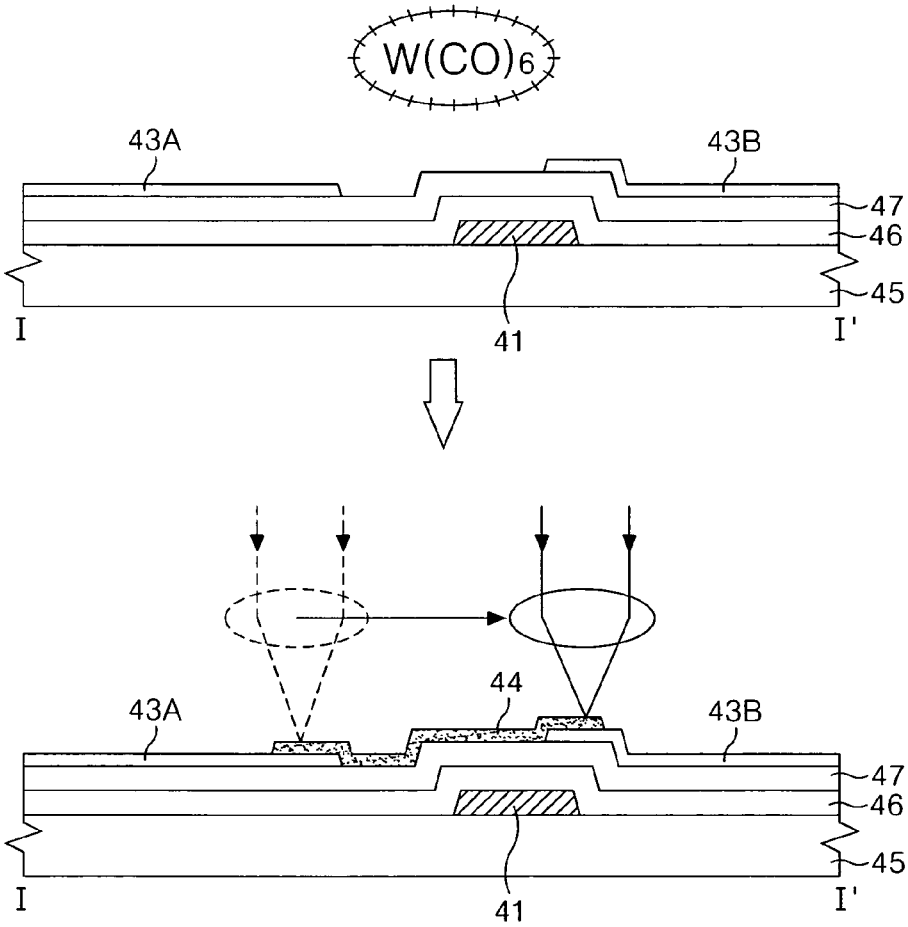

For example, FIGS. 13A to 13C are diagrams for explaining a repair process of a liquid crystal display device of a TN mode according to a first embodiment of the present invention. Referring to FIGS. 13A and 13B, a repair process according to the present invention directly forms a link pattern 44 on a pixel electrode 43A of the defect sub-pixel 10 and a pixel electrode 43B of the normal sub-pixel 11 which are adjacent to each other.

In addition, on a glass substrate 45 of the lower substrate, a gate line 41 and a data line 42 cross each other and a TFT is formed at the crossing part thereof. Further, a gate electrode of the TFT is electrically connected to the gate line 41 and a source electrode is electrically connected to the data line 42. A drain electrode of the TFT is also electrically connected to the pixel electrodes 43A and 43B through a contact hole.

In addition, a gate metal pattern inclusive of the gate line 41, the gate electrode of the TFT, etc. is formed on the glass substrate 45 by a deposition process of a gate metal such as aluminum Al, aluminum neodymium AlNd, etc., a photolithography process and an etching process. A source/drain metal pattern inclusive of the data line 42, the source and drain electrodes of the TFT, etc. is formed on a gate insulating film 46 by a deposition process of a source/drain metal such as chrome Cr, molybdenum Mo, titanium Ti, etc, a photolithography process and an etching process.

The gate insulating film 46 for electrically insulating the gate metal pattern from the source/drain metal pattern is formed of an inorganic insulating film such as silicon nitride SiNx or silicon oxide SiOx. Further, a passivation film covering the TFT, the gate line 41 and the data line is formed of an inorganic insulating film or an organic insulating film.

In addition, the pixel electrodes 43A and 43B are formed on the passivation film 47 by depositing a transparent conductive metal such as ITO (indium tin oxide), TO (tin oxide), IZO (indium zinc oxide) or ITZO (indium tin zinc oxide), a photolithography process and an etching process. A data voltage from the data line 42 is supplied to the pixel electrodes 43A and 43B through the TFT for a scan period while the TFT is turned on.

Further, the repair process is performed for the lower substrate before the substrate bonding/liquid crystal injecting process. The repair process firstly opens a current path between the source electrode of the TFT and the data line 42 or between the drain electrode of the TFT and the pixel electrode 43A by a laser cutting process in order to block the current path between the TFT of the defect sub-pixel 10 and the pixel electrode 43A. Subsequently, the link pattern 44 is formed between the pixel electrode 43A of the defect sub-pixel 10 and the pixel electrode 43B of the normal sub-pixel 11 which is adjacent thereto and has the same color by directly depositing tungsten W on the passivation film 47 between the pixel electrodes 43A and 43B using the W-CVD process. Further, the order of the wire breaking process and the W-CVD process can be interchanged.

In addition, the W-CVD process condenses a laser light on any one of the pixel electrodes 43A and 43B under the atmosphere of $W(CO)_6$ and moves or scans the condensed laser light to another pixel electrode as shown in FIG. 13C. Then, the $W(CO)_6$ reacts to the laser light for the tungsten W to be separated from the $W(CO)_6$, and the tungsten W is deposited on the passivation film 47 between the pixel electrodes 43A and 43B while moving from one pixel electrode 43A to the other pixel electrode 43B through the passivation film 47 along the scan direction of the laser light.

Figure 14A:
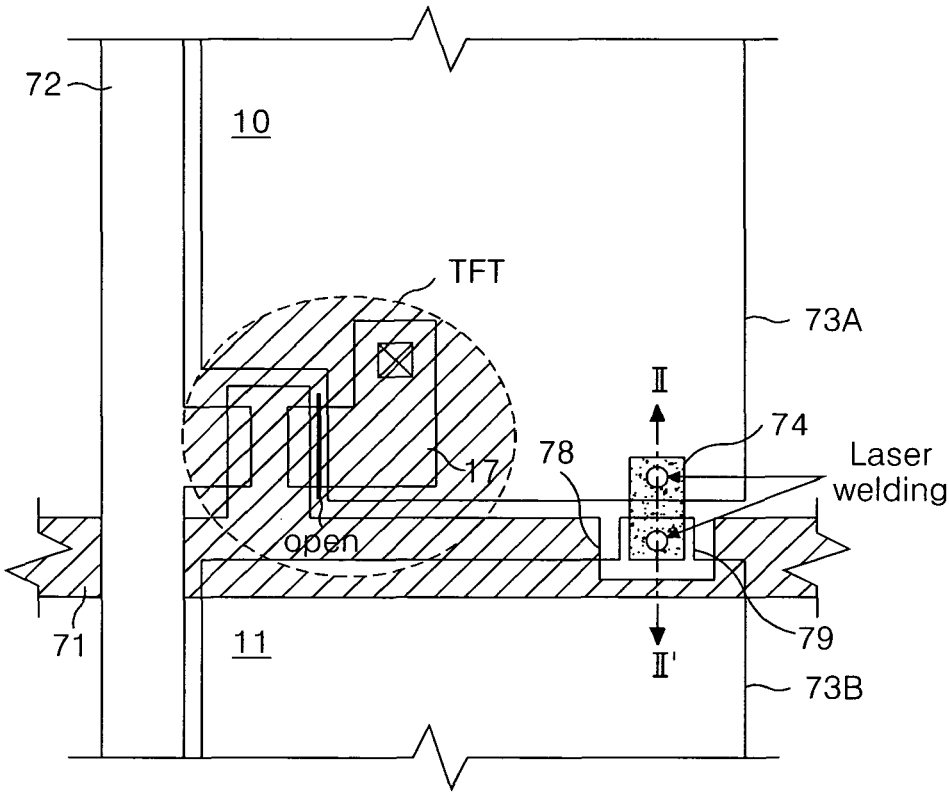
FIGS. 14A to 14C are diagrams representing a second embodiment of the repair process according to an embodiment of the present invention.
Figure 14B:
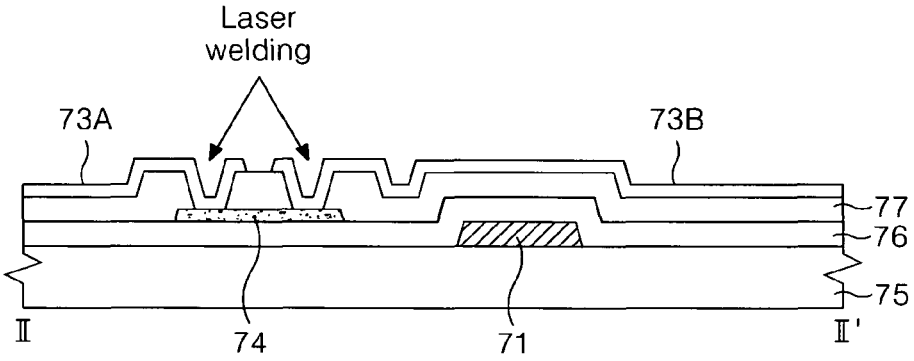
Figure 14C:
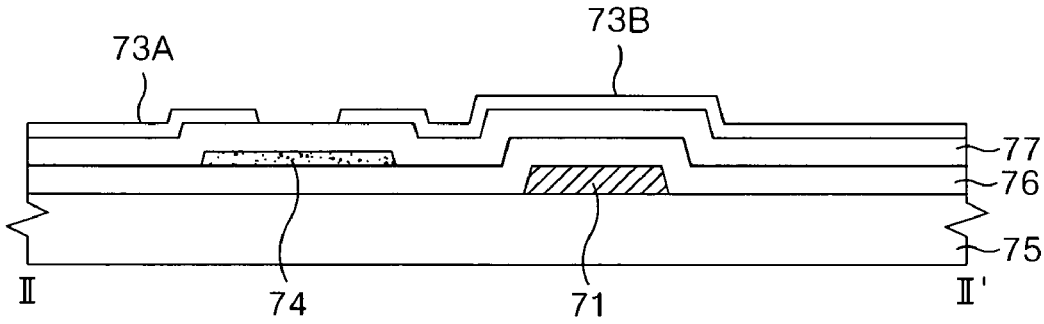

Next, FIGS. 14A to 14C are diagrams for explaining a repair process of a liquid crystal display device of a TN mode according to a second embodiment of the present invention. Referring to FIGS. 14A and 14B, a repair process according to the present invention includes a link pattern 74 that overlaps a pixel electrode 73A of the defect sub-pixel 10 and a pixel electrode 73B of the normal sub-pixel 11, which are adjacent to each other, with a passivation film 77 therebetween.

In addition, on a glass substrate 75 of the lower substrate, a gate line 71 and a data line 72 cross each other and a TFT is formed at the crossing part thereof. Further, a gate electrode of the TFT is electrically connected to the gate line 71 and a source electrode is electrically connected to the data line 72. Also, a drain electrode of the TFT is electrically connected to the pixel electrodes 73A and 73B through a contact hole.

In addition, a gate metal pattern inclusive of the gate line 71, the gate electrode of the TFT, etc. is formed on the glass substrate 75 by a gate metal deposition process, a photolithography process and an etching process. Also, the gate line 71 is separated from the link pattern 74 with a designated distance so as not to overlap the link pattern 74, and includes a concave pattern 78 which has a shape of covering the link pattern 74.

Also, a source/drain metal pattern inclusive of the data line 72, the source and drain electrodes of the TFT, the link pattern 74, etc. is formed on a gate insulating film 76 by a source/drain metal deposition process, a photolithography process and an etching process. In addition, the link pattern 74 is formed to be an island pattern, which is not connected to the gate line 71, the data line 72 and the pixel electrodes 73A and 73B before the repair process. Further, both ends of the link pattern 74 are overlapped with the vertically adjacent pixel electrodes 73A and 73B and are connected to the pixel electrodes 73A and 73B in the laser welding process.

In addition, the gate insulating film 76 electrically insulates the gate metal pattern from the source/drain metal pattern, and a passivation film 77 electrically insulates the source/drain metal pattern from the pixel electrodes 73A, 73B. The pixel electrodes 73A and 73B are formed on the passivation film 77 by depositing a transparent conductive metal, a photolithography process and an etching process. The pixel electrodes 73A and 73B include an extension part 79 which is extended from one side of an upper part. The pixel electrodes 73A and 73B are sufficiently overlapped with one end of the link pattern 74 by the extension part 79. Also, a data voltage from the data line 72 is supplied to the pixel electrodes 73A and 73B through the TFT for a scan period while the TFT is turned on.

In addition, the repair process is performed for the lower substrate before the substrate bonding/liquid crystal injecting process or for a panel after the substrate bonding/liquid crystal injecting process. The repair process firstly opens a current path between the source electrode of the TFT and the data line 72 or between the drain electrode of the TFT and the pixel electrode 73A by a laser cutting process in order to block the current path between the TFT of the defect sub-pixel and the pixel electrode 73A.

Subsequently, the repair process irradiates a laser beam to the pixel electrodes 73A and 73B which are adjacent in both ends of the link pattern 74. Then, the pixel electrodes 73A and 73B and the passivation film 77 are melted by the laser light, and as a result, the pixel electrodes 73A and 73B are connected to the link pattern 74. In addition, the order of the wire breaking process and the laser welding process can be interchanged. FIG. 14C shows the pixel electrodes 73A and 73B and the link pattern 74 electrically separated by the passivation film before the laser welding process.

Figure 15A:
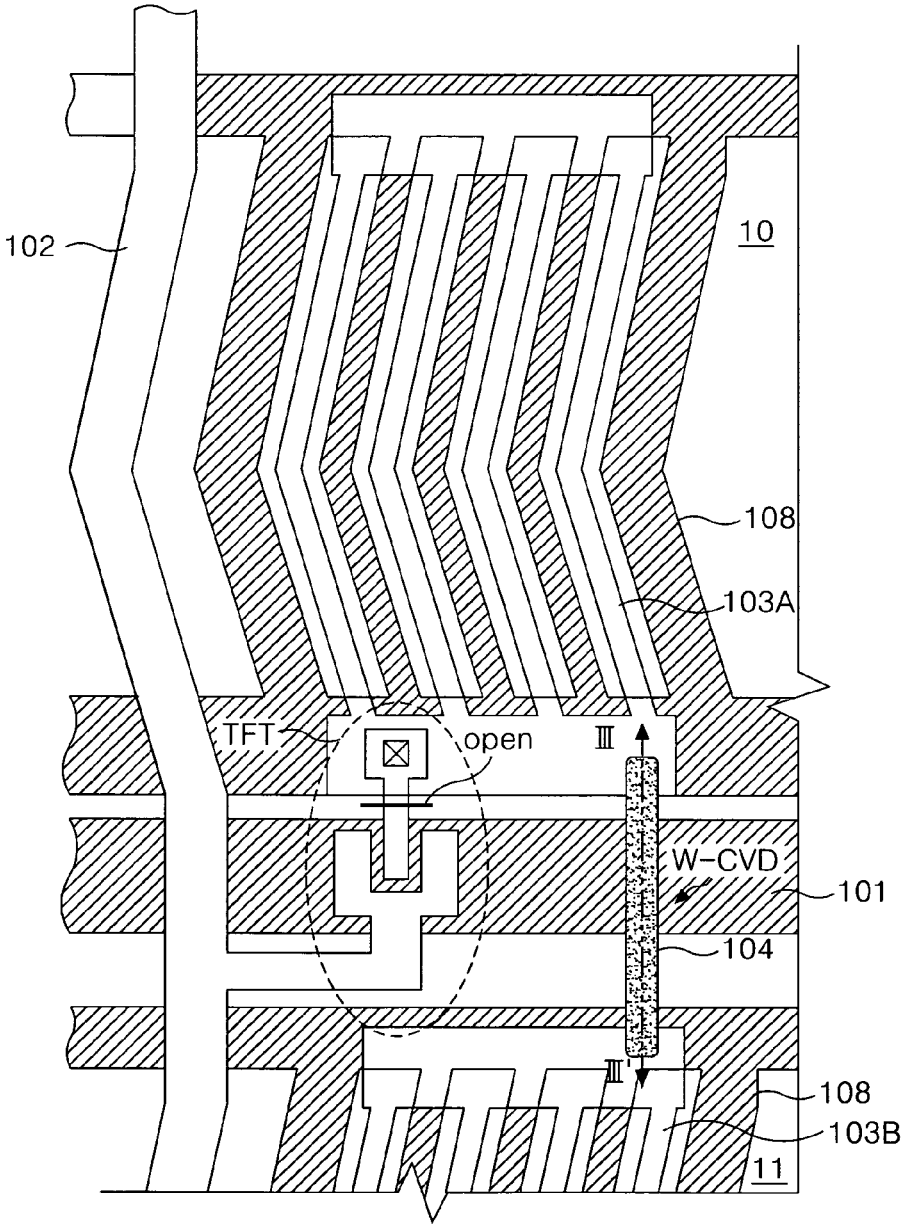
FIGS. 15A and 15B are diagrams representing a second embodiment of the repair process according to the present invention.
Figure 15B:
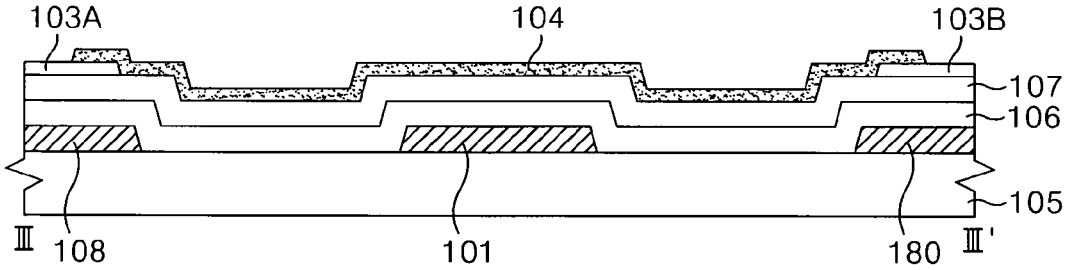

Next, FIGS. 15A and 15B are diagrams for explaining a repair process of a liquid crystal display device of an IPS mode according to a third embodiment of the present invention. Referring to FIGS. 15A and 15B, the repair process forms a link pattern 104 on a pixel electrode 103A of the defect sub-pixel 10 and a pixel electrode 103B of the normal sub-pixel 11, which are adjacent, using a W-CVD (chemical vapor deposition) process.

Further, on a glass substrate 105 of the lower substrate, a gate line 101 and a data line 102 cross each other and a TFT is formed at the crossing part thereof. A gate electrode of the TFT is also electrically connected to the gate line 101 and a source electrode is electrically connected to the data line 102. Also, a drain electrode of the TFT is electrically connected to the pixel electrodes 103A, 103B through a contact hole.

In addition, a gate metal pattern inclusive of the gate line 101, the gate electrode of the TFT, a common electrode 108, etc. is formed on the glass substrate 105 by a gate metal deposition process, a photolithography process and an etching process. The common electrode 108 is connected to all liquid crystal cells to apply a common voltage Vcom to the liquid crystal cells. A horizontal electric field is applied to the liquid crystal cells by the common voltage Vcom applied to the common electrode 108 and the data voltage applied to the pixel electrodes 103A, 103B.

In addition, a source/drain metal pattern inclusive of the data line 102, the source and drain electrodes of the TFT, etc. is formed on a gate insulating film 106 by a source/drain metal deposition process, a photolithography process and an etching process. The pixel electrodes 103A and 103B are formed on a passivation film 107 by a process of depositing a transparent conductive metal, a photolithography process and an etching process. A data voltage from the data line 102 is supplied to the pixel electrodes 103A and 103B through the TFT for a scan period while the TFT is turned on.

The repair process is performed for the lower substrate before the substrate bonding/liquid crystal injecting process. The repair process firstly opens a current path between the source electrode of the TFT and the data line 102 or between the drain electrode of the TFT and the pixel electrode 103A by a laser cutting process in order to block the curren,t path between the TFT of the defect sub-pixel 10 and the pixel electrode 103A. Subsequently, a link pattern 104 is formed between the pixel electrode 103A of the defect sub-pixel 10 and the pixel electrode 103B of the normal sub-pixel 11 which is adjacent thereto and has the same color by directly depositing tungsten W on the passivation film 107 between the pixel electrodes 103A and 103B using the W-CVD process. In addition, the order of the wire breaking process and the W-CVD process can be interchanged.

Figure 16A:
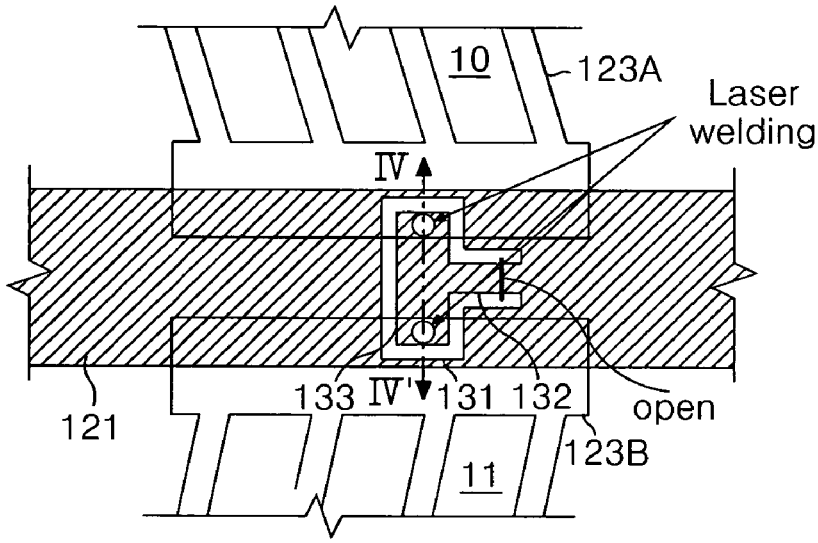
FIGS. 16A to 16C are diagrams representing a third embodiment of the repair process according to the present invention.
Figure 16B:
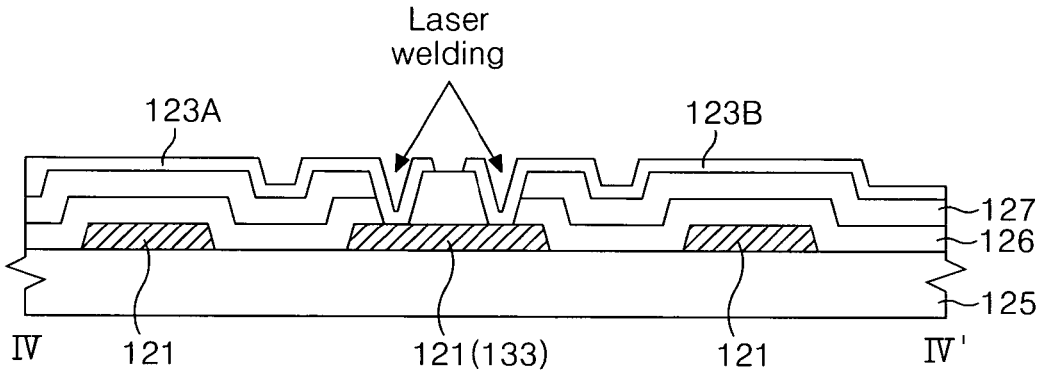
Figure 16C:
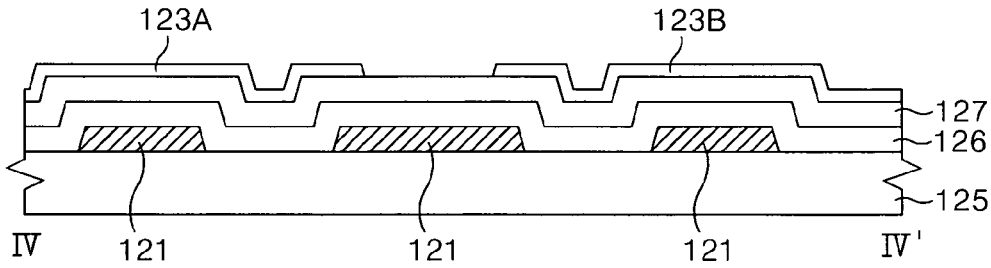

Next, FIGS. 16A to 16C are diagrams for explaining a repair process of a liquid crystal display device of an IPS mode according to a fourth embodiment of the present invention. In FIGS. 16A to 16C, the data metal pattern such as the data line, etc., the TFT, the common electrodes for applying the horizontal electric field to the liquid crystal cells together with the pixel electrode, etc. are omitted.

Referring to FIGS. 16A and 16B, a gate line 121 of the liquid crystal display device according to the present invention includes a neck part 132, a head part 133 which is connected to the neck part 132 and of which the area is enlarged, and an aperture pattern 131 which is removed in a 'C' shape around the neck part 132 and the head part 133. A gate metal pattern inclusive of the gate line 121, the gate electrode of the TFT (not shown), a common electrode, etc. is formed on the glass substrate 125 by a gate metal deposition process, a photolithography process and an etching process.

The pixel electrodes 123A and 123B are formed on a passivation film 127 by a process of depositing a transparent conductive metal, a photolithography process and an etching process. In the gate line 121, the neck part 132 is opened by the laser cutting process in the repair process. Further, one end of the head part 133 overlaps the pixel electrode 123A of the defect sub-pixel with the gate insulating film 126 and the passivation film 127 therebetween, and the other end of the head part 133 overlaps the pixel electrode 123B of the normal sub-pixel 11, which is adjacent to the defect sub-pixel 10, with the gate insulating film 126 and the passivation film 127 therebetween.

The repair process is performed for the lower substrate before the substrate bonding/liquid crystal injecting process or a panel after the substrate bonding/liquid crystal injecting process. The repair process firstly opens a current path between the source electrode of the TFT and the data line or between the drain electrode of the TFT and the pixel electrode 123A by a laser cutting process in order to block the current path between the TFT of the defect sub-pixel and the pixel electrode 123A. Subsequently, the repair process irradiates a laser beam to the pixel electrodes 123A and 123B which are adjacent in both ends of the head part using the laser welding process as in FIG. 16B. Then, the pixel electrodes 123A and 123B, the passivation film 127 and the gate insulating film 126 are melted by the laser light, and as a result, the head part 133 becomes an independent pattern to be separated from the gate line 121 and the pixel electrodes 123A and 123B are connected to the head part 133. Further, the order of the wire breaking process and the laser welding process can be interchanged. FIG. 16C shows the pixel electrodes 123A and 123B and the head part 133 which are electrically separated by the passivation film 127 and the gate insulating film 126 before the laser welding process.

Further, the repair process according to the fourth embodiment of the present invention removes the neck part 133 in advance in the patterning process of the gate line 121 to form the link pattern 74 of FIG. 14A as an independent pattern, thereby making it possible to omit the cutting process of the neck part 133 in the repair process. In addition, the link pattern 74 of FIG. 14A, or the head part 133, the neck part 132 and the aperture pattern 131 of FIG. 16A can be formed one per pixel as in the foregoing embodiments, or they can be formed a plural number per pixel for reducing the electrical contact characteristic (i.e., the contact resistance) of the link sub-pixels).

Hereinafter, a picture quality controlling method of the liquid crystal display device according to an embodiment of the present invention will be explained.

The picture quality controlling method includes a first compensation step of modulating the video data to be displayed in the bordering part and the first display surface using the summed compensation data which is determined by the foregoing fabricating method of the liquid crystal display device, and a second compensation step of modulating the video data to be displayed in the link sub-pixel using the charge characteristic compensation data.

A first embodiment of the first compensation step in the picture quality controlling method increases or decreases the video data to be displayed in the first display surface and the bordering part to the summed compensation data. A second embodiment of the first compensation step converts R/G/B data of m/m/m bits inclusive of red R, green G and blue B information, which are to be displayed in the first display surface and the bordering part, into Y/U/V data of n/n/n (n is an integer higher than m) bits inclusive of brightness Y and color difference U/V information, increases or decreases the Y data to be displayed in the first display surface and the bordering part out of the converted Y/U/V data of n/n/n bits to the summed compensation data to modulate, and converts the modulated data again into the R/G/B data of m/m/m bits inclusive of the red R, green G and blue B information. For example, the R/G/B data of 8/8/8/ bits are converted into the Y/U/V data of 10/10/10 bits of which the number of bits is increased, the panel defect compensation data are added to or subtracted from the extended bit of the Y data when converting into the Y/U/V data, and then the Y/U/V data of 10/10/10 bits where the Y data are increased or decreased are converted again into the R/G/B data of 8/8/8 bits.

For example, when the summed compensation data for each gray level are set as in TABLE 1 below for the first display surface and the bordering part, the R/G/B data of 8/8/8/ bits, which are to be displayed in a 'location 1', are converted into the Y/U/V data of 10/10/10 bits, '10(2)' is added to the lower 2 bits of the Y data to modulate the Y data if the upper 8 bits of the converted Y data are '01000000(64)' corresponding to a 'gray level section 2'and then the Y/U/V data inclusive of the modulated Y data are converted again into the R/G/B data of 8/8/8 bits, thereby modulating the data. Further, the R/G/B data of 8/8/8/ bits, which are to be displayed in a 'location 4'are converted into the Y/U/V data of 10/10/10 bits, '11(3)' is added to the lower 2 bits of the Y data to modulate the Y data if the upper 8 bits of the converted Y data are '10000000(128)' corresponding to a 'gray level section 3'and then the Y/U/V data inclusive of the modulated Y data are converted again into the R/G/B data of 8/8/8 bits, thereby modulating the data. Further, a conversion method between the R/G/B data and the Y/U/V data will be described in detail later.

TABLE 1

| | | | | | |
|---|---|---|---|---|---|
| Gray level section 4 | 10111111(191)~11111010(250) | 00(0) | 01(1) | 10(2) | 11(3) |
| Gray level section 1 | 00000000(0)~00110010(50) | 01(1) | 00(0) | 01(1) | 01(1) |
| Gray level section 2 | 00110011(51)~01110000(112) | 10(2) | 00(0) | 01(1) | 10(2) |
| Gray level section 3 | 01110001(113)~10111110(190) | 11(3) | 01(1) | 10(2) | 11(3) |

As described above, the second embodiment of the first compensation step converts the RGB video data to be displayed in the first display surface and the bordering part into a brightness component and a color difference component by recognizing that the human eyes are more sensitive to the brightness difference than to the hue difference, and controls the brightness of the first display surface and the bordering part by increasing the bit number of the Y data inclusive of the brightness information among them, and thus there is an advantage in that a fine adjustment of the brightness is possible.

A third embodiment of the first compensation step disperses the summed compensation data to a plurality of frames using a frame rate control FRC method, and increases and decreases the video data to be displayed in the first display surface and the bordering part to the summed compensation data which are dispersed to the frames. Further, the frame rate control is an image control method using an integration effect of a visual sense, and is a picture quality controlling method where the pixels which represent different hues or gray levels are temporally arranged to make an image that expresses the hue and gray level therebetween. Also, the temporal arrangement of the pixels takes a frame period as a unit. The frame period is also known as a field period and is a display period of one screen when the data are applied to all of the pixels of one screen, and the frame period is standardized to be 1/60 seconds for an NTSC system and 1/50 seconds for a PAL system.

A fourth embodiment of the first compensation step disperses the summed compensation data to a plurality of adjacent pixels using a dithering method, and increases and decreases the video data to be displayed in the first display surface and the bordering part to the summed compensation data which are dispersed to the pixels. Further, the dithering is an image control method using an integration effect of a visual sense, and is a picture quality controlling method where the pixels which represent different hues or gray levels are spatially arranged to make an image that expresses the hue and gray level therebetween.

A fifth embodiment of the first compensation step disperses the summed compensation data to a plurality of frames using a frame rate control method and to a plurality of adjacent pixels using a dithering method, and increases and decreases the video data to be displayed in the first display surface and the bordering part to the summed compensation data which are dispersed to the frames and to the pixels.

Figure 17:
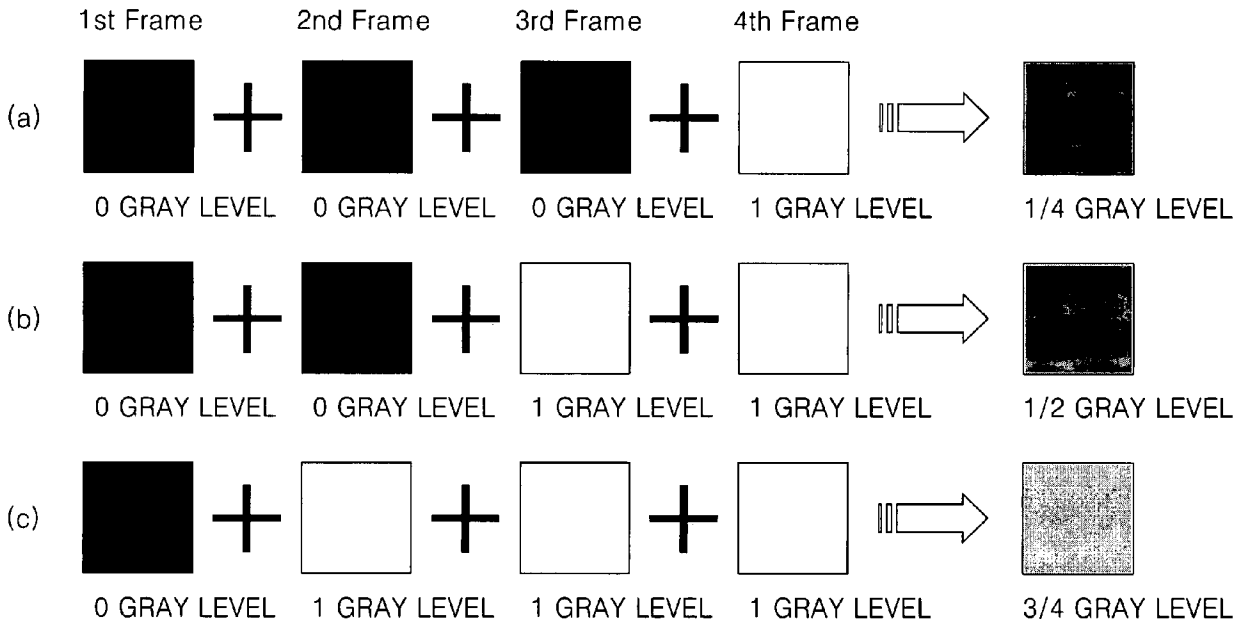
FIGS. 17 to 20 are diagrams for explaining a picture quality control which is made by a frame rate control and a dithering process.
Figure 18:
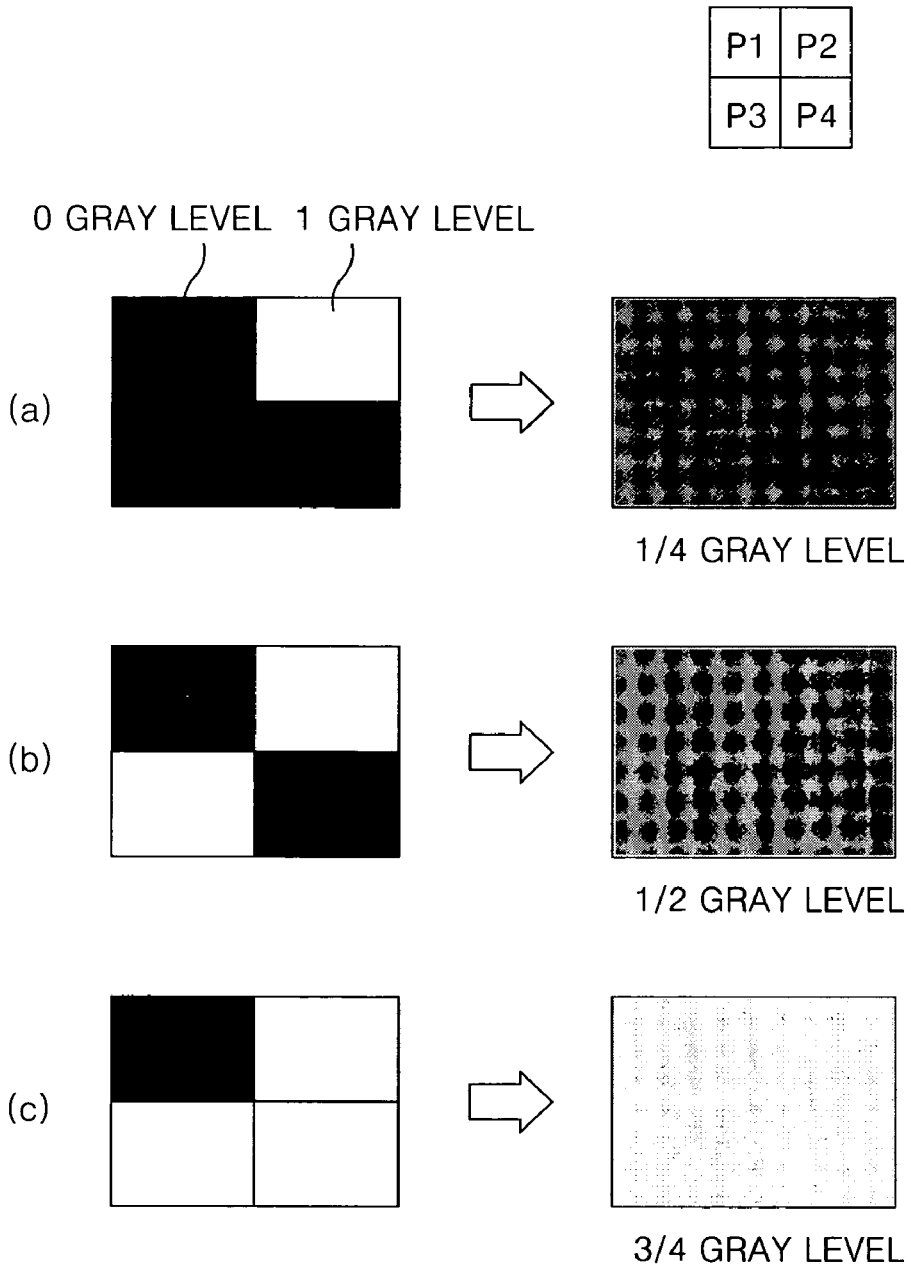

The frame rate control method and the dithering method will be explained in reference to FIGS. 17 to 19. For example, when expressing an intermediate gray level such as a 1/4 gray level, 1/2 gray level, 3/4 gray level, etc. in a screen composed of pixels which only can display 0 gray level and 1 gray level, in the frame rate control method, if 0 gray level is displayed for 3 frames and 1 gray level is displayed for 1 frame out of 4 frames which are taken as one frame group and sequentially continue, as shown in FIG. 17(*a*), an observer perceives 1/4 gray level for the pixel. In the same manner, the 1/2 gray level and 3/4 gray level are also expressed as shown in FIGS. 17(*b*) and 17(*c*). In addition, in the dithering method, if 0 gray level is displayed at 3 pixels and 1 gray level is displayed as 1 pixel out of 4 pixels which are taken as one pixel group having a 2×2 pixel structure, as shown in FIG. 18(*a*), an observer perceives a 1/4 gray level for the pixel group. In the same manner, the 1/2 gray level and 3/4 gray level are also expressed as shown in FIGS. 18(*b*) and (*c*).

Figure 19:
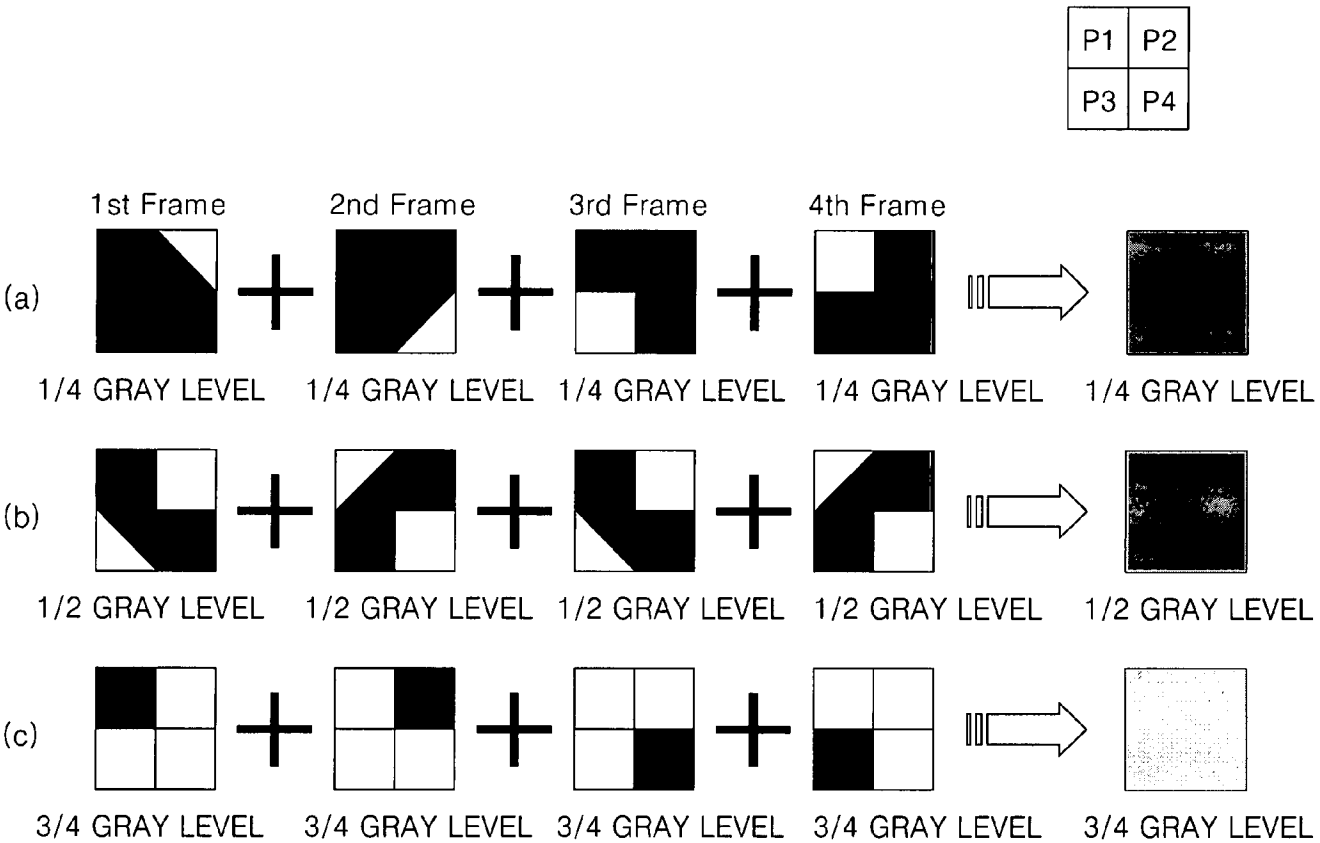

Further, as a method of using the frame rate control method and the dithering method together, FIG. 19 represents that the intermediate gray level is expressed by simultaneously applying the dithering method where the 2×2 pixel structure is one pixel group and the frame rate control where the 4 frames are taken as one unit for the pixel group. When the frame rate control and dithering method having the 2×2 pixel structure and the 4 frames as one unit as shown FIG. 19(*a*), the gray level represented by the pixel group is 1/4 gray level for each frame during the 4 frames and each of the pixels (first to fourth pixels) which constitute the pixel group represents 1/4 gray level by taking the 4 frames as one unit. In the same manner, when expressing the 1/2 gray level as shown in FIG. 19(*b*), each pixel group expresses a 1/2 gray level by the dithering process for each frame, and each pixel expresses 1/2 gray level for the 4 frames. In the same manner, 3/4 gray level is also expressed as shown in FIG. 19(*c*). The picture quality controlling method of applying the frame rate control and the dithering method together has an advantage in that it is possible to solve a flicker problem which can be generated in the frame rate control and a resolution deterioration which can be generated in the dithering method.

In addition, the number of frames which form a frame group in the frame rate control method and the number of pixels which form a pixel group in the dithering method can be adjusted in various ways as occasion demands. As an example, FIG. 20 represents a picture quality controlling method using the frame rate control and the dithering method by having a 8×8 pixel structure and 8 frames as a unit.

Figure 20:
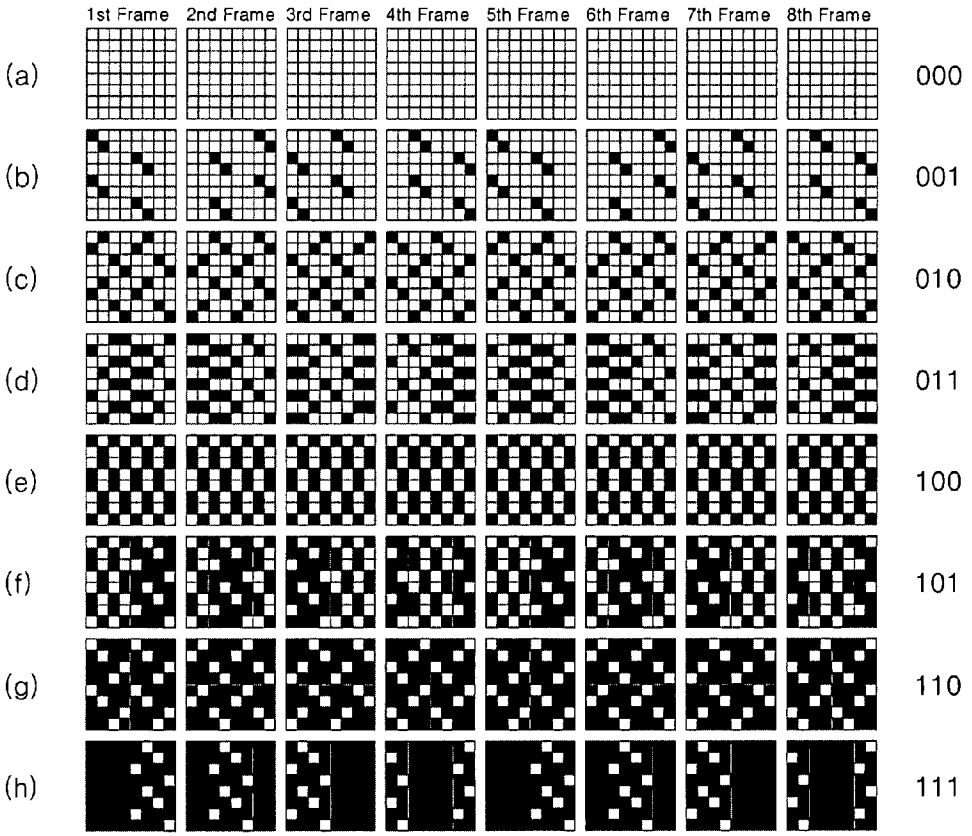

For example, when the summed compensation data for each location and for each gray level are set as in TABLE 2 below in relation to the first display surface and the bordering part, if a digital video data, which is to be displayed at a 'location 1', is '01000000(64)' corresponding to a 'gray level section 2' the frame rate control and the dithering method are performed in a pattern, as shown in FIG. 20(*d*) using the compensation data of '011(3)' so as to modulate the digital video data, which is to be displayed in the 'location 1'. Further, if the digital video data, which is to be displayed at a 'location 4' is '10000000(128)' corresponding to a 'gray level section 3' the frame rate control and the dithering method are performed in a pattern as shown in FIG. 20(*g*) using the compensation data of '110(6)' so as to modulate the digital video data, which is to be displayed in the 'location 4'.

TABLE 2

| | | | | | |
|---|---|---|---|---|---|
| Gray level section 4 | 10111111(191)~11111010(250) | 101(5) | 110(6) | 011(3) | 111(7) |
| Gray level section 1 | 00000000(0)~00110010(50) | 010(2) | 011(3) | 010(2) | 100(4) |
| Gray level section 2 | 00110011(51)~01110000(112) | 011(3) | 100(4) | 010(2) | 101(5) |
| Gray level section 3 | 01110001(113)~10111110(190) | 100(4) | 101(5) | 011(3) | 110(6) |

As described above, the third to fifth embodiments of the first compensation step compensate the brightness of the bordering part and the first display surface by the picture quality controlling method such as the frame rate control and/or the dithering method which can further sub-divide and express the hue or gray level that a screen of the display device can express in accordance with the data process capacity of the display device, thereby having an advantage in that a natural and high-grade picture quality can be realized.

Further, the picture quality controlling method of the liquid crystal display device according to the present invention increases or decreases the data, which are to be displayed in the link sub-pixel, to the charge characteristic compensation data in a second compensation step subsequent to the foregoing first compensation step.

For example, when the charge characteristic compensation data for each location and for each gray level are set as in TABLE 3 below in relation to the link sub-pixel, the second compensation step adds '00000100(4)' to '01000000(64)' to modulate the digital video data, which are to be displayed in a 'location 1'to '01000100(68)' if the digital video data, which are to be displayed at the 'location 1'is '01000000(64)' corresponding to a 'gray level section 1'and adds '00000110 (6)' to '10000000(128)' to modulate the digital video data, which are to be displayed in a 'location 2'to '10000110(134)' if the digital video data, which are to be displayed at the 'location 2'is '10000000(128)' corresponding to a 'gray level section 3'.

TABLE 3

| classification | Gray level area | Location 1 | Location 2 |
|---|---|---|---|
| Gray level section 1 | 00000000(0)~00110010(50) | 00000100(4) | 00000010(2) |
| Gray level section 2 | 00110011(51)~01110000(112) | 00000110(6) | 00000100(4) |
| Gray level section 3 | 01110001(113)~10111110(190) | 00001000(8) | 00000110(6) |

As described above, the second compensation step forms the link sub-pixel by electrically connecting the defect sub-pixel with the normal sub-pixel which is adjacent to and has the same color as the defect sub-pixel, and modulates the digital video data, which are to be displayed at the link sub-pixel, to the compensation data which are set up in advance for compensating the charge characteristic of the link sub-pixel. Thus, it is possible to reduce the degree of perceiving the defect sub-pixel and to compensate the charge characteristic of the link sub-pixel inclusive of the defect sub-pixel.

In addition, it is possible to generate a case that the location of the link sub-pixel overlaps the location of the bordering part and the first display surface on the display panel. In such a case, the charge characteristic compensation data are calculated in consideration of the summed compensation data value for the location where the location of the link sub-pixel overlaps the location of the bordering part and the first display surface. For example, if the panel defect compensation data in a specific gray level (area) is calculated to '+2' and the charge characteristic compensation data is calculated to '+6' as the compensation data without consideration of the location overlapping (i.e., the compensation data independently calculated for each location) in relation to the location where the link sub-pixel overlaps the first display surface and the bordering part, then the picture quality controlling method according to the embodiment of the present invention compensates the charge characteristic for the link sub-pixel by '+2' in the first compensation step in relation to the overlapping location, thereby compensation the charge characteristic by '+4' (+6−2) for the link sub-pixel in the second compensation step.

Figure 21:
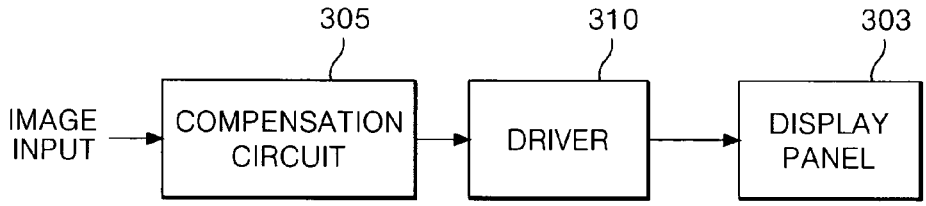
FIG. 21 is a block diagram representing a configuration of a flat panel display device according to an embodiment of the present invention.

In order to realize the picture quality controlling method according to the embodiment of the present invention, as described above, the liquid crystal display device according to the embodiment of the present invention, as shown in FIG. 21, includes a compensation circuit 205 which receives the video data, modulates the video data, and supplies the modulated video data to a driver 210 that drives a display panel 203.

Figure 22:
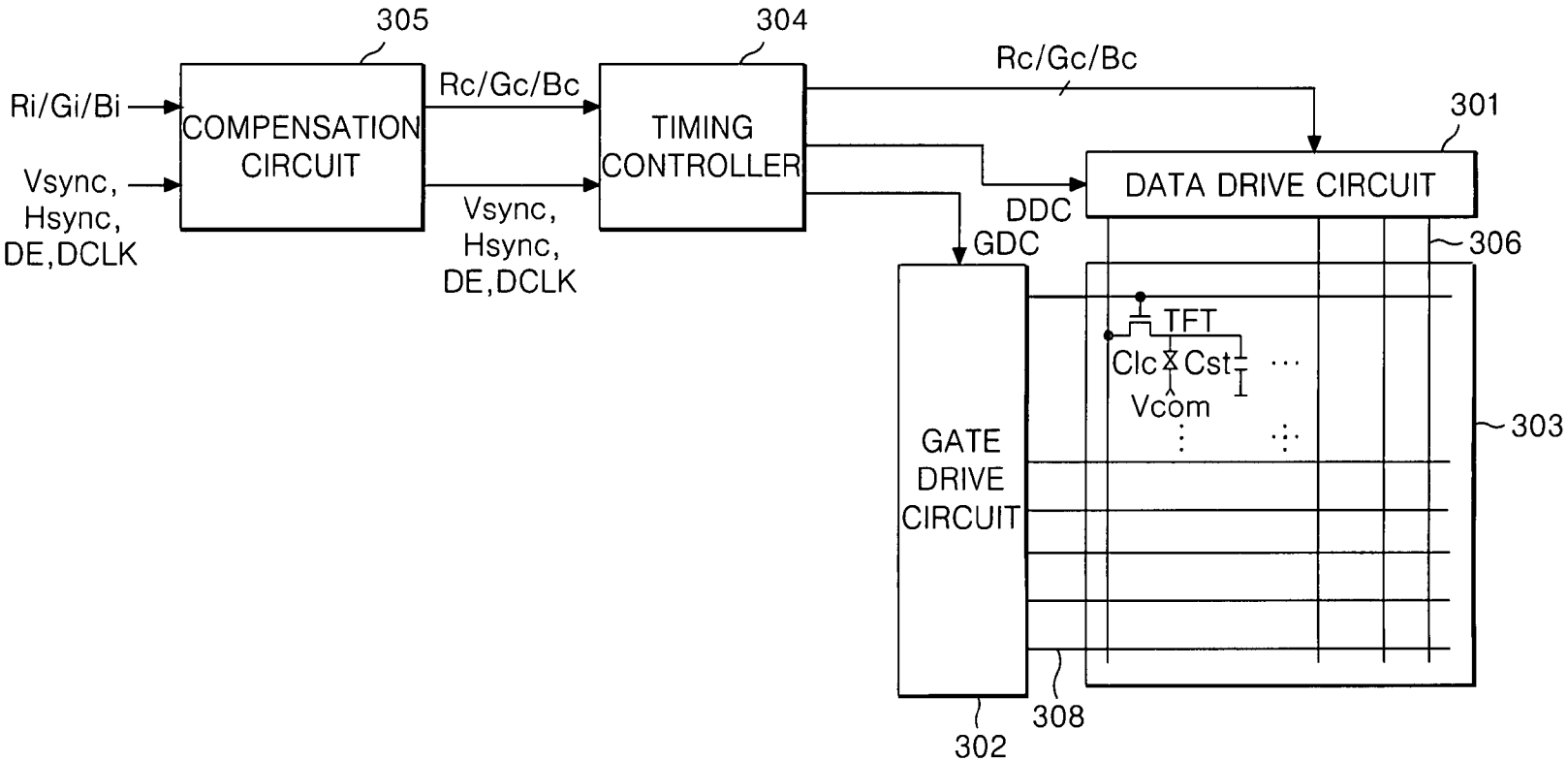
FIG. 22 is a block diagram representing a flat panel display device according to an embodiment of the present invention.

Next, FIG. 22 represents a liquid crystal display device according to an embodiment of the present invention. Referring to FIG. 22, the liquid crystal display device includes a display panel 303 where data lines 306 cross gate lines 308 and a TFT for driving a liquid crystal cell Clc is formed at each of the crossing parts thereof, a compensation circuit 305 for generating the corrected digital video data Rc/Gc/Bc, a data drive circuit 301 for converting the corrected digital video data Rc/Gc/Bc into an analog data voltage to supply to the data lines 306, a gate drive circuit 102 for supplying a scan signal to the gate lines 308, and a timing controller 304 for controlling the data drive circuit 301 and the gate drive circuit 302.

Further, the display panel 303 has liquid crystal molecules injected between two substrates (i.e., a TFT substrate and color filter substrate). The data lines 306 and the gate lines 308 formed on the TFT substrate are at right angles to each other. The TFT formed at the crossing part of the data lines 306 and the gate lines 308 supplies the data voltage supplied through the data line 306 to the pixel electrode of the liquid crystal cell Clc in response to the scan signal from the gate line 308. Further, a black matrix, a color filter and a common electrode (not shown) are formed on the color filter substrate. In addition, the common electrode formed on the color filter substrate can be formed on the TFT substrate in accordance with an electric field application method. Polarizers having a vertical polarizing axis to each other are respectively adhered to the TFT substrate and the color filter substrate.

In addition, the compensation circuit 305 receives the input digital video data Ri/Gi/Bi from a system interface to modulate the input digital video data Ri/Gi/Bi, which are to be displayed at the location of the panel defect, to generate the corrected digital video data Rc/Gc/Bc. The compensation circuit 305 will be explained in detail later.

Further, the timing controller 304 supplies the corrected digital video data Rc/Gc/Bc, which are supplied through the compensation circuit 305, to the data drive circuit 301 in accordance with the dot clock DCLK and generates a gate control signal GDC for controlling the gate drive circuit 302 and a data control signal DDC for controlling the data drive circuit 301 using a vertical/horizontal synchronization signal Vsync, Hsync, a data enable signal DE and a dot clock DCLK. Further, the data drive circuit 301 receives the corrected digital video data Rc/Gc/Bc and converts the corrected digital video data Rc/Gc/Bc into the analog gamma compensation voltage (data voltage) to supply to the data lines 306 of the display panel 303 under control of the timing controller 304.

In addition, the gate drive circuit 302 supplies a scan signal to the gate lines 308 to turn on the TFT's connected to the gate lines 308, thereby selecting the liquid crystal cells Clc of one horizontal line where the data voltages are to be displayed. The analog data voltage generated from the data drive circuit 301 is synchronized with the scan signal to be supplied to the liquid crystal cells Clc of the selected one horizontal line.

Next, a detail description on the compensation circuit 305 will be given with reference to FIGS. 23 to 31.

Figure 23:
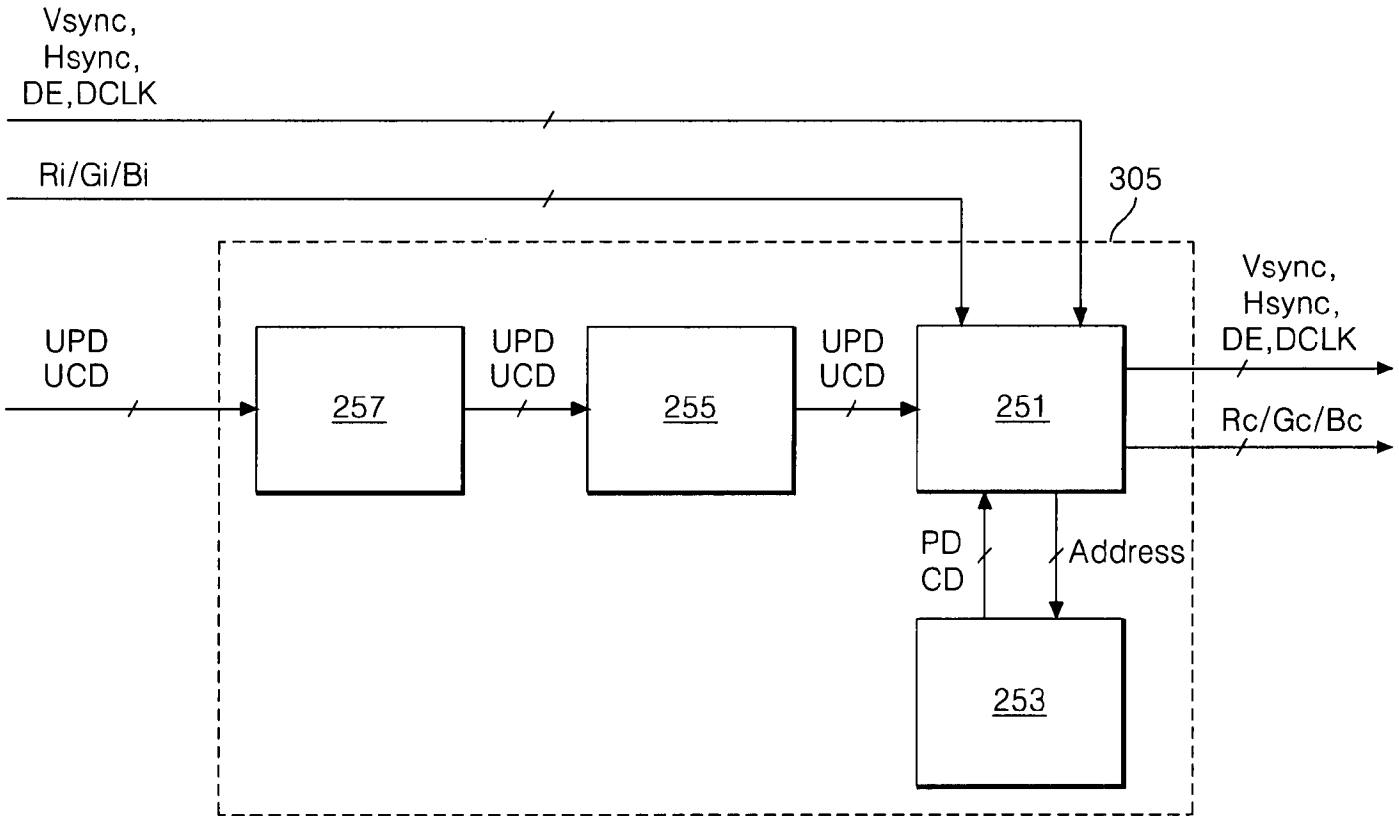
FIG. 23 is a block diagram representing a compensation circuit shown in FIG. 22.

Referring to FIG. 23, the compensation circuit 305 includes an EEPROM 253 which stores a location data PD indicating the location of the panel defect, the bordering part and the link sub-pixel, a summed compensation data for compensating the brightness which is to be displayed at the first display surface and the bordering part, and a charge characteristic compensation data CD for compensating the charge characteristic of the link sub-pixel, a compensation part 251 for generating the corrected digital video data Rc,Gc,Bc by modulating the input video digital data Ri/Gi/Bi using the location data PD and the compensation data CD which are stored at the EEPROM 253, an interface circuit 257 for communication between the compensation circuit 305 and an external system, and a register 255 for temporarily storing the data which are to be stored at the EEPROM 253 through the interface circuit 257.

The EEPROM 253 temporally stores the location data PD indicating the location of the panel defect area, the bordering part and the link sub-pixel, a final panel defect compensation data UCD for compensating the brightness of the first display surface and the bordering part, and a compensation data UCD. Hereinafter, in reference to FIG. 24 to 31, embodiments of the compensation part 251 according to the present invention will be explained in detail.

Figure 24:
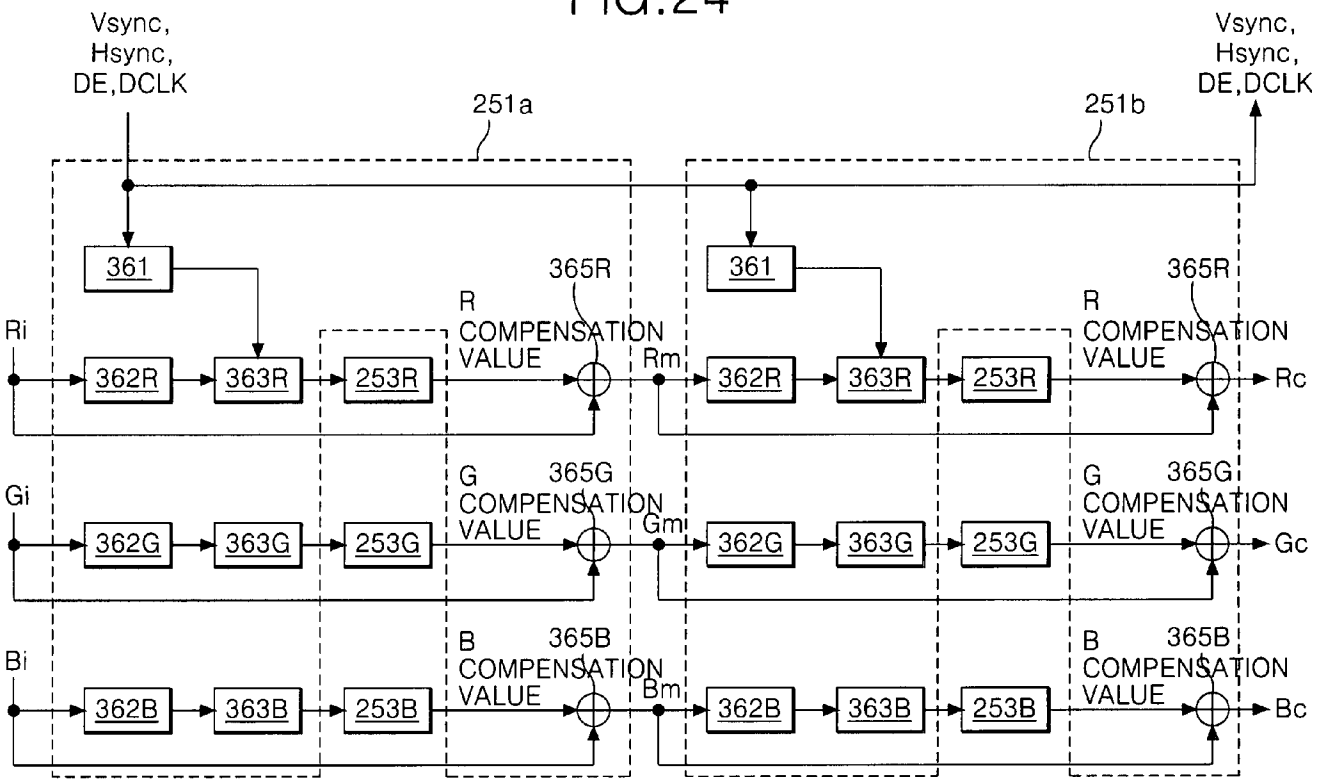
FIG. 24 is a block diagram representing a first embodiment of the compensation circuit shown in FIG. 23.

Referring to FIG. 24, a compensation part 251 according to a first embodiment of the present invention includes a first compensation part 251A which modulates the input digital video data Ri/Gi/Bi, which are to be displayed in the first display surface and the bordering part, using the summed compensation data CD and the location data PD of the first display surface and the bordering part that are stored at the EEPROM 253, and a second compensation part 251B which modulates the digital video data Rm/Gm/Bm, which are modulated by the first compensation part 251A, using the charge characteristic compensation data.

Further, the first compensation data 251A generates the digital video data Rm/Gm/Bm that are intermediately modulated by increasing and decreasing the data, which are to be displayed in the first display surface and the bordering part, among the input digital video data Ri/Gi/Bi to the summed compensation data which are stored at the EEPROM 253. The first compensation part 251A includes a location judging part 361, a gray level judging part 362, an address generating part 363, and operators 365R, 365G, 365B. Further, the EEPROM 253 referred by the first compensation part 251A includes the EEPROM 253R, 253G, 253B for each of red R, green G and blue B, which stores the final panel defect compensation data CD and the location data PD of the first display surface and the bordering part.

In addition, the location judging part 361 judges the display location of the input digital video data Ri/Gi/Bi on the display panel 303 using a vertical/horizontal synchronization signal Vsync, Hsync, a data enable signal DE and a dot clock DCLK. The gray level judging part 362 includes a gray level judging part 362R, 362G, 362B for each of red R, green G and blue B, which analyzes the gray level of the input digital video data Ri/Gi/Bi.

The address generator 363 includes an address generator 363R, 363G, 363B for each red R, green G and blue B color. The address generator 363R, 363G, 363B generates a read address for reading the summed compensation data of the location to supply to the EEPROM 253R, 253G, 253B if the display location of the input digital video data Ri/Gi/Bi on the display panel 303 corresponds to the first display surface and the bordering part in reference to the location data of the first display surface and the bordering part of the EEPROM 253R, 253G, 253B. The summed compensation data outputted from the EEPROM 253R, 253G, 253B are supplied to the operator 365R, 365G, 365B in accordance with the read address.

The operator includes an operator 365R, 365G, 365B for each red R, green G and blue B color. The operator 365R, 365G, 365B adds the summed compensation data to or subtracts the summed compensation data from the input digital video data Ri/Gi/Bi, thereby modulating the input digital video data Ri/Gi/Bi which are to be displayed at the first display surface and the bordering part. Further, the operator 365R, 365G, 365B may include a multiplier or a divider for multiplying or dividing the input digital video data Ri/Gi/Bi by the summed compensation data besides the adder and subtractor.

The second compensation part 251B generates the corrected digital video data Rc/Gc/Bc by increasing and decreasing the data, which are to be displayed in the link sub-pixel 13, among the digital video data Rm/Gm/Bm to the charge characteristic compensation data which are stored at the EEPROM 253. The second compensation part 251B includes a location judging part 361, a gray level judging part 362, an address generating part 363, and an operator 365. In addition, the EEPROM 253 referred by the second compensation part 251B includes the EEPROM 253R, 253G, 253B for each red R, green G and blue B color, which stores the charge characteristic compensation data CD and the location data PD of the link sub-pixel 13.

The location judging part 361 judges the display location of the modulated digital video data Rm/Gm/Bm on the display panel 303 using a vertical/horizontal synchronization signal Vsync, Hsync, a data enable signal DE and a dot clock DCLK. The gray level judging part 362 includes a gray level judging part 362R, 362G, 362B for each red R, green G and blue B color. The gray level judging part 362R, 362G, 362B analyzes the gray level of the input digital video data Ri/Gi/Bi.

In addition, the address generator 363 includes an address generator 363R, 363G, 363B for each red R, green G and blue B color. The address generator 363R, 363G, 363B generates a read address for reading the charge characteristic compensation data of the location of the link sub-pixel 13 to supply to the EEPROM 253R, 253G, 253B if the display location of the modulated digital video data Rm/Gm/Bm on the display panel 303 corresponds to the location of the link sub-pixel 13 in reference to the location data of the link sub-pixel 13 of the EEPROM 253R, 253G, 253B. The charge characteristic compensation data outputted from the EEPROM 253R, 253G, 253B are supplied to the operator 365R, 365G, 365B in accordance with the read address.

The operator includes an operator 365R, 365G, 365B for each red R, green G and blue B color. The operator 365R, 365G, 365B adds the charge characteristic compensation data to or subtracts the charge characteristic compensation data from the modulated digital video data Rm/Gm/Bm, thereby modulating the input digital video data Ri/Gi/Bi which are to be displayed at the normal sub-pixel 11 included in the link sub-pixel 13. Further, the operator 365R, 365G, 365B may include a multiplier or a divider for multiplying or dividing the input digital video data Ri/Gi/Bi by the charge characteristic compensation data besides the adder and subtractor.

The digital video data Rc, Gc, Bc which are modulated by the foregoing first and second compensation parts 251A and 251B to compensate the charge characteristic of the link sub-pixel and the brightness of the bordering part and the first display surface (i.e., the corrected digital video data Rc, Gc, Bc) are supplied to the display panel 303 through the drive circuit 310, thereby displaying the picture of which the picture quality is corrected.

Figure 25:
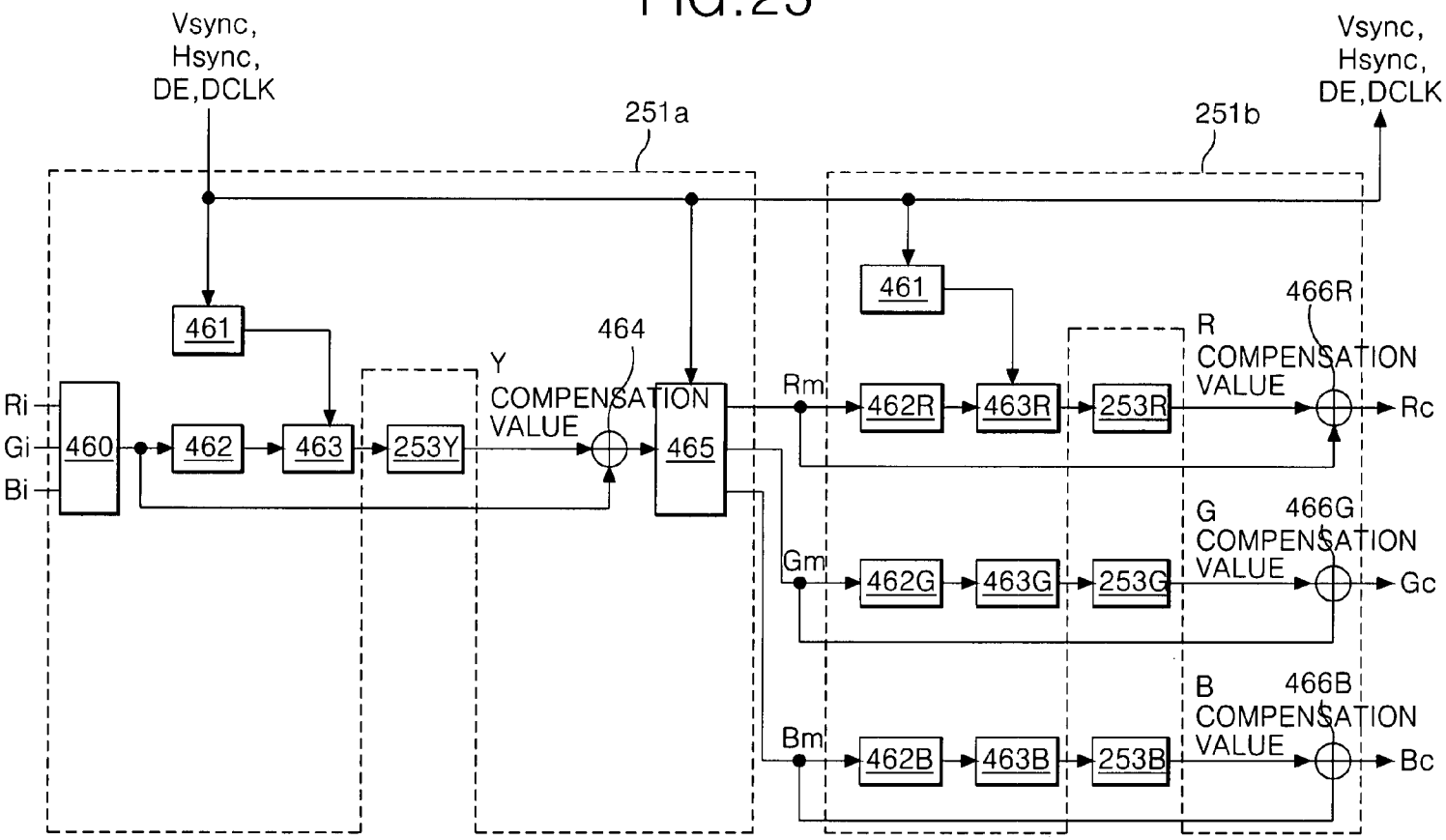
FIG. 25 is a block diagram representing a second embodiment of the compensation circuit shown in FIG. 23.

Referring to FIG. 25, the compensation part 251 according to the second embodiment of the present invention includes a first compensation part 251A which modulates the input digital video data Ri/Gi/Bi, which are to be displayed in the first display surface and the bordering part, using the summed compensation data CD and the location data PD of the first display surface and the bordering part that are stored at the EEPROM 253, and a second compensation part 251B which modulates the digital video data Rm/Gm/Bm, which are modulated by the first compensation part 251A, using the charge characteristic compensation data.

The first compensation part 251A includes an RGB to YUV converter 460, a location judging part 461, a gray level judging part 462, an address generating part 463, an operator 464, and a YUV to RGB converter 465. In addition, the EEPROM 253Y referred by the first compensation part 251A stores the panel defect compensation data for each location and for each gray level for finely modulating the brightness information Yi of the input digital video data Ri/Gi/Bi which are to be displayed at the first display surface and the bordering part.

Further, the RGB to YUV converter 360 calculates the brightness information Yi and the color difference information Ui/Vi of n/n/n (n is an integer higher than m) bits using the below Mathematical Formulas 1 to 3 which take the input digital video data Ri/Gi/Bi having the R/G/B data of m/m/m bits as a variable.

$$Yi=0.299Ri+0.587Gi+0.114Bi \quad \text{(Mathematical Formula 1)}$$

$$Ui=-0.147Ri-0.289Gi+0.436Bi=0.492(Bi-Y) \quad \text{(Mathematical Formula 2)}$$

$$Vi=0.615Ri-0.515Gi-0.100Bi=0.877(Ri-Y) \quad \text{(Mathematical Formula 3)}$$

The location judging part 461 judges the display location of the input digital video data Ri/Gi/Bi on the display panel 303 by use of a vertical/horizontal synchronization signal Vsync, Hsync, a data enable signal DE and a dot clock DCLK. The gray level judging part 462 analyzes the gray level of the input digital video data Ri/Gi/Bi on the basis of the brightness information Yi from the RGB to YUV converter 460. Further, the address generator 463 generates a read address for reading the panel defect compensation data of the panel defect location to supply to the EEPROM 253Y if the display location of the input digital video data Ri/Gi/Bi corresponds to the panel defect location in reference to the panel defect location data of the EEPROM 253Y.

The panel defect compensation data outputted from the EEPROM 253Y in accordance with the address are supplied to the operator 464. The operator 464 adds the panel defect compensation data from the EEPROM 253Y to or subtracts the panel defect compensation data from the brightness information Yi of n bits which is supplied from the RGB to YUV converter 460, thereby modulating the brightness of the input digital video data Ri/Gi/Bi which are to be displayed at the panel defect location. Further, the operator 464 may include a multiplier or a divider for multiplying or dividing the brightness information Yi of n bits by the panel defect compensation data besides the adder and subtractor.

In addition, the brightness information Yc modulated by the operator 464 in this way increases or decreases the brightness information Yi of the increased n bits, and thus the brightness of the input digital video data Ri/Gi/Bi can be finely adjusted to the fractional part. The YUV to RGB converter 465 calculates the modulated data Rm/Gm/Bm of m/m/m bits by use of the following Mathematical Formulas 4 to 6 which take the brightness information Yc which is modulated by the operator 464 and the color difference information Ui/Vi from the RGB to YUV converter 460 as a variable.

$$Rm=Yc+1.140Vi \quad \text{(Mathematical Formula 4)}$$

$$Gm=Yc-0.395Ui-0.581Vi \quad \text{(Mathematical Formula 5)}$$

$$Bm=Yc+2.032Ui \quad \text{(Mathematical Formula 6)}$$

Further, the second compensation part 251B generates the corrected digital video data Rc/Gc/Bc by increasing and decreasing the digital video data, which are to be displayed in the link sub-pixel 13, among the digital video data Rm/Gm/Bm, which are modulated by the first compensation part 251A, to the charge characteristic compensation data, which are stored at the EEPROM 253. The second compensation part 251B includes a location judging part 461, a gray level judging part 462, an address generating part 463, and an operator 466. The EEPROM 253R, 253G, 253B referred by the second compensation part 251B stores the charge characteristic compensation data CD and the location data PD of the link sub-pixel 13 separately for each red R, green G and blue B color.

The location judging part 461 judges the location of the display panel 303 where the modulated digital video data Rm/Gm/Bm are to be displayed using a vertical/horizontal synchronization signal Vsync, Hsync, a data enable signal DE and a dot clock DCLK. The gray level judging part 462R, 464G, 462B analyzes the gray level of the input digital video data Ri/Gi/Bi for each red R, green G and blue B color.

The address generator 463R, 463G, 463B generates a read address for reading the charge characteristic compensation data of the location of the link sub-pixel 13 to supply to the EEPROM 253R, 253G, 253B if the display location of the modulated digital video data Rm/Gm/Bm corresponds to the location of the link sub-pixel 13 in reference to the location data of the link sub-pixel 13 in the EEPROM 253R, 253G, 253B. Further, the charge characteristic compensation data outputted from the EEPROM 253R, 253G, 253B are supplied to the operator 466R, 466G, 466B in accordance with the read address.

Further, the operator 466R, 466G, 466B adds the charge characteristic compensation data to or subtracts the charge characteristic compensation data from the digital video data Rm/Gm/Bm which are modulated for each red R, green G and blue B color, thereby modulating the input digital video data Ri/Gi/Bi which are to be displayed at the normal sub-pixel 11 included in the link sub-pixel 13. Further, the operator 466R, 466G, 466B may include a multiplier or a divider for multiplying or dividing the input digital video data Ri/Gi/Bi by the charge characteristic compensation data besides the adder and subtractor.

The digital video data Rc, Gc, Bc which are modulated by the foregoing first and second compensation parts 251A and 251B to compensate the charge characteristic of the link sub-pixel and the brightness of the bordering part and the first display surface (i.e., the corrected digital video data Rc, Gc, Bc) are converted into the drive signal, which is suitable for driving the display panel 303, by the drive circuit 310 to be displayed in the display panel 303.

Figure 26:
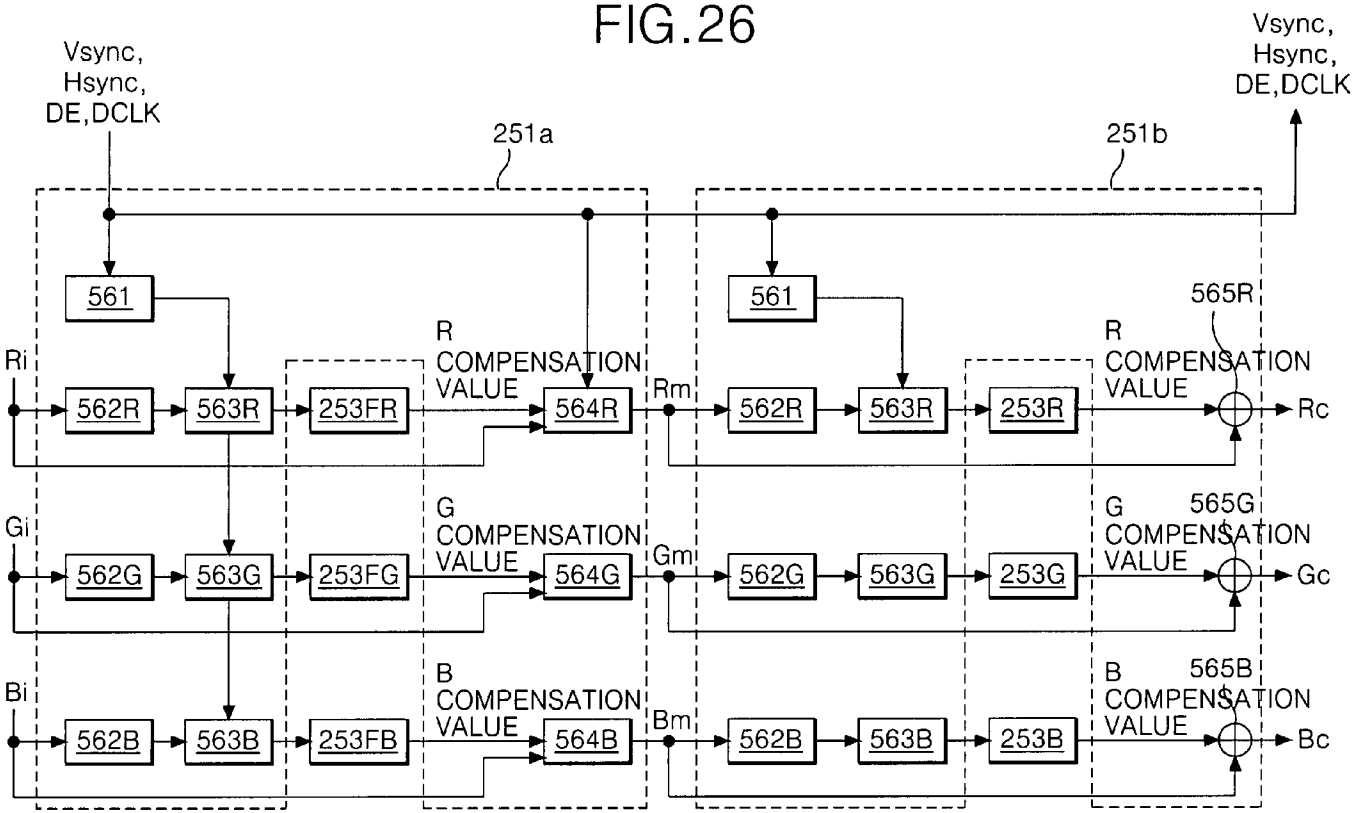
FIGS. 26 and 27 are block diagrams representing a third embodiment of the compensation circuit shown in FIG. 23.

Referring to FIG. 26, a compensation part 251 according to a third embodiment of the present invention includes a first compensation part 251A which modulates the input digital video data Ri/Gi/Bi, which are to be displayed in the first display surface and the bordering part, by an FRC method using the summed compensation data CD and the location data PD of the first display surface and the bordering part that are stored at the EEPROM 253, and a second compensation part 251B which modulates the digital video data Rm/Gm/Bm, which are modulated by the first compensation part 251A, using the charge characteristic compensation data.

The first compensation data 251A includes a location judging part 561, a gray level judging part 562, an address generating part 563, and an FRC controller 564. The EEPROM 253FR, 253FG, 253FB referred by the first compensation part 251A stores the summed compensation data CD and the location data PD of the first display surface and the bordering part separately for each red R, green G and blue B color.

The location judging part 561 judges the display location of the input digital video data Ri/Gi/Bi by use of a vertical/horizontal synchronization signal Vsync, Hsync, a data enable signal DE and a dot clock DCLK. The gray level judging part 562 analyzes the gray level of the input digital video data Ri/Gi/Bi for each red R, green G and blue B color.

The address generator 563 generates a read address for reading the compensation data of the first display surface and the bordering part to supply to the EEPROM 253FR, 253FG, 253FB if the display location of the modulated input digital video data Rm/Gm/Bm corresponds to the first display surface and the bordering part in reference to the location data of the first display surface and the bordering part for each pixel in the EEPROM 253FR, 253FG, 253FB. The compensation data outputted from the EEPROM 253FR, 253FG, 253FB are supplied to the FRC controller 564R, 564G, 564B in accordance with the read address.

If the compensation data which are optimized in the specific gray level and location of the first display surface and the bordering part is 0.5 (1/2), the FRC controller 564R, 564G, 564B adds '1' gray level to the data which are to be displayed in the corresponding to the first display surface and the bordering part for two frame periods out of four frame periods, as in FIG. 17(*b*), to compensate the data Ri/Gi/Bi, which are to be displayed in the first display surface and the bordering part, by 0.5 gray level. The FRC controller 564R, 564G, 564B has a circuit configuration as in FIG. 27.

Figure 27:
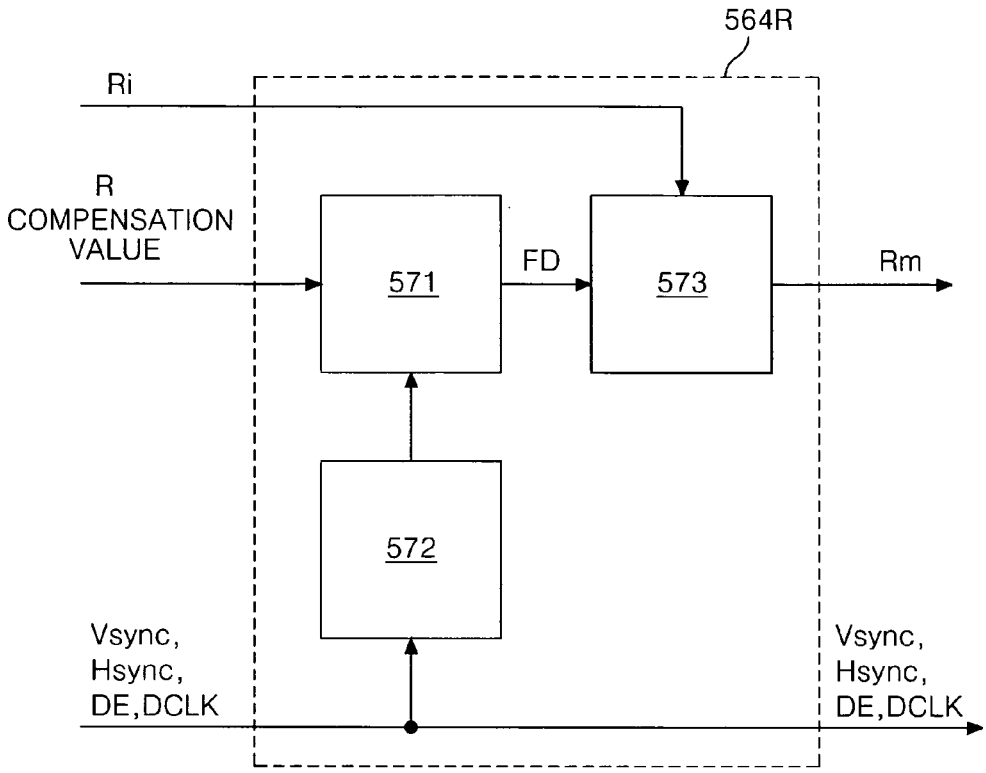

In more detail, FIG. 27 represents a first FRC controller 564R for correcting red data in detail. In addition, second and third FRC controllers 564G, 564B substantially have the same circuit configuration as the first FRC controller 564R. Referring to FIG. 27, the first FRC controller 564R includes a compensation value judging part 571, a frame number sensing part 572 and an operator 573.

The compensation value judging part 571 judges the R compensation value and generates the FRC data FD with the value divided by the number of frames. For example, when four frames are set as one frame group of the FRC, the compensation value judging part 571 judges the R compensation data '01' as the data where 1/4 gray level is to be added to the display gray level of the first display surface and the bordering part data corresponding thereto, if the compensation value judging part 571 is pre-programmed so that the R compensation data '00' is perceived to be the compensation value for 0 gray level, the R compensation data '01' is perceived to be the compensation value for 1/4 gray level, the R compensation data '10' is perceived to be the compensation value for 1/2 gray level, and the R compensation data '11' is perceived to be the compensation value for 3/4 gray level. If the gray level of the R compensation data is judged in this way, in order to compensate 1/4 gray level to the input digital video data Ri/Gi/Bi which are to be displayed in the first display surface and the bordering part corresponding thereto, the compensation value judging part 571 generates the FRC data FD of '1' in one frame period, when one gray level is to be added, of the first to fourth frames and generates the FRC data FD of '0' for the remaining three frame periods, as shown in (a) of FIG. 17.

The frame number sensing part 572 senses the number of frames using any one or more of a vertical/horizontal synchronization signal Vsync, Hsync, a dot clock DCLK and a data enable signal DE. For example, the frame number sensing part 572 can sense the number of frames by counting the vertical synchronization signal Vsync. The operator 573 increases or decreases the input digital video data Ri/Gi/Bi to the FRC data FD, thereby generating the corrected digital video data Rm.

In addition, the input digital video data Ri/Gi/Bi to be corrected and the summed compensation data CD can each be supplied to the FRC controller 564A, 564G, 564B through a different data transmission circuit, or can be supplied in the same line. For example, if the input digital video data Ri/Gi/Bi to be corrected is '01000000' of 8 bits and the summed compensation data CD is '011' of 3 bits, the '01000000' and '011' can be supplied to the FRC controller 564R, 564G, 564B through the different data transmission lines respectively or they can be combined to an 11 bit data of '01000000011' to be supplied to the FRC controller 564R, 564G, S64B. In case that the input digital video data Ri/Gi/Bi and the summed compensation data CD are combined to the 11 bit data which are to be supplied to the FRC controller 564R, 564G, 564B, the FRC controller 564R, 564G, 564B perceives the upper 8 bits out of the 11 bit data as the input digital video data Ri/Gi/Bi to be corrected and perceives the lower 3 bits as the compensation data CD, thereby performing the FRC control. On the other hand, as an example of the method of generating the data of '01000000011' into which the above '01000000' and '011' are combined, there is a method that a dummy bit '000' is added to the lowest bit of '01000000' to convert them into '01000000000' and '011' is added thereto to generate the data of '01000000011'.

As described above, the first compensation part 251A according to the third embodiment of the present invention can correct the data, which are to be displayed in the panel defect location, in detail by sub-dividing into 1021 gray levels when assuming that the input R,G,B digital video data are each 8 bits and four frame periods is one frame group for the compensation value to be temporally dispersed.

The second compensation part 251B generates the second-modulated digital video data Rc/Gc/Bc by increasing and decreasing the data, which are to be displayed in the link sub-pixel 13, among the digital video data Rm/Gm/Bm, which are modulated by the first compensation part 251A, to the charge characteristic compensation data, which are stored at the EEPROM 253. The second compensation part 251B includes a location judging part 561, a gray level judging part 562, an address generating part 563, and an operator 565. The EEPROM 253R, 253G, 253B referred by the second compensation part 251B stores the charge characteristic compensation data CD and the location data PD of the link sub-pixel 13 separately for each red R, green G and blue B color.

The location judging part 561 judges the display location of the modulated digital video data Rm/Gm/Bm using a vertical/horizontal synchronization signal Vsync, Hsync, a data enable signal DE and a dot clock DCLK. The gray level judging part 562 includes a gray level judging part 562R, 562G, 562B for each of red R, green G and blue B color. The gray level judging part 562R, 562G, 562B analyzes the gray level of the input digital video data Ri/Gi/Bi.

The address generator 563R, 563G, 563B generates a read address for reading the charge characteristic compensation data of the location of the link sub-pixel 13 to supply to the EEPROM 253R, 253G, 253B if the display location of the modulated digital video data Rm/Gm/Bm corresponds to the location of the link sub-pixel 13 in reference to the location data of the link sub-pixel 13 of the EEPROM 253R, 253G, 253B. The charge characteristic compensation data outputted from the EEPROM 253R, 253G, 253B are supplied to the operator 565R, 565G, 565B in accordance with the read address.

The operator 565R, 565G, 565B adds the charge characteristic compensation data to or subtracts the charge characteristic compensation data from the modulated digital video data Rm/Gm/Bm, thereby modulating the input digital video data Ri/Gi/Bi which are to be displayed at the normal sub-pixel 11 included in the link sub-pixel 13. Further, the operator 565R, 565G, 565B may include a multiplier or a divider for multiplying or dividing the input digital video data Ri/Gi/Bi by the charge characteristic compensation data besides the adder and subtractor.

The digital video data Rc, Gc, Bc which are modulated by the foregoing first and second compensation parts 251A, 251B to compensate the charge characteristic of the link sub-pixel and the brightness of the bordering part and the first display surface (i.e., the first and second corrected digital video data Rc, Gc, Bc) are converted into a drive signal which is suitable for driving the display panel 303 through the drive circuit 310, thereby being displayed in the display panel 303.

Figure 28:
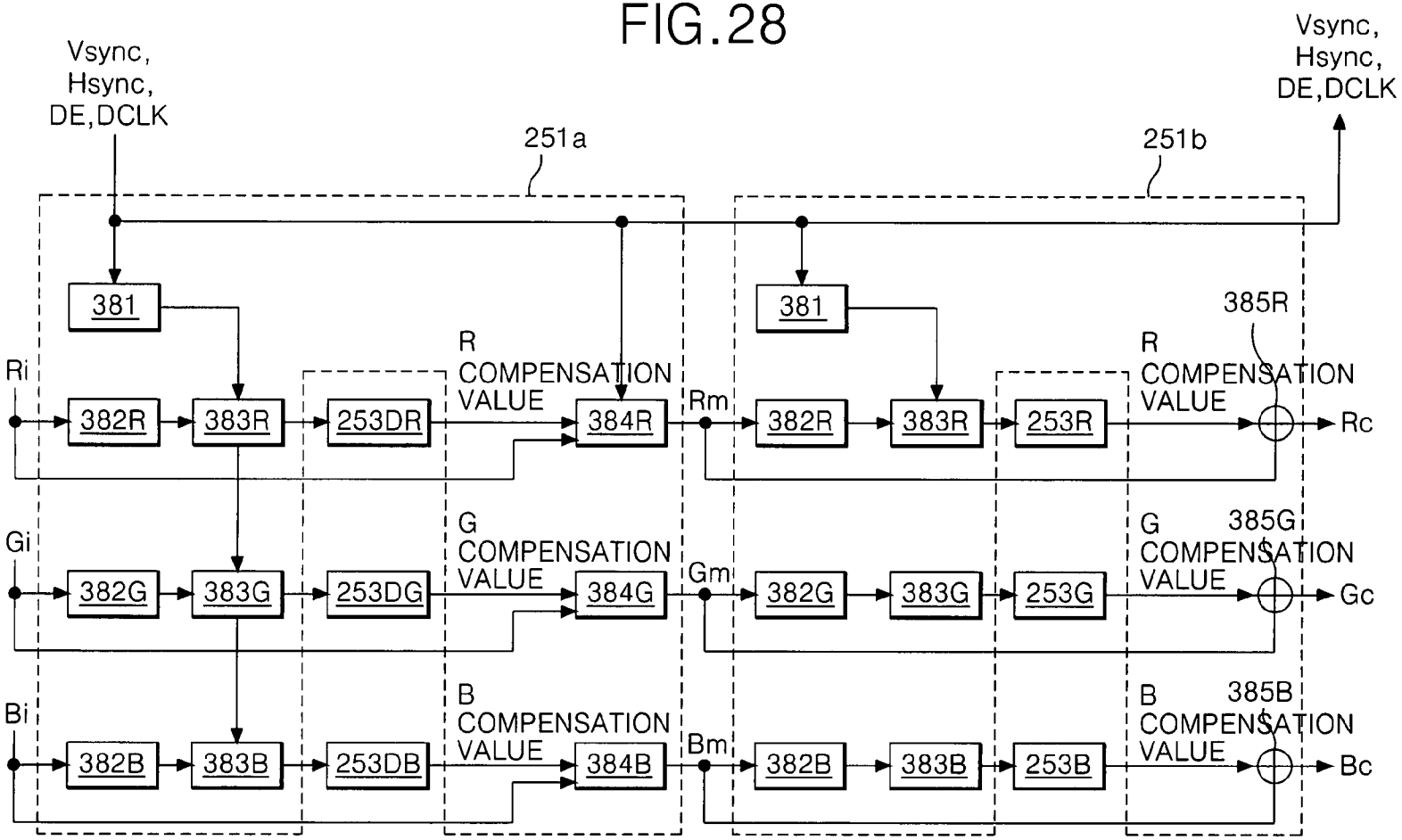
FIGS. 28 and 29 are block diagrams representing a fourth embodiment of the compensation circuit shown in FIG. 23.

Referring to FIG. 28, a compensation part 251 according to a fourth embodiment of the present invention includes a first compensation part 251A which modulates the input digital video data Ri/Gi/Bi, which are to be displayed in the first display surface and the bordering part, by a dithering method by use of the summed compensation data CD and the location data PD of the first display surface and the bordering part that are stored at the EEPROM 253; and a second compensation part 251B which modulates the digital video data Rm/Gm/Bm, which are modulated by the first compensation part 251A, using the charge characteristic compensation data.

The first compensation data 251A includes a location judging part 381, a gray level judging part 382, an address generating part 383, and a dithering controller 384. Further, the EEPROM 253 referred by the first compensation part 251A includes the EEPROM 235DR, 235DG, 235DB for each red R, green G and blue B color, which stores the summed compensation data CD and the location data PD of the first display surface and the bordering part.

The location judging part 381 judges the display location of the input digital video data Ri/Gi/Bi using a vertical/horizontal synchronization signal Vsync, Hsync, a data enable signal DE and a dot clock DCLK. The gray level judging part 382R, 382G, 382B analyzes the gray level of the input digital video data Ri/Gi/Bi.

The address generator 383R, 383G, 383B generates a read address for reading the summed compensation data of the location thereof to supply to the EEPROM 253DR, 253DG, 253DB if the display location of the input digital video data Ri/Gi/Bi on the display panel 303 corresponds to the first display surface and the bordering part in reference to the location data of the first display surface and the bordering part in the EEPROM 253DR, 253DG, 253DB. The compensation data outputted from the EEPROM 253DR, 253DG, 253DB are supplied to the dithering controller 384R, 384G, 384B in accordance with the read address.

The dithering controller 384R, 384G, 384B disperses the summed compensation data from the EEPROM 253DR, 253DG, 253DB to each of the pixels of a unit pixel window that includes a plurality of pixels, thereby modulating the input digital video data Ri/Gi/Bi which are to be display in the first display surface and the bordering part.

Figure 29:
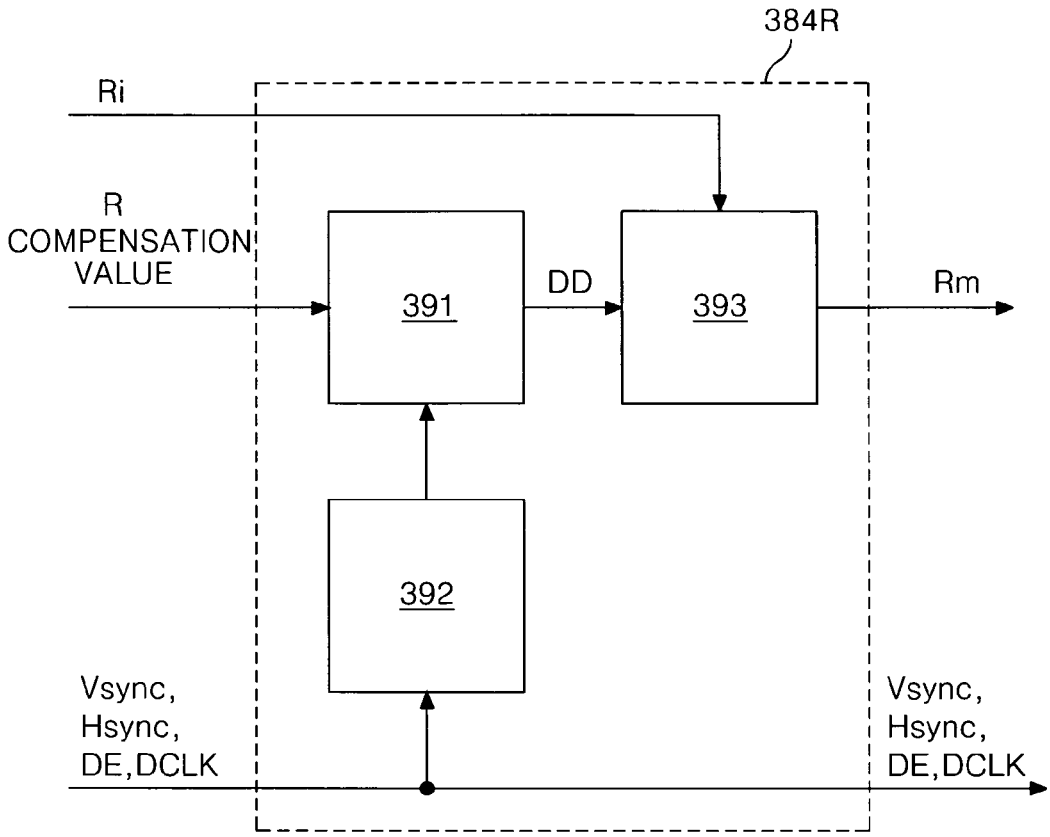

Next, FIG. 29 represents a first dithering controller 384R for correcting red data in detail. In addition, the second and third dithering controllers 384G, 384B substantially have the same circuit configuration as the first dithering controller 384R. Referring to FIG. 29, the first dithering controller 384R includes a compensation value judging part 391, a pixel location sensing part 392 and an operator 393.

The compensation value judging part 391 judges the R compensation value and generates a dithering data DD with the compensation value which is to be dispersed to the pixels included within a unit pixel window. The compensation value judging part 391 is programmed to automatically output the dithering data DD in accordance with the R compensation value. For example, when it is pre-programmed that the compensation value of the unit pixel window is perceived for 1/4 gray level if the R compensation value expressed as a binary data is '00'the compensation value of the unit pixel window is perceived for 1/2 gray level if the R compensation value is '10'and the compensation value of the unit pixel window is perceived for 3/4 gray level if the R compensation value is '11', the compensation value judging part 391 generates '1' as the dithering data DD in one pixel location within the unit pixel window if four pixels are included in the unit pixel window and the R compensation value is '01'but generates '0' a the dithering data DD in the remaining three pixel locations. The dithering data DD is increased or decreased for each pixel location within the unit pixel window from the input digital video data by the operator 332 as shown in FIG. 18.

The pixel location sensing part 392 senses the pixel location using any one or more of a vertical/horizontal synchronization signal Vsync, Hsync, a dot clock DCLK and a data enable signal DE. For example, the pixel location sensing part 392 can sense the pixel location by counting the horizontal synchronization signal Hsync and the dot clock DCLK. The operator 393 increases or decreases the input digital video data Ri/Gi/Bi to the dithering data DD, thereby generating the modulated digital video data Rm.

In addition, the input digital video data Ri/Gi/Bi to be corrected and the summed compensation data CD can each be supplied to the dithering controller 384 through a different data transmission circuit, or can combined to be supplied in the same line. For example, if the input digital video data Ri/Gi/Bi to be corrected is '01000000' of 8 bits and the panel defect compensation data CD is '011' of 3 bits, the '01000000' and '011' can be supplied to the dithering controller 384 through the different data transmission lines respectively or they can be combined to an 11 bit data of '01000000011' to be supplied to the dithering controller 384. When the input digital video data Ri/Gi/Bi and the summed compensation data CD are combined to the 11 bit data to be supplied to the dithering controller 384, the dithering controller 384 perceives the upper 8 bits out of the 11 bit data as the input digital video data Ri/Gi/Bi to be corrected and perceives the lower 3 bits as the compensation data CD, thereby performing the dithering control. On the other hand, as an example of the method of generating the data of '01000000011' into which the above '01000000' and '011' are combined, there is a method that a dummy bit '000' is added to the lowest bit of '01000000' to convert them into '01000000000' and '011' is added thereto to generate the data of '01000000011'.

As described above, the first compensation part 251A according to the fourth embodiment of the present invention can finely adjust the data, which are to be displayed in the panel defect location, with the compensation value which is sub-divided into 1021 gray levels for each of R, G and B when assuming that the unit pixel window is composed of four pixels.

Further, the second compensation part 251B generates the second-modulated digital video data Rc/Gc/Bc by increasing and decreasing the data, which are to be displayed in the link sub-pixel 13, among the digital video data Rm/Gm/Bm, which are modulated by the first compensation part 251A, to the charge characteristic compensation data, which are stored at the EEPROM 253. The second compensation part 251B includes a location judging part 381, a gray level judging part 382, an address generating part 383, and an operator 385.

The EEPROM 253R, 253G, 253B referred by the second compensation part 251B stores the charge characteristic compensation data CD and the location data PD of the link sub-pixel 13 separately for each of red R, green G and blue B color. The location judging part 381 judges the display location of the modulated digital video data Rm/Gm/Bm by use of a vertical/horizontal synchronization signal Vsync, Hsync, a data enable signal DE and a dot clock DCLK.

The gray level judging part 382R, 382G, 382B analyzes the gray level of the input digital video data Ri/Gi/Bi. Further, the address generator 383R, 383G, 383B generates a read address for reading the charge characteristic compensation data of the location of the link sub-pixel 13 to supply to the EEPROM 253R, 253G, 253B if the display location of the modulated digital video data Rm/Gm/Bm corresponds to the location of the link sub-pixel 13 in reference to the location data of the link sub-pixel 13 of the EEPROM 253R, 253G, 253B. The charge characteristic compensation data outputted from the EEPROM 253R, 253G, 253B are supplied to the operator 385R, 385G, 385B in accordance with the read address.

The operator 385R, 385G, 385B adds the charge characteristic compensation data to or subtracts the charge characteristic compensation data from the modulated digital video data Rm/Gm/Bm, thereby modulating the input digital video data Ri/Gi/Bi which are to be displayed at the normal sub-pixel 11 included in the link sub-pixel 13. The operator 385R, 385G, 385B may include a multiplier or a divider for multiplying or dividing the input digital video data Ri/Gi/Bi by the charge characteristic compensation data besides the adder and subtractor.

The digital video data Rc, Gc, Bc which are modulated by the foregoing first and second compensation parts 251A, 251B to compensate the charge characteristic of the link sub-pixel and the brightness of the bordering part and the first display surface, i.e., the first and second corrected digital video data Rc, Gc, Bc, are displayed in the display panel 303 through the drive circuit 310.

Figure 30:
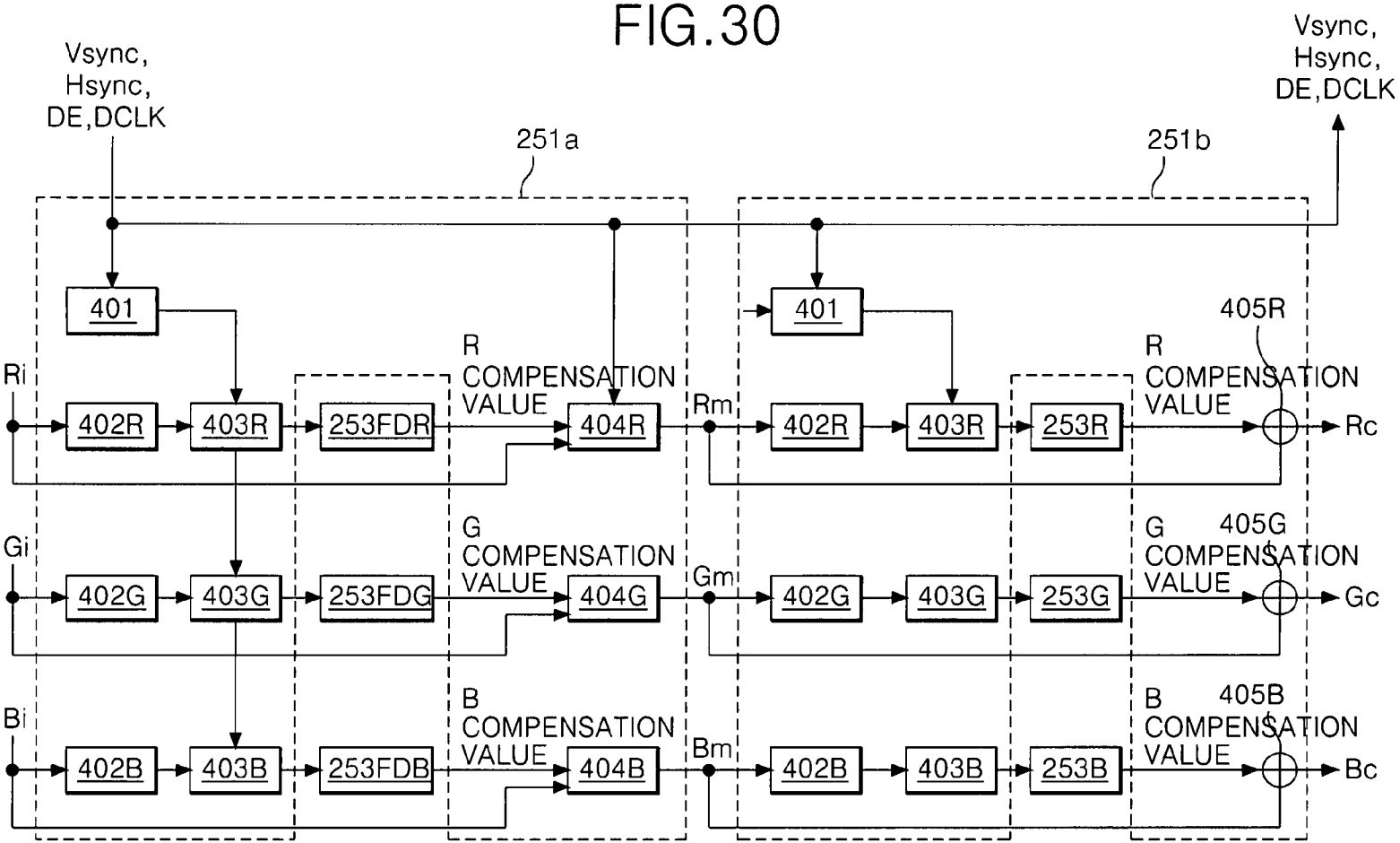
FIGS. 30 and 31 are block diagrams representing a fifth embodiment of the compensation circuit shown in FIG. 23.

Referring to FIG. 30, a compensation part 251 according to a fifth embodiment of the present invention includes a first compensation part 251A which modulates the input digital video data Ri/Gi/Bi, which are to be displayed in the first display surface and the bordering part, by FRC and dithering methods using the summed compensation data CD and the location data PD of the first display surface and the bordering part that are stored at the EEPROM 253, and a second compensation part 251B which modulates the digital video data Rm/Gm/Bm, which are modulated by the first compensation part 251A, by use of the charge characteristic compensation data.

The first compensation data 251A includes a location judging part 401, a gray level judging part 402, an address generating part 403, and an FRC & dithering controller 404. The EEPROM 253 referred by the first compensation part 251A includes the EEPROM 253FDR, 253FDG, 253FDB for each red R, green G and blue B color, which stores the summed compensation data CD and the location data PD of the first display surface and the bordering part.

The location judging part 401 judges the display location of the input digital video data Ri/Gi/Bi using a vertical/horizontal synchronization signal Vsync, Hsync, a data enable signal DE and a dot clock DCLK. The gray level judging part 402R, 402G, 402B analyzes the gray level of the input digital video data Ri/Gi/Bi.

In addition, the address generator 403R, 403G, 403B generates a read address for reading the panel defect compensation data of the location thereof to supply to the EEPROM 253FDR, 253FDG, 253FDB if the display location of the input digital video data Ri/Gi/Bi corresponds to the first display surface and the bordering part in reference to the location data of the panel defect in the EEPROM 253FDR, 253FDG, 253FDB. The summed compensation data outputted from the EEPROM 253FDR, 253FDG, 253FDB are supplied to the FRC & dithering controller 404R, 404G, 404B in accordance with the read address.

The FRC & dithering controller 404R, 404G, 404B disperses the summed compensation data from the EEPROM 253FDR, 253FDG, 253FDB to each of the pixels of a unit pixel window that includes a plurality of pixels, and disperses the summed compensation data to a plurality of frame periods, thereby modulating the input digital video data Ri/Gi/Bi which are to be display in the first display surface and the bordering part.

Figure 31:
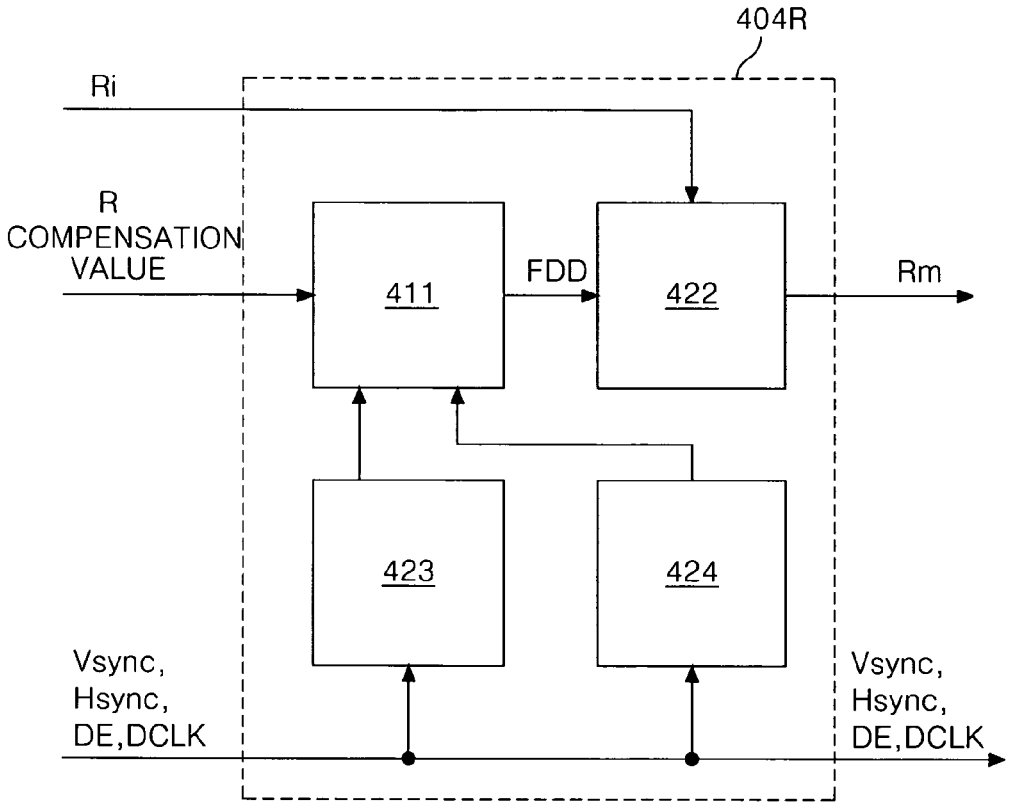

Next, FIG. 31 represents a first FRC & dithering controller 404R for correcting red data in detail. Second and third FRC & dithering controllers 404G, 404B substantially have the same circuit configuration as the first FRC & dithering controller 404R. Referring to FIG. 31, the first FRC & dithering controller 404R includes a compensation value judging part 411, a frame number sensing part 423, a pixel location sensing part 424 and an operator 422.

The compensation value judging part 411 judges the R compensation value and generates the FRC & dithering data FDD with the value which is to be dispersed to the pixels included in a unit pixel window and to a plurality of frame periods. The compensation value judging part 411 is programmed to automatically output the FRC & dithering data DD in accordance with the R compensation value. For example, the compensation value judging part 411 is preprogrammed so that the compensation value is perceived for 0 gray level if the R panel defect compensation value is '00'the compensation value is perceived for 1/4 gray level if the R panel defect compensation value is '01'the compensation value is perceived for 1/2 gray level if the R compensation value is '10', and the compensation value is perceived for 3/4 gray level if the R compensation value is '11'. Assuming that the R panel defect compensation data is '01'four frame periods are one FRC frame group and four pixels are configured as a unit pixel window of the dithering, the compensation value judging part 411 generates '1' as the FRC & dithering data RDD at the location of one pixel within the unit pixel window for four frame periods and generates '0' as the FRC & dithering data RDD at the location of remaining three pixels, as in FIG. 19, but the location of the pixel where '1' is generated is changed for each frame.

The frame number sensing part 423 senses the number of frames using any one or more of a vertical/horizontal synchronization signal Vsync, Hsync, a dot clock DCLK and a data enable signal DE. For example, the frame number sensing part 423 can sense the number of frames by counting the vertical synchronization signal Vsync. The pixel location sensing part 424 senses the pixel location by use of any one or more of a vertical/horizontal synchronization signal Vsync, Hsync, a dot clock DCLK and a data enable signal DE. For example, the pixel location sensing part 424 can sense the pixel location by counting the horizontal synchronization signal Hsync and the dot clock DCLK.

The operator 422 increases or decreases the input digital video data Ri/Gi/Bi to the FRC & dithering data FDD, thereby generating the modulated digital video data Rm. In addition, the input digital video data Ri/Gi/Bi to be corrected and the summed compensation data CD can each be supplied to the FRC & dithering controller 404A, 404G, 404B through a different data transmission circuit, or can be combined to be supplied in the same line. For example, if the input digital video data Ri/Gi/Bi to be corrected is '01000000' of 8 bits and the summed compensation data CD is '011' of 3 bits, as in TABLE 2, the '01000000' and '011' can be supplied to the FRC and dithering controller 404R, 404G, 404B through the different data transmission lines respectively or they can be combined to an 11 bit data of '01000000011' to be supplied to the FRC & dithering controller 404R, 404G, 404B.

When the input digital video data Ri/Gi/Bi to be corrected and the summed compensation data CD are combined to the 11 bit data to be supplied to the FRC & dithering controller 404R, 404G, 404B, the FRC & dithering controller 404R, 404G, 404B perceives the upper 8 bits out of the 11 bit data as the input digital video data Ri/Gi/Bi to be corrected and perceives the lower 3 bits as the panel defect compensation data CD, thereby performing the FRC & dithering control. In addition, as an example of the method of generating the data of '01000000011' into which the above '01000000' and '011' are combined, there is a method that a dummy bit '000' is added to the lowest bit of '01000000' to convert them into '01000000000' and '011' is added thereto to generate the data of '01000000011'.

As described above, the first compensation part 251A according to the fifth embodiment of the present invention can finely adjust the data, which are to be displayed in the panel defect location, with the compensation value which is sub-divided into 1021 gray levels for each of R, G and B with almost no flicker and resolution deterioration when assuming that the unit pixel window is composed of four pixels and four frame periods are one FRC frame group.

The second compensation part 251B generates the second-modulated digital video data Rc/Gc/Bc by increasing and decreasing the data, which are to be displayed in the link sub-pixel 13, among the digital video data Rm/Gm/Bm, which are modulated by the first compensation part 251A, to the charge characteristic compensation data, which are stored at the EEPROM 253.

The second compensation part 251B includes a location judging part 401, a gray level judging part 402R, 402G, 402B, an address generating part 403R, 403G, 403B, and an operator 405R, 405G, 405B. The EEPROM 253R, 253G, 253B referred by the second compensation part 251B stores the charge characteristic compensation data CD and the location data PD of the link sub-pixel 13 separately for each of red R, green G and blue B color.

The location judging part 401 judges the display location of the modulated digital video data Rm/Gm/Bm by use of a vertical/horizontal synchronization signal Vsync, Hsync, a data enable signal DE and a dot clock DCLK. Further, the gray level judging part 402R, 402G, 402B analyzes the gray level of the input digital video data Ri/Gi/Bi.

The address generator 403R, 403G, 403B generates a read address for reading the charge characteristic compensation data of the location of the link sub-pixel 13 to supply to the EEPROM 253R, 253G, 253B if the display location of the modulated digital video data Rm/Gm/Bm corresponds to the location of the link sub-pixel 13 in reference to the location data of the link sub-pixel 13 of the EEPROM 253R, 253G, 253B. The charge characteristic compensation data outputted from the EEPROM 253R, 253G, 253B are supplied to the operator 405R, 405G, 405B in accordance with the read address.

The operator 405R, 405G, 405B adds the charge characteristic compensation data to or subtracts the charge characteristic compensation data from the modulated digital video data Rm/Gm/Bm for each of red R, green G and blue B color, thereby modulating the input digital video data Ri/Gi/Bi which are to be displayed at the normal sub-pixel 11 included in the link sub-pixel 13. The operator 405R, 405G, 405B may include a multiplier or a divider for multiplying or dividing the input digital video data Ri/Gi/Bi by the charge characteristic compensation data besides the adder and subtractor.

The digital video data Rc, Gc, Bc which are modulated by the foregoing first and second compensation parts 251A, 251B to compensate the charge characteristic of the link sub-pixel and the brightness of the bordering part and the first display surface (i.e., the first and second modulated digital video data Rc, Gc, Bc) are displayed in the display panel 303 through the drive circuit 310.

The first compensation data in the foregoing embodiments has been explained centering on the example of being added to the digital video data, which are to be displayed in the first display surface when being applied to each of the pixels of the first display surface, of which the brightness is measured relatively lower, but can be applied to each of the pixels of the second display surface so as the brightness to be the same as the brightness of the first display surface. In other words, the compensation value of the first compensation data can be subtracted from the digital video data, which are to be displayed in each of the pixels of the second display surface, so that the brightness of the second display surface is identical to the brightness of the first display surface in the same gray level.

In addition, the first compensation data in the foregoing embodiments has been explained centering on the example of being determined as the compensation values which correspond to each of the pixels within the first display surface in order to compensate the brightness of the first display surface in comparison with the normal area, but can include the data for compensating the brightness non uniformity of the backlight unit in the liquid crystal display device. That is, the liquid crystal display device is not a self luminous device, and thus it requires a backlight unit for irradiating light to a liquid crystal display panel.

The backlight unit includes an edge type backlight unit and a direct type backlight unit in accordance with a lamp location. The edge backlight unit disposes a lamp in one side edge of the liquid crystal display panel and converts the light from the lamp into a surface light though a light guide panel and a plurality of optical sheets to irradiate to the liquid crystal display panel. In comparison with this, the direct type backlight unit disposes a light source such as a plurality of lamps and/or light emitting diodes right under the liquid crystal display panel to irradiate the light from the light source to the liquid crystal display panel through a diffusion plate and a plurality of optical sheets.

Further, the direct type backlight unit has an advantage in that the light can be irradiated to the liquid crystal display panel with a high brightness in a large-sized screen, but the light is irradiated with a relatively high brightness at the location of the light sources and the light is irradiated with a relatively low brightness between the light sources, and thus the brightness can be non uniform in accordance with the location of the screen. When the lamp is used as the light source in the direct type backlight unit, a phenomenon of being shown bright in accordance with the lamp is called "lamp bright line".

Accordingly, the brightness non uniformity of the backlight unit is measured, and as the result of the measure, in order to compensate the brightness of an area where the brightness of the backlight unit is relatively low, the compensation value can be determined for increasing the brightness of the digital video data which are to be displayed in a part of the display surface of the liquid crystal display panel corresponding to the area where the brightness of the backlight unit is low. The compensation value can be included in the first compensation data. In this instance, the area where the brightness of the backlight unit is low can be positioned within the second display surface of the liquid crystal display panel, and thus the first compensation data can be applied to each pixel within the first display surface, and can also be applied to each pixel of the areas where the brightness of the backlight unit is low within the normal area.

The flat panel display device and the fabricating method thereof, and the picture quality controlling method and apparatus according to the foregoing embodiment of the present invention has been explained centering on the liquid crystal display device, but can similarly be applied to other flat panel display devices such as an active matrix organic light emitting diode OLED, etc.

As described above, the picture quality controlling method and a flat panel display device using the same according to the present invention can compensate the brightness of the link sub-pixel by adding the charge characteristic compensation data to the data which are to be displayed in the link sub-pixel, and can improve the display stain, which appears in various shapes due to various causes, by compensating the brightness of the first display surface between the first and second display surfaces, of which the brightness is different in the same gray level, and by compensating the brightness of the data, which are to be displayed in the first display surface and the bordering part, by use of the compensation data for compensating the brightness of the bordering part between the first and second display surfaces.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A picture quality controlling method, comprising:

determining a charge characteristic compensation data that compensates a charge characteristic of a link sub-pixel which is electrically connected to a defect sub-pixel and a normal sub-pixel that is adjacent to the defect sub-pixel in a display panel, wherein the defect sub-pixel and the normal sub-pixel have a same color and are electrically connected each other via a link pattern to charge a same data;

judging a first display surface and a second display surface, which are different in brightness from each other, by supplying a test data to the display panel to measure a brightness of the display panel, wherein the first display surface is a defective area and the second display surface is a normal area;

determining a first compensation data which compensates a brightness of the first display surface;

modulating the test data of the first display surface using the first compensation data;

determining a second compensation data that corrects a brightness of a bordering part inclusive of a part of the first display surface and a part of the second display surface between the first and second display surfaces by supplying the modulated test data to the first display surface;

adding the first compensation data and the second compensation data to calculate a summed compensation data;

storing the charge characteristic compensation data and the summed compensation data in a memory;

adjusting a video data, which is to be displayed in the link sub-pixel, using the charge characteristic compensation data stored in the memory; and adjusting a video data, which is to be displayed in the first display surface and the bordering part, using the summed compensation data that is stored at the memory, wherein the first compensation data has a same or different compensation value for pixels which are horizontally adjacent in at least a part of the first display surface, and wherein the second compensation data is determined to have a different compensation value from each other for vertically adjacent pixels and to have a different compensation value from each other for horizontally adjacent pixels in at least a part of the bordering part.

2. The picture quality controlling method according to claim 1, wherein the charge characteristic compensation data is different in accordance with a location and a gray level of the link sub-pixel.

3. The picture quality controlling method according to claim 1, wherein the memory includes at least one of an EEPROM and an EDID ROM.

4. The picture quality controlling method according to claim 1, further comprising:

opening a current path between the defect sub-pixel and a data line of the display panel; and electrically connecting a pixel electrode of the defect sub-pixel to a pixel electrode of the normal sub-pixel.

5. The picture quality controlling method according to claim 1, wherein the first compensation data is different in accordance with a pixel location within the first display surface and a gray level of the data which is to be displayed in the first display surface.

6. The picture quality controlling method according to claim 1, wherein the second compensation data is different in accordance with a pixel location within the bordering part and a gray level of the data which is to be displayed in the bordering part.

7. The picture quality controlling method according to claim 1, wherein the second compensation data is determined to be a compensation value which increases the brightness of the first display surface and the second display surface that are included in the bordering part.

8. The picture quality controlling method according to claim 1, wherein the second compensation data is determined to be a compensation value which decreases the brightness of the first display surface and the second display surface that are included in the bordering part.

9. The picture quality controlling method according to claim 1, wherein the second compensation data is determined to have a compensation value which increases the brightness of the first display surface and the brightness of the second display surface included in the bordering part.

10. The picture quality controlling method according to claim 1, wherein the first and second compensation data are determined to have different compensation values from each other for the same pixel.

11. The picture quality controlling method according to claim 10, wherein the second compensation data is determined to have a compensation value which is lower in a degree of brightness compensation than the first compensation data for the same pixel.

12. The picture quality controlling method according to claim 1, wherein the second compensation data is determined to have a compensation value which decreases the brightness of the first display surface included in the bordering part and increases the brightness of the second display surface included in the bordering part.

13. The picture quality controlling method according to claim 1, wherein the first and second compensation data are determined to have a compensation value which is lower in a degree of brightness compensation than the charge characteristic compensation data for a same pixel.

14. The picture quality controlling method according to claim 1, wherein adjusting the video data which is to be displayed in the first display surface and the bordering part includes:

extracting a brightness information and a color difference information of n (n is an integer higher than m) bits from a red data of m bits, a green data of m bits and a blue data of m bits which are to be displayed in the first display surface and the bordering part;

generating the modulated brightness information of n bits by adjusting the brightness information of n bits with the summed compensation data; and generating a modulated red data of m bits, a modulated green data of m bits and a modulated blue data of m bits using the color difference information and the modulated brightness information of n bits.

15. The picture quality controlling method according to claim 1, wherein adjusting the video data which is to be displayed in the first display surface and the bordering part includes:

dispersing a compensation value of the summed compensation data using at least one of a frame rate control (FRC) method and a dithering method; and adjusting the data, which is to be displayed in the first display surface and the bordering part, with the dispersed data.

16. The picture quality controlling method according to claim 1, wherein the first compensation data includes the data which compensates a brightness of a backlight unit that irradiates light to the display panel.

17. A flat panel display device, comprising:

a memory that stores a charge characteristic compensation data for compensating a charge characteristic of a link sub-pixel which is electrically connected to a defect sub-pixel and a normal sub-pixel adjacent to the defect sub-pixel in a display panel, and a compensation data including a first compensation value for compensating a brightness of a first display surface out of first and second display surfaces which are displayed differently in brightness in the display panel and a second compensation value for compensating a brightness of a bordering part which includes a part of a first display surface and a part of a second display surface between the first display surface and the second display surface, wherein the first display surface is a defective area and the second display surface is a normal area;

a first compensation part for adjusting the data, which is to be displayed in the first display surface and the bordering part, using the compensation data;

a second compensation part for adjusting the data, which is to be displayed in the link sub-pixel, from the first compensation part using the charge characteristic compensation data; and a driver for displaying the data from the second compensation part in the display panel, wherein the compensation data is a summed compensation data which includes a sum of the first compensation value for compensating the brightness of the first display surface and the second compensation value for compensating the brightness of the bordering part, wherein the defect sub-pixel and the normal sub-pixel of the link sub-pixel have a same color and are electrically connected to each other via a link pattern to charge a same data, wherein the compensation data has a same compensation value for pixels which are horizontally adjacent in at least a part of the first display surface, and wherein the compensation data is determined to have a different compensation value from each other for vertically adjacent pixels and to have a different compensation value from each other for horizontally adjacent pixels in at least a part of the bordering part.

18. The flat panel display device according to claim 17, wherein the charge characteristic compensation data is different in accordance with the gray level and location of the link sub-pixel.

19. The flat panel display device according to claim 17, wherein the memory includes at least one of an EEPROM and an EDID ROM.

20. The flat panel display device according to claim 17, wherein a current path between the defect sub-pixel and a data line of a display panel is opened, and a pixel electrode of the defect sub-pixel is electrically connected to a pixel electrode of the normal sub-pixel.

21. The flat panel display device according to claim 17, wherein the compensation data is different in accordance with a pixel location within the first display surface and the bordering part, and a gray level of the data which is to be displayed in the first display surface.

22. The flat panel display device according to claim 17, wherein the compensation data is determined to be a compensation value which increases the brightness of the first display surface and the second display surface that are included in the bordering part.

23. The flat panel display device according to claim 17, wherein the compensation data is determined to be a compensation value which decreases the brightness of the first display surface and the second display surface that are included in the bordering part.

24. The flat panel display device according to claim 17, wherein the first compensation part includes:

an RGB to YUV converter for extracting a brightness information and a color difference information of n (n is an integer higher than m) bits from a red data of m bits, a green data of m bits and a blue data of m bits which are to be displayed in the first display surface and the bordering part;

an operator for generating the modulated brightness information of n bits by adjusting the brightness information of n bits with the summed compensation data; and a YUV to RGB converter for generating a modulated red data of m bits, a modulated green data of m bits and a modulated blue data of m bits by use of the color difference information and the modulated brightness information of n bits.

25. The flat panel display device according to claim 17, wherein the first compensation part disperses a compensation value of the summed compensation data using at least one of a frame rate control (FRC) method and a dithering method, and adjusts the data, which is to be displayed in the first display surface and the bordering part, with the dispersed data.

26. The flat panel display device according to claim 17, wherein the first compensation value includes a compensation value which compensates a brightness of a backlight unit that irradiates light to the display panel.

* * * * *